US005595379A

United States Patent [19]

Hoang

[11] Patent Number: 5,595,379

[45] Date of Patent: Jan. 21, 1997

[54] OPERATOR INTERFACE APPARATUS AND METHOD FOR ADJUSTING BINDING LINE TIMING

[75] Inventor: Thang Hoang, Valinda, Calif.

[73] Assignee: R. R. Donnelley & Sons Company, Lisle, Ill.

[21] Appl. No.: 410,060

[22] Filed: Mar. 24, 1995

Related U.S. Application Data

[63] Continuation-in-part of Ser. No. 124,307, Sep. 20, 1993, abandoned.

[51] Int. Cl.[6] ..... B65H 39/043

[52] U.S. Cl. ..... 270/52.06; 270/52.29; 270/58.29

[58] Field of Search ..... 270/52.04, 52.05, 270/52.06, 52.15, 52.16, 52.26, 52.27, 58.03, 58.29; 271/9.01, 9.05, 9.12, 9.13, 11, 12; 364/471, 478

[56] References Cited

U.S. PATENT DOCUMENTS

| | | | |
|---|---|---|---|
| 3,519,264 | 7/1970 | Beacham et al. | 270/58.03 |
| 3,525,516 | 8/1970 | Bushnell et al. | 270/52.04 |
| 3,578,310 | 5/1971 | Carson, Jr. | 270/52.04 |
| 3,656,738 | 4/1972 | Glasser et al. | 270/58.03 |
| 3,819,173 | 6/1974 | Anderson et al. . | |
| 3,924,846 | 12/1975 | Reed | 270/52.04 X |
| 3,972,521 | 8/1976 | Reed | 270/52.04 |
| 4,022,455 | 5/1977 | Newsome et al. | 270/52.29 |
| 4,121,818 | 10/1978 | Riley et al. . | |
| 4,168,828 | 9/1979 | McLear . | |
| 4,241,907 | 12/1980 | McCain et al. . | |
| 4,484,733 | 11/1984 | Loos et al. . | |
| 4,511,130 | 4/1985 | Barton et al. . | |
| 4,753,430 | 6/1988 | Rowe et al. | 270/58.03 |
| 4,757,984 | 7/1988 | Rowe et al. | 270/58.03 |
| 4,789,147 | 12/1988 | Berger et al. | 270/52.16 X |
| 4,799,661 | 1/1989 | Nail | 270/52.04 |
| 4,923,189 | 5/1990 | Nail | 270/52.04 |
| 4,925,174 | 5/1990 | Bruce et al. | 270/52.04 |
| 4,936,562 | 6/1990 | Rowe | 270/56 |
| 5,011,123 | 4/1991 | Vigano . | |
| 5,105,363 | 4/1992 | Dragon et al. . | |
| 5,135,211 | 8/1992 | Barnebey | 270/52.04 |
| 5,144,562 | 9/1992 | Stikkelorum et al. . | |
| 5,316,281 | 5/1994 | Bale et al. | 270/52.18 |
| 5,326,087 | 7/1994 | Colson et al. | 270/58.02 |
| 5,346,196 | 9/1994 | Nussbaum et al. . | |
| 5,413,321 | 5/1995 | Banks et al. | 270/52.05 |
| 5,458,323 | 10/1995 | Magee et al. | 270/52.18 |

*Primary Examiner*—John E. Ryznic
*Attorney, Agent, or Firm*—Marshall, O'Toole, Gerstein, Murray & Borun

[57] ABSTRACT

A timing-adjustment apparatus and method for adjusting a gathering section of a binding line is operable during an initial operational sequence of the binding line for storing a defined time period during which a condition of a feeding device of the binding line is expected to arise in each subsequent operational sequence of the binding line. The apparatus is operable during a subsequent operational sequence of the binding line for either developing an indication for an operator of the binding line that the defined time period has been reached and enabling the operator to change the defined time period in a subsequent operational sequence based on the indication or for automatically updating the defined time period during the subsequent operational sequence in response to operator input to the apparatus.

72 Claims, 29 Drawing Sheets

| TW | Actions Performed | Called from: |
|---|---|---|
| 800 | SET UP ALL SADDLE EYES | |
| | 1. Execute constant-initialization subroutine (Figs 8A-8B). | Block 304, Fig. 7A |
| | 2. Execute saddle-eye set-up subroutine (Figs 9A-9B). | |
| | • This subroutine executes conversion subroutine (Fig. 10) to convert saddle-eye timing points to bit patterns. | Block 306, Fig. 7A |
| 801-832 | SET UP TIMING POINTS AND SHIFT-REGISTER POSITIONS FOR SELECTED DEVICE | |
| | 1. Execute constant-initialization subroutine (Figs 8A-8B). | Block 312, Fig. 7B |
| | 2. Execute timing/shift-register set-up subroutine (Figs. 11A-11F). | |
| | • This subroutine executes conversion subroutine (Fig. 12) to convert solenoid and feed-line eye timing points to bit patterns. | Block 314, Fig. 7B |
| 999 | SET UP TIMING POINTS AND SHIFT-REGISTER POSITIONS FOR ALL POCKETS | |
| | 1. Set Auto Setup Mode bit ASM. | |
| | 2. Execute constant-initialization subroutine (Figs. 8A-8B). | Block 317, Fig. 7C |
| | 3. Execute auto pocket set-up subroutine (Fig. 13). | Block 318, Fig. 7C |
| | • This subroutine executes timing/shift-register set-up subroutine (Figs. 11a-11F), once for each pocket. During each execution, the set-up routine, in turn, executes the conversion subroutine (Fig. 12) to convert solenoid and feed-line eye timing points to bit patterns. | Block 320, Fig. 7C |

FIGURE 6

OPERATOR INTERFACE APPARATUS AND METHOD FOR ADJUSTING BINDING LINE TIMING

CROSS-REFERENCE TO RELATED APPLICATION

This application is a continuation-in-part of U.S. application Ser. No. 08/124,307, filed Sep. 20, 1993, now abandoned.

TECHNICAL FIELD

The present invention relates generally to binding lines and, more particularly, to an interface apparatus for allowing timing parameters of components in a binding line to be adjusted manually and/or automatically.

BACKGROUND OF THE INVENTION

In a typical binding line, a gathering chain for conveying a plurality of signatures along a gathering section of the binding line extends in a path along which a row of feeding devices, such as pockets (which are also called packer boxes), card-feeders, and SMUF and Dragon PTF devices, are disposed. The gathering chain forms a closed loop and includes a plurality of gathering pins disposed at spaced locations dividing the gathering chain into a plurality of chain spaces. The feeding devices are selectively operative to place printed signatures on selected chain spaces as the gathering chain advances along the length of the gathering section.

A typical chain space, for example, is initially empty, and the feeding devices selectively deposit signatures on the chain space atop previously-gathered signatures, if any. Thus, at the end of the gathering section, the chain space has a stack of signatures deposited thereon.

Each stack is transferred from the gathering section to a stitcher unless the stack is first rejected by a reject gate. The reject gate rejects a stack if a bit in a shift register corresponding to the chain space in which the stack was assembled is set, indicating that the stack was found to be defective by sensors located in the feeding devices or otherwise disposed adjacent the gathering chain.

If the shift-register bit corresponding to a particular chain space is not set (i.e., the stack of signatures in that chain space has not been found to be defective), the stack passes through the reject gate into the stitcher where the stack of signatures is stitched or stapled together to form a complete product or book. If necessary, the stitched books may then be trimmed to a uniform page size. Finally, the books are mailed or otherwise distributed.

In order for the binding line to operate properly and produce acceptable books, it is important to ensure that the machine cycle of each feeding device be synchronized with the position of the chain space on which the feeding device is to place a signature. Under a variety of circumstances, however, the synchronized operation of the feeding devices with respect to the gathering chain can be disrupted.

For example, because the gathering chain is typically up to one hundred feet long, it has a tendency to stretch under prolonged use.

In addition, there is occasionally a need to calibrate the binding line. For example, the chain-space-size is often changed to produce books of different sizes.

Still further, one or more of the feeding device is often replaced with a different kind of device for feeding a different kind of signature. For example, a card-feeder is a device for placing a card (such as a subscription-renewal card or an information-request card) on stacks of signatures.

Any of the above changes to the binding line can disrupt the synchronized timing of the feeding devices causing signatures to be misaligned in the stacks or even omitted altogether.

Moreover, if the feeding devices are not properly synchronized with the gathering chain, the shift-register contents, which ordinarily indicate which stacks are defective and which are acceptable, may be rendered invalid. In other words, for example, if a sensor of one of the feeding devices detects that a signature that should be present in a particular chain space is missing, the bit in the shift register corresponding to the particular chain space should be set, so that the stack in the particular chain space will thereafter be rejected by the reject gate. If the timing of the feeding devices is not properly synchronized, however, the detection of a missing signature may result in the wrong bit in the shift register being set. Consequently, a defective stack may be accepted, or a nondefective stack may be rejected, or both.

Previously, when an operator of a binding line identified a problem with the timing points of the feeding devices, it was necessary for an electrical technician to reprogram the timing points and shift-register positions of the feeding devices or the contents of the shift register using a portable programmable computer temporarily interfaced into the binding line controller. The binding line controller provided no means for an operator to independently make adjustments to machine timing. As a result, timing problems often have resulted in prolonged down time of the binding line causing undesirable lags in productivity. Moreover, the length of these lags is particularly problematic when a significant number of adjustments must be made to the binding line due to the sizeable number of feeding devices which are included in the binding line, and where each feeding device includes a number of sensors each of which has (1) an associated timing point and (2) an associated shift-register position, either or both of which may need to be adjusted. Still further, because a binding line is often reconfigured, such as to produce differently sized books, the above-described operator set-up procedure must often be repeated for each new binding line configuration.

SUMMARY OF THE INVENTION

A binding line includes a feeding device having a sensor that develops an output during each of a plurality of operational sequences indicating that a condition has arisen and means responsive to the sensor output for controlling the binding line.

According to one aspect of the present invention, a timing-adjustment apparatus for the binding line includes storing means operable during an initial operational sequence for storing an operator-defined time period during which the condition is expected to arise in each subsequent operational sequence. The timing-adjustment apparatus also includes developing means responsive to the storing means and operable during an operational sequence subsequent to the initial operational sequence for developing an indication for an operator of the binding line that the operator-defined time period has been reached. Further, the timing-adjustment apparatus includes changing means coupled to the storing means for changing the operator-defined time period in an operational sequence subsequent to the initial operational sequence based on the indication.

According to another aspect of the present invention, a binding line includes a conveyor having a plurality of conveyor spaces for conveying a plurality of signatures, a plurality of feeding devices, each feeding device including a plurality of sensors each of which develops an output during each of a plurality of operational sequences indicating that a corresponding one of a plurality of conditions has arisen, and means responsive to the sensor outputs for controlling the binding line. A timing-adjustment apparatus for the binding line includes a plurality of storage locations for storing a plurality of bits, each representing a condition of a book on the binding line at a particular conveyor space, wherein the bits are successively shifted through the storage locations as the conveyor is conveying signatures. The timing-adjustment apparatus also includes setting means responsive to the sensor output of a particular sensor of one of the feeding devices for setting one of the bits in a first storage location associated with the sensor. The timing-adjustment apparatus further includes associating means responsive to a detected loss of synchronism between the feeding devices and the conveyor spaces and coupled to the setting means for associating a second storage location different from the first storage location with the particular sensor.

According to another aspect of the present invention, a binding line includes a feeding device having a sensor that develops an output during each of a plurality of operational sequences indicating that a condition has arisen and controlling means responsive to the sensor output for controlling the binding line. Timing of the binding line is adjusted in accordance with a timing-adjustment method for adjusting binding-line timing. The method comprises the steps of storing, during an initial operational sequence, an operator-defined time period during which the condition is expected to arise in each subsequent operational sequence; providing, during an operational sequence subsequent to the initial operational sequence and in response to the operator-defined time period, an indication for an operator of the binding line that the operator-defined time period has been reached; and changing, during an operational sequence subsequent to the initial operational sequence, the operator-defined time period in response to the indication.

According to yet another aspect of the present invention, an automatic timing-adjustment apparatus for a synchronous gathering section of a binding line includes storing means, operable during an initial operational sequence for storing a defined time period during which the condition is expected to arise in each subsequent operational sequence, and updating means responsive to the storing means and operable during an operational sequence subsequent to the initial operational sequence for automatically updating the defined time period during the subsequent operational sequence.

According to yet another aspect of the present invention, a binding line includes a plurality of feeding devices each including a plurality of sensors each of which develops an output during each of a plurality of operational sequences indicating that a corresponding one of a plurality of conditions has arisen and a conveyor having a plurality of conveyor spaces for conveying a plurality of signatures, and means responsive to the sensor outputs for controlling the binding line. A timing-adjustment apparatus for the binding line includes a plurality of storage locations for storing a plurality of bits, each representing a condition of a book on the binding line at a particular conveyor space, wherein the bits are successively shifted through the storage locations as the conveyor is conveying signatures. The timing-adjustment apparatus also includes setting means responsive to the sensor output of a particular sensor of one of the feeding devices for setting one of the bits in a first storage location associated with the sensor and means responsive to a detected loss of synchronism between the feeding devices and the conveyor spaces and coupled to the setting means for automatically associating a second storage location different from the first storage location with the particular sensor.

BRIEF DESCRIPTION OF THE DRAWING

FIG. 6 comprises a table generally summarizing the relationship among subroutines shown in FIGS. 8A–13, which, as shown in FIGS. 7A–7C, make up the automatic timing-adjustment apparatus of the present invention;

DETAILED DESCRIPTION

Figure 1:
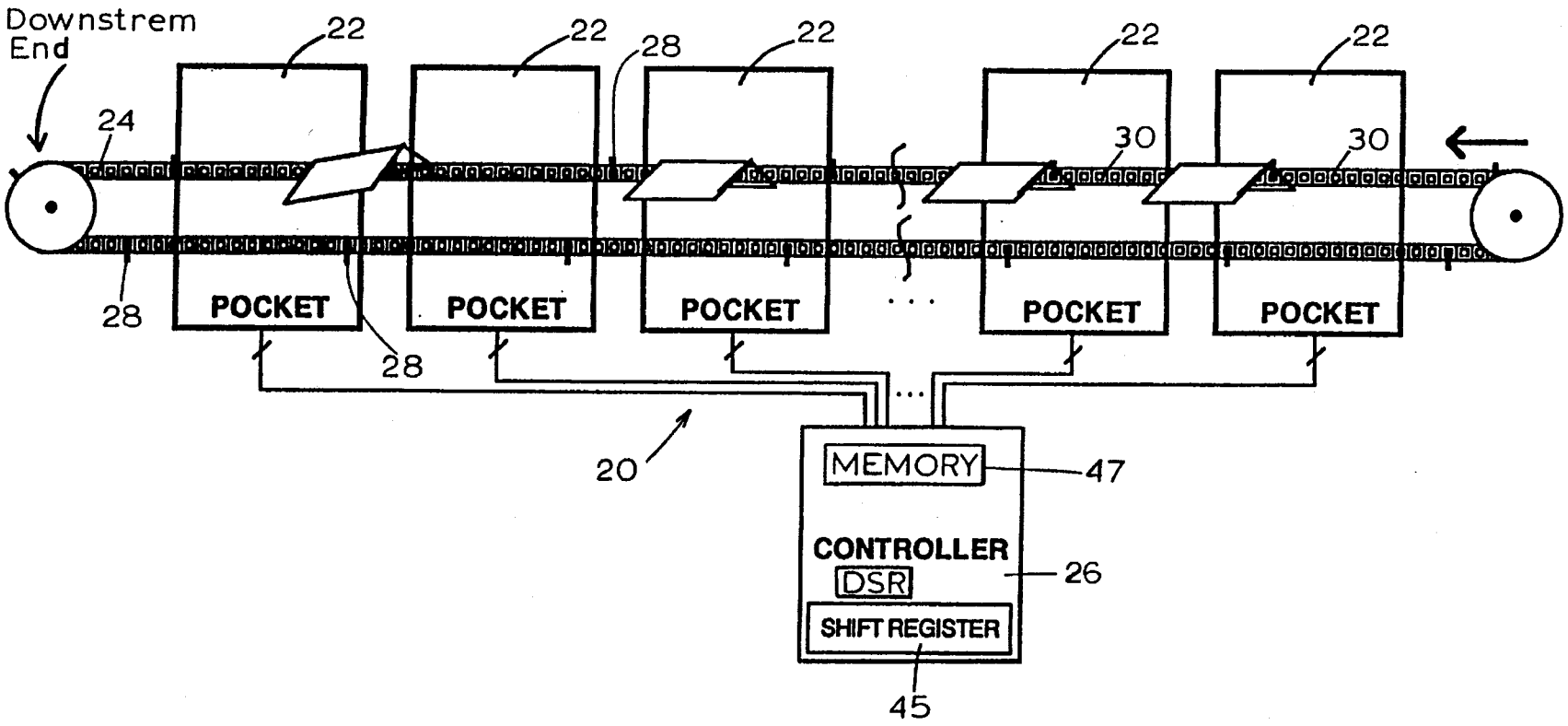
FIG. 1 comprises a generalized block diagram of a binding line gathering section including a plurality of feeding devices and a controller connected thereto.

As shown in FIG. 1, a binding-line gathering section 20, which may be of the saddle type, includes a plurality of feeding devices 22, a gathering chain 24, and a programmable logic controller 26 coupled to sensors or solenoids (described below) of the feeding devices 22. For simplicity, the only feeding devices 22 shown in the gathering section 20 of FIG. 1 are pockets 22. However, it will be evident to those skilled in the art that the various types of feeding devices 22 are functionally similar and differ only in timing characteristics (primarily feed time). The controller 26 controls the feeding devices 22 and enables an operator of the binding line to selectively adjust the timing of the various components of the feeding devices 22. It should be noted that the term "plurality" used herein encompasses any number greater than or equal to two.

The gathering chain 24 is a closed loop, as described above, and includes a plurality of gathering pins 28 disposed at spaced locations along the length of the gathering chain 24. The gathering pins 28 divide the gathering chain 24 into a plurality of chain spaces 30.

For each sensor and solenoid of each feeding device 22, the controller 26 stores a timing point representing a particular twenty-degree time period during each machine cycle, wherein the machine cycle duration is equal to the time required for the chain 24 to move the length of one chain space 30.

The timing point of a feeding device (described below in connection with FIG. 3) may be set to any of eighteen twenty-degree segments in a 360° machine cycle except those between 0° and 20° and between 320° and 360° for reasons described below. Of course, the 360° machine cycle may be partitioned into an arbitrary number of equal segments of a different angular magnitude, or into unequal segments, if desired.

The controller 26 includes a shift register 45 comprising a plurality of storage locations for storing a plurality of bits and a memory 47 of the controller 26. Each bit corresponds to a book on the binding line at a particular chain space 30 and represents a condition of that book. The storage locations are consecutively numbered, and a bit corresponding to a particular book is successively shifted through the storage locations of the shift register 45 in descending numerical order as the gathering chain 24 conveys the particular book along the gathering section 20.

In particular, the state of a bit corresponding to a given book identifies the book as defective or nondefective. As the first signature for a particular book is gathered by a feeding device 22, a bit corresponding to the book is set to zero and is initially stored in the highest-numbered storage location in the shift register 45. As the signatures making up the book are gathered, the corresponding bit is set to one if the book is determined to be defective by sensors disposed in, or adjacent, the feeding devices 22, as described below. If all of the signatures necessary to form a complete book are successfully gathered by the gathering section 20, the bit corresponding to the book will retain the initial zero value.

As the gathering chain 24 advances along the gathering section 20, the book is carried on a chain space 30 from one feeding device 22 to another, and the bit corresponding to the book is simultaneously shifted from one storage location to another. Downstream of the gathering section 20, a reject gate (not shown) rejects a book exiting the gathering section 20 whenever the shift-register bit corresponding to the book, which is then in the first or lowest-numbered storage location of the shift register 45, is set to one. If the bit corresponding to a book is set to zero, the corresponding book is acceptable and passes through the reject gate to a stitcher (not shown) located downstream of the reject gate.

Figure 2A:
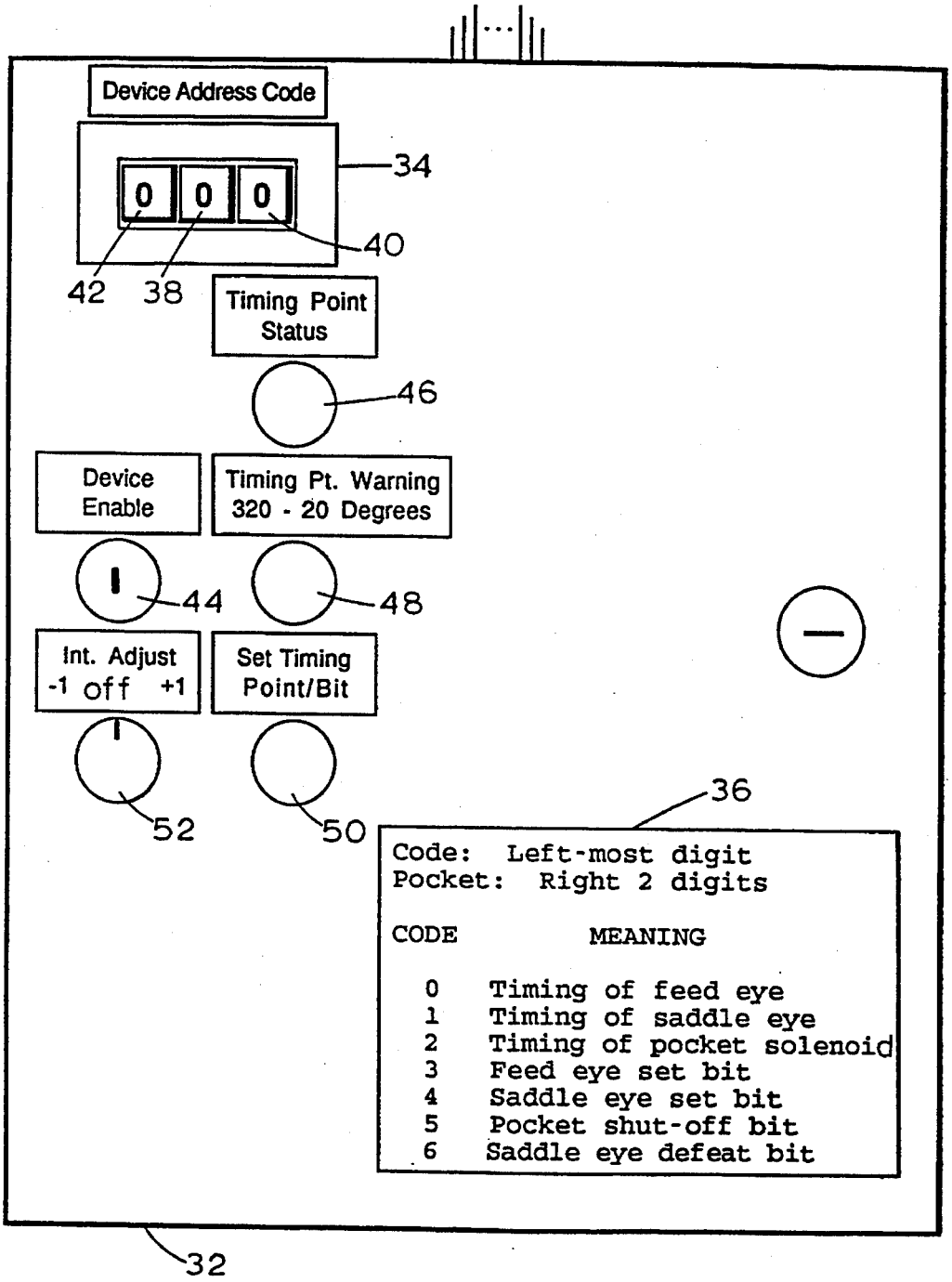
FIGS. 2A–2B comprise elevational views of an operator-interface control panel associated with the controller of FIG. 1 in manual and automatic/manual embodiments of the present invention, respectively.
Figure 2B:
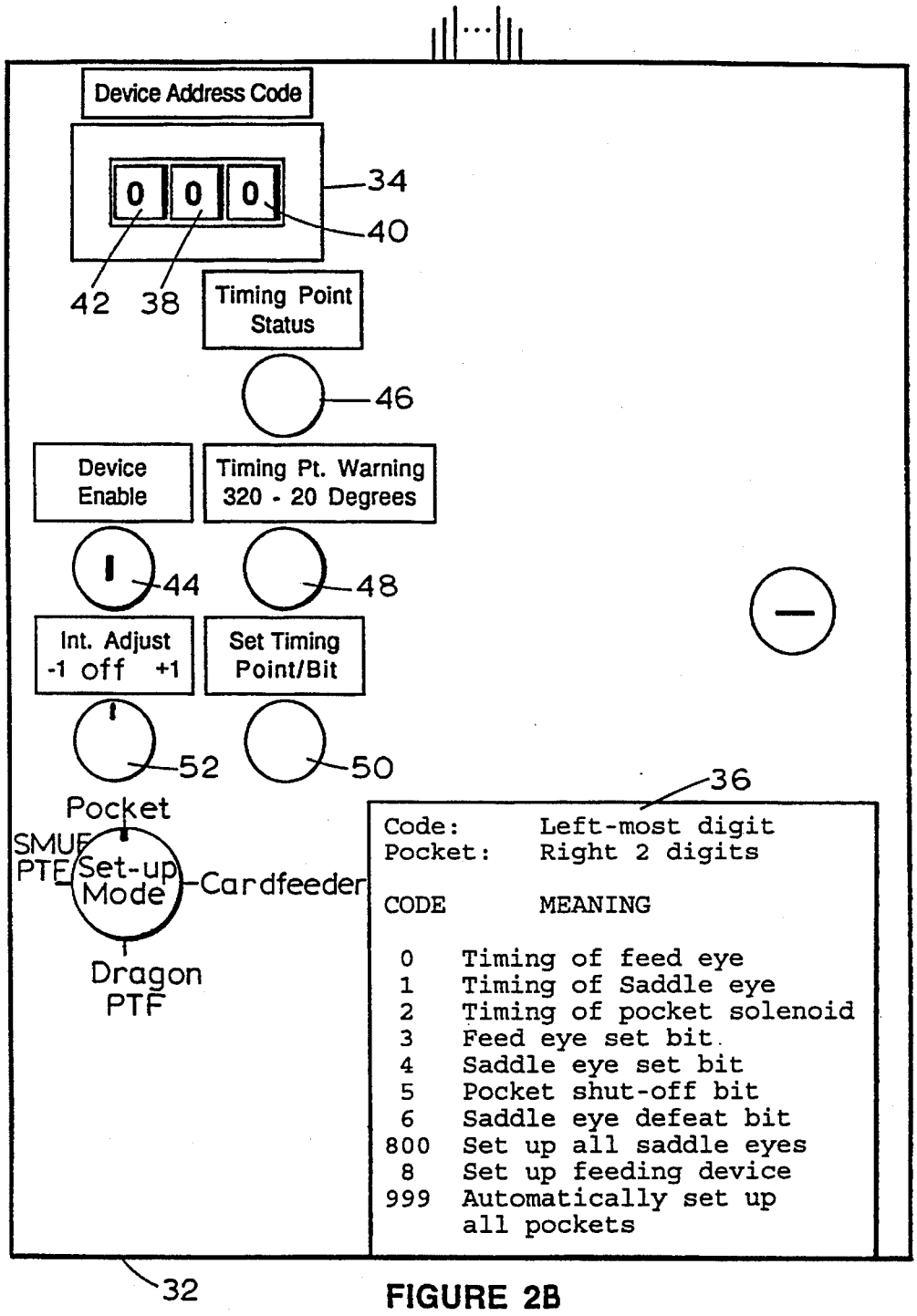

As shown in FIG. 2A, a control panel 32 associated with the controller 26 and adapted for manual timing adjustment includes a three-digit thumbwheel 34 for allowing the operator of the binding line to select a three-digit device address code. FIG. 2B depicts the control panel 32 modified for use in an automatic/manual adjustment embodiment. In either embodiment, the controller 26 interprets the device address code selected on the thumbwheel 34 and associates the other controls of the control panel 32 with the feeding device corresponding to the selected device address code as described below.

Preferably, the controller 26 is programmed to simplify the selection of the device address code by the operator by using a coding scheme 36 which may be displayed on the front of the control panel 32 for the convenience of the operator.

According to the coding scheme 36, the operator sets the right-most two digits 38, 40 to a number corresponding to the feeding device 22 that contains the sensor or solenoid, the timing point or shift-register position of which must be adjusted. The operator also sets the left-most digit 42 of the thumbwheel 34 to one of the codes specified in the coding scheme 36 appearing on the control panel 32.

For example, if the operator sets the digits 42, 38, and 40 of the thumbwheel 34 to "1", "2", and "3", respectively, the controller 26 associates the controls of the control panel 32 with the timing point of a saddle eye (described in detail below) for the 23rd feeding device 22 on the gathering section 20, inasmuch as "1" is the code for setting the timing point of a saddle eye in the coding scheme 36.

Again, the coding scheme 36 is designed for the convenience of the operator, but any suitable coding scheme may be used.

The control panel 32 also includes a keyswitch 44 which enables the control panel 32 to be used by the operator to adjust the timing points of components in, or associated with, the feeding devices 22 as well as the contents of a shift register 45 (shown in FIG. 1). When the keyswitch 44 is turned on, the controller 26 responds to signals produced by the various controls on the control panel 32 to make the timing and shift-register adjustments requested by the operator. When the keyswitch 44 is turned off, the control panel 32 is locked out, and the controller 26 is not responsive to signals from the various controls on the control panel 32.

In addition to the thumbwheel 34 and the keyswitch 44, the control panel 32 includes a green timing-point-status light 46 for indicating to the operator when the timing point of the particular sensor or solenoid selected by the device address code entered on the thumbwheel 34 has been reached during the current machine cycle of the gathering section 20. Specifically, the timing-point-status light 46 is off at all times except during the timing point of the selected sensor or solenoid when the timing-point-status light 46 is on. Of course, it should be noted that the light 46 could be left on normally and be turned off to indicate that the selected timing point has been reached, and further that the timing-point-status light 46 could, in fact, be replaced by an audible alarm or any other suitable type of signalling means, as desired.

The control panel 32 also includes a flashing red warning light 48 which indicates to the operator that the gathering section 20 is within that portion of the machine cycle between 0° and 20° or between 320° and 360° thereof. During this time, it is undesirable for the timing point of any feeding device to be set.

The control panel 32 still further includes a pushbutton 50 and an integer adjust knob 52. As shown in FIG. 2B, the automatic/manual control panel 32 also includes a four-position set-up mode selector switch 54 which enables an operator to select the type of feeding device to be set up.

Specifically, the operator may select the set-up of a pocket, or of a SMUF PTF, a Dragon PTF, or a card feeder, which are different types of feeding devices that may be used in a binding line gathering section 20 in particular applications. Each of these automatic set-up modes has a corresponding bit or flag that is set automatically when the set-up mode selector switch 54 is set to the corresponding set-up mode. Each of these controls is described in greater detail below.

Figure 3:
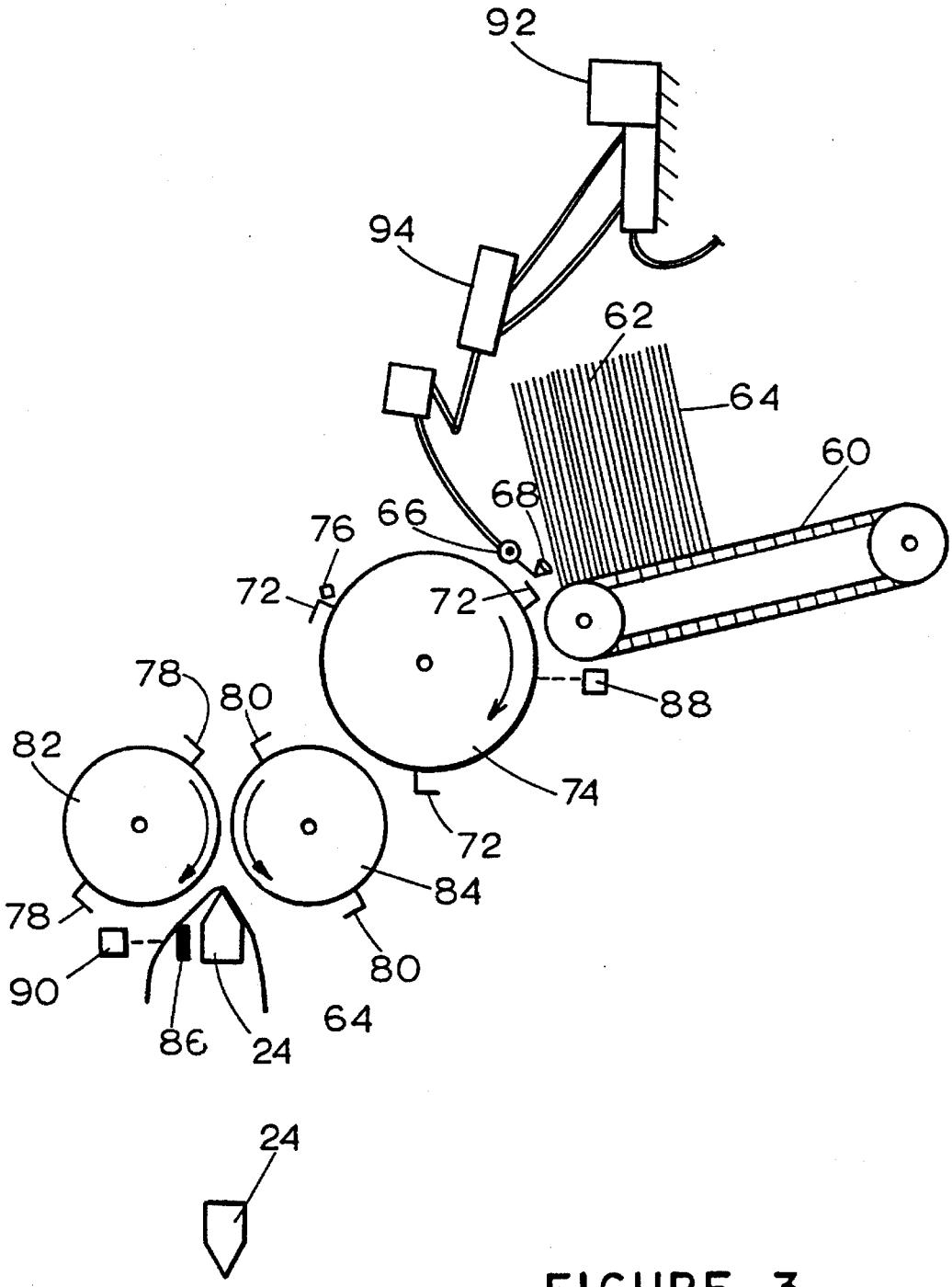
FIG. 3 comprises a schematic diagram of one of the feeding devices of FIG. 1.

As shown in FIG. 3, each feeding device 22 of the gathering section 20 has a feed chain 60 on which a stack 62 of signatures 64 is stored in the feeding device 22. A sucker bar 66 in each feeding device 22 is mounted adjacent the signature stack 62, and one or more vacuum-operated suckers 68 hingedly mounted to the sucker bar 66 remove a signature 64 from the stack 62 and deliver the signature 64 to a pair of grippers 72 (only one of which is shown in FIG. 3). The grippers 72 are disposed on either end of a rotating main drum 74 around which the signature 64 is pulled until it reaches a register stop 76. At the register stop 76, the grippers 72 release the signature 64. The signature 64 is then received by similar gripper pairs 78, 80 on each of two parallel, counter-rotating opening-drums 82, 84 which open or unfold the signature 64 by pulling the ends of the signature 64 in opposite directions. The gripper pairs 78, 80 release the signature 64 so that it falls onto and straddles the gathering chain 24 and a saddle 86 adjacent the chain 24.

Each feeding device 22 includes an optical feed-line eye or sensor 88 disposed adjacent the main drum 74 and operable, as described in more detail below, to produce an output indicating the absence of a signature 64 thereon. During that time period within the machine cycle when a signature 64 is expected to be in front of the feed-line sensor 88 (i.e., the operator-defined time period corresponding to the optical sensor 88), the controller 26 examines the output of the sensor 88.

The gathering section 20 also includes an optical saddle-eye sensor 90 for each feeding device 22. The saddle-eye sensor 90 of each feeding device is disposed adjacent the saddle 86 and is operable, as described in more detail below, to produce an output indicating the absence of a signature 64 on the saddle 86. During that time period within the machine cycle when a signature 64 is expected to be on the saddle 86 (i.e., the operator-defined time period corresponding to the saddle-eye sensor 90), the controller 26 examines the output of the saddle-eye sensor 90.

The same particular storage location in the shift register 45 of the controller 26 is associated with each optical sensor 88 and 90 of a given feeding device. The controller 26 maintains a data file containing the number of the storage location associated with each sensor 88, 90.

If a sensor 88 or 90 detects the absence of a signature 64 during the operator-defined time period corresponding to that sensor, the controller sets the bit stored in the storage location associated with that sensor to one, indicating that a signature is missing from the book to which the bit corresponds so that the book will later be rejected as described above.

Finally, associated with leach feeding device 22 is a solenoid 92 for actuating an air cylinder 94 which locks the sucker bar 66 in a position wherein the suckers 68 are isolated from the stack 62 of signatures 64 and turns off the suction provided at the suckers 68. The solenoid 92 of each feeding device 22 is associated with a particular storage location in the shift register 45. If the bit in the storage location associated with the solenoid 92 of a particular feeding device 22 is set to one, indicating that the book in the chain space 30 at that feeding device 22 is defective, the controller 26 energizes the solenoid 92 to lock the sucker bar 66 and turn off the suckers 68 of that feeding device 22. As the bit corresponding to the defective book is shifted through the shift register 45, each subsequent feeding device 22 is turned off in this manner to prevent subsequent feeding devices 22 from depositing signatures on the defective book. Consequently, the number of gathered signatures in the defective book that must be decollated and returned to their respective feeding devices to prevent waste of signatures is minimized.

Figure 4:
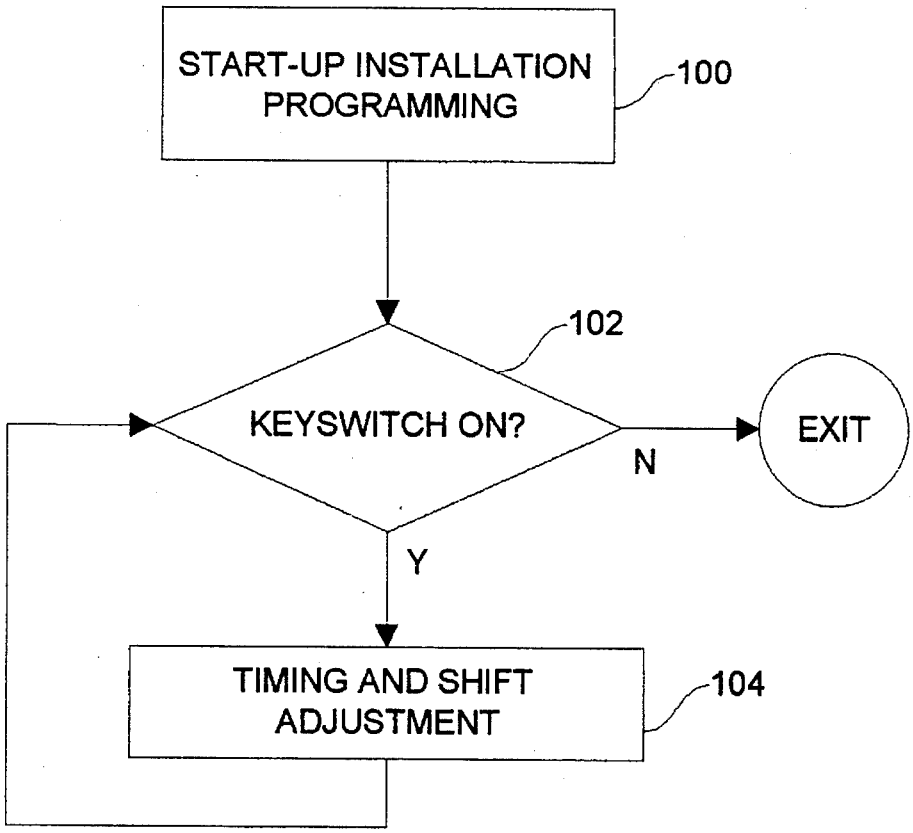
FIG. 4 comprises a generalized flowchart of the operation of the timing-adjustment apparatus of the present invention.

When the control panel 32 is enabled by the keyswitch 44, the controller 26 executes a computer program represented generally by the blocks 100–104 of FIG. 4.

As shown in FIG. 4, the block 100 executes a sequence of start-up installation programming instructions for initially setting timing periods for all of the sensors and solenoids in the gathering section 20. Specifically, the block 100 correlates the various devices, such as the optical sensors 88 and 90 and the solenoids 92 of each of the feeding devices 22, with a respective storage location in the shift register 45 within the memory 47 of the controller 26. After the start-up installation programming sequence has been executed, control passes to a block 102 which tests the position of the keyswitch 44 on the control panel 32. If the keyswitch 44 is off, the controller 26 will not respond to operator input to the controls on the control panel 32. If the keyswitch 44 is on, control passes to a block 104 which executes a programming sequence, once during each machine cycle.

Ordinarily, the keyswitch 44 will be off, and the binding line will be run by the operator in a routine manner. When the operator observes that the feeding devices 22 and the gathering chain 24 are no longer synchronized, however, the operator will turn on the keyswitch 44 invoking the programming sequence implemented by the block 104. This sequence allows the operator of the binding line to adjust the timing points and shift-register positions of the various devices (i.e., sensors and solenoids) in the gathering section 20 using the controls on the control panel 32 as described below.

As long as the binding line is operating and the keyswitch 44 of the control panel 32 is turned on, the controller 26 will repeatedly execute the program cycle of the block 104 (FIG. 4). After all of the necessary timing adjustments have been made, the operator turns off the keyswitch 44 and resumes the routine operation of the binding line until further adjustments become necessary.

The procedure by which the operator of the binding line initially defines the contents of the shift register 45 and the timing points of the various sensors and solenoids during execution of the block 100 is substantially the same as the procedure used to adjust the timing points and shift-register positions during execution of the block 104 described below in detail both in connection with the manual embodiment of FIGS. 5A–5G and in connection with the automatic embodiment of FIGS. 6A–12. Accordingly, the start-up installation programming of the block 100 will not be further described.

The timing/shift adjustment sequence of the block 104 is shown in more detail in FIGS. 5A–5G.

Upon detecting a timing problem and turning on the keyswitch 44, the operator stops the continuous operation of the binding line and enters a device address code into the thumbwheel 34. The operator then inches or slowly advances the gathering chain 24 forward (while the feeding devices 22 contemporaneously advance through respective, concurrent machine cycles) until the green timing-point-status light 46 turns on as described below in connection with FIG. 5B. The operator then physically inspects the gathering section 20. If the operator determines that a timing or shift-register adjustment is needed, such as, for example, if a feeding device 22 deposits a signature 64 atop a gathering pin 28 rather than on the chain space 30 between two adjacent gathering pins 28, then the operator makes the necessary adjustment as described below in connection with FIGS. 5A–5G.

Figure 5A:
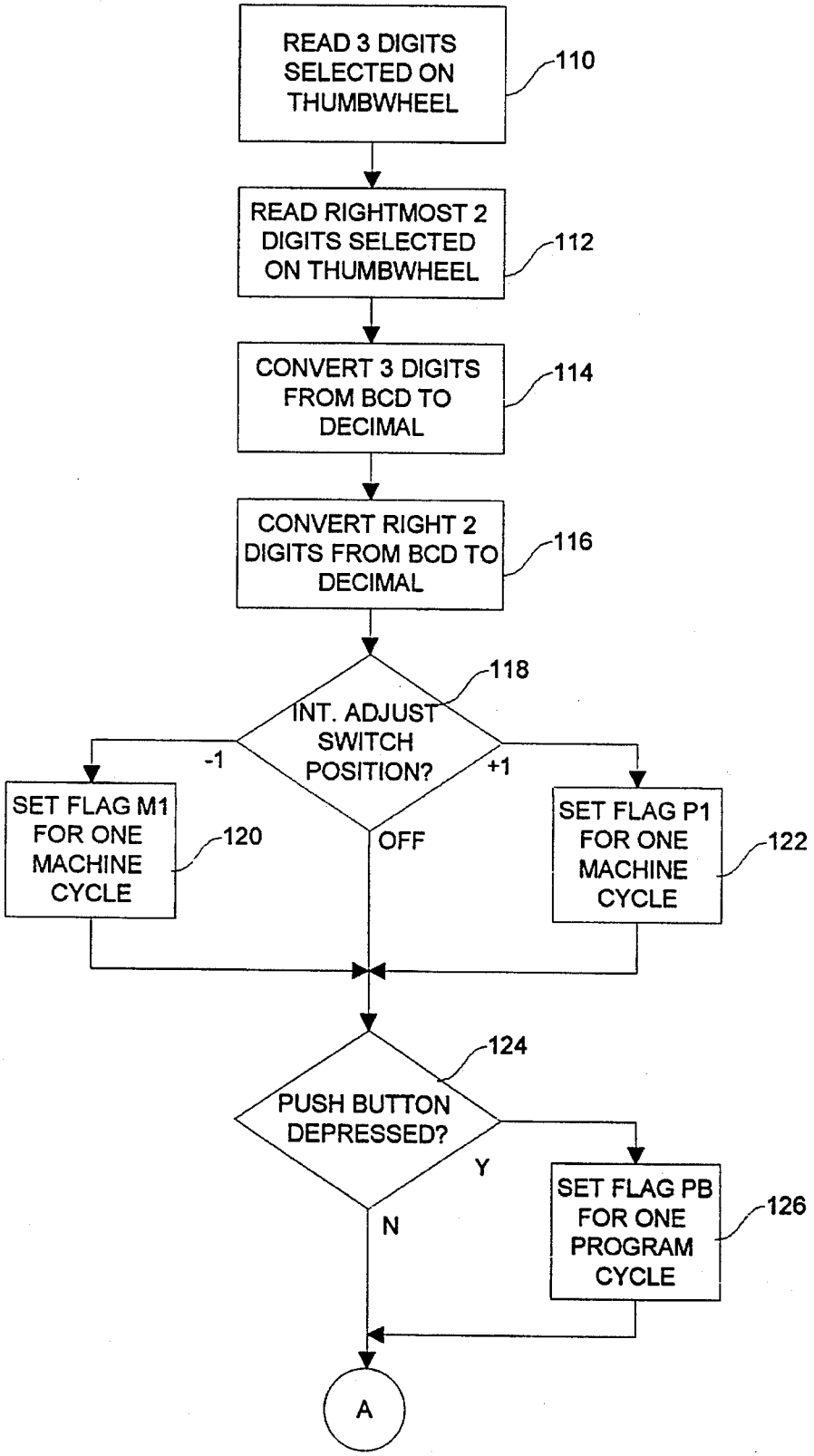
FIGS. 5A–5G, when joined along the similarly lettered lines, together comprise a detailed flowchart illustrating the operation of a manual embodiment of the timing-adjustment apparatus of the present invention.

As shown in FIG. 5A, a block 110 reads the three-digit code that the operator has entered via the thumbwheel 34 of FIG. 2A. Specifically, each of the three digits entered via the thumbwheel 34 is provided by the thumbwheel 34 in the form of a four-bit, binary-coded-decimal (BCD) number. A block 112 reads the right-most two thumbwheel digits 38, 40, representing the number or code of the feeding device 22 in which a sensor or solenoid timing point or shift-register position is to be adjusted (hereafter the "selected device"). A pair of blocks 114, 116 convert the three-digit BCD code read by the block 110 and the two-digit BCD "selected device" number read by the block 112 from BCD format to decimal values. The decimal values of the three-digit thumbwheel contents and the two-digit "selected device" number are stored in registers TW3 and TW2, respectively, in the memory 47 of the controller 26.

Next, a block 118 checks the position of the knob 52, which may be in one of three positions: "–1", "+1",or "OFF." If the knob 52 is in the –1 position, a block 120 sets a flag M1 for one program cycle (i.e., one execution of the block 104), and control thereafter passes to a block 124. If the knob 52 is in the +1 position, a block 122 sets a flag P1 for one program cycle, and control thereafter passes to the block 124. If the knob 52 is in the off position, the blocks 120 and 122 are bypassed, and control passes directly to the block 124.

Figure 5B:
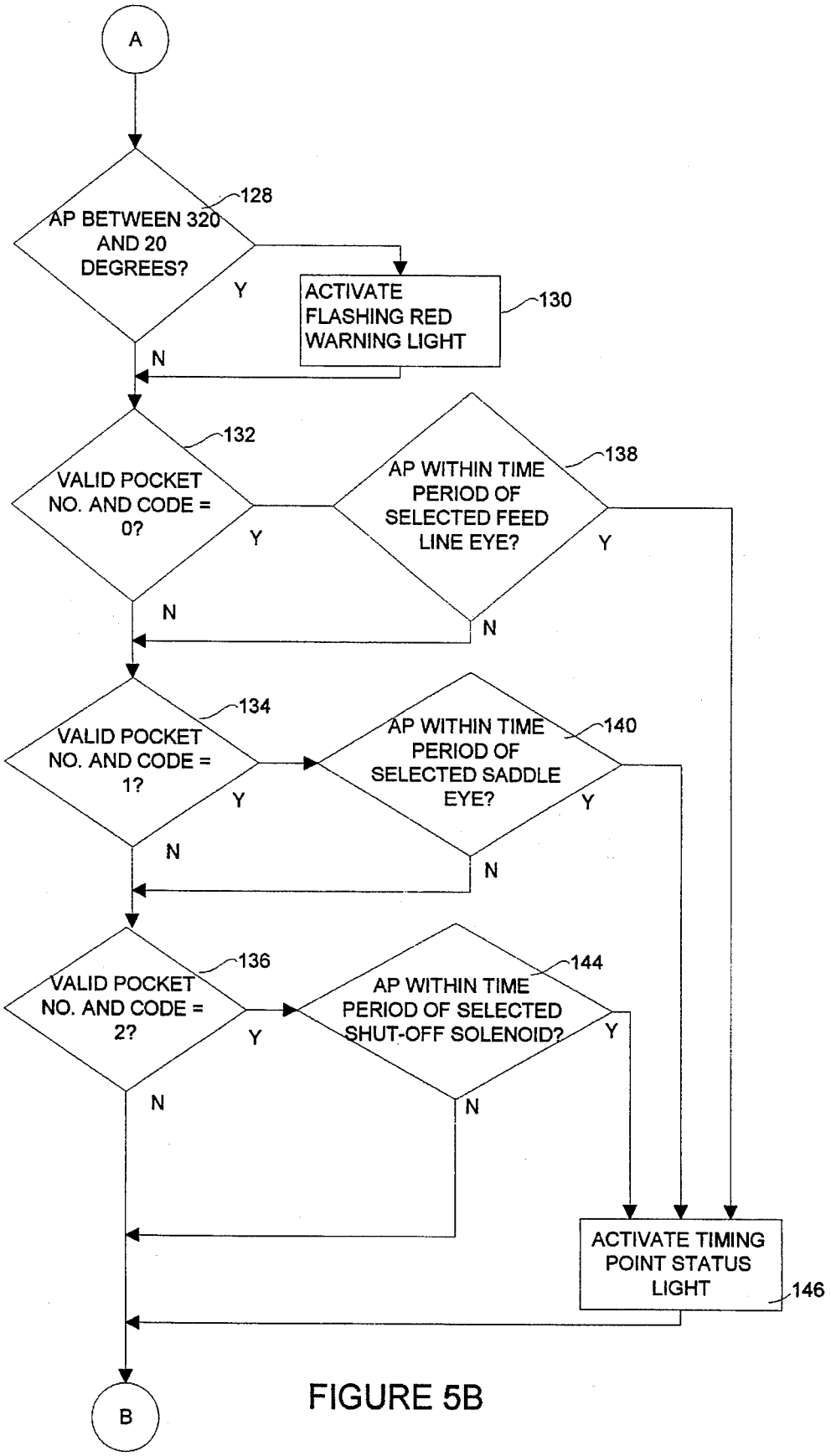

The block 124 tests the pushbutton 50 on the control panel 32. If the pushbutton 50 is depressed, control passes to a block 126 which sets a flag PB for one program cycle, and control passes to a block 128 (FIG. 5B). If the pushbutton 50 is not depressed, the block 126 is bypassed and control passes directly to the block 128.

As shown in FIG. 5B, the block 128 tests a register AP coupled to a decoder or a resolver that senses the angular position of the stitcher (which is used as a reference for measurement of the current angular position in the machine cycle of the binding line). The operation of a feeding device 22 is divided into 1° increments such that a feeding device 22 cycles through 360° of operation (i.e., one machine cycle) for each one-chain-space advancement of the gathering chain 24. The value stored in the register AP therefore cycles periodically from 0° to 359° and then back to 0° during operation of the binding line. Each feeding device 22 operates periodically, in parallel, and in synchronism with the machine cycle which is common to all feeding devices 22 of the gathering section 20.

If, in a given machine cycle, the angular position AP is between 0° and 20° or between 320° and 360° (360° being the 0° point in the immediately subsequent machine cycle), control passes to a block 130 which activates the flashing red warning light 48 on the control panel 32, and control thereafter passes to a block 132.

As mentioned above, the flashing of the warning light 48 serves to warn the operator of the binding line not to set a timing point to prevent further timing problems.

If the angular position AP is between 20° and 320°, the block 130 is bypassed, the warning light 48 remains off, and control passes directly to the block 132. Of course, it should be noted that the warning light 48 could be an on/off light (like the timing-point-status light 46) rather than a flashing light, and that the warning light 48 can be replaced by an audible alarm or any other suitable type of signalling means, as desired.

The block 132 tests the contents of the registers TW3 and TW2 which indicate the selected device address code as stated above. If the number of the selected feeding device 22 is valid (e.g., between 1 and 28 for a gathering section 20 having twenty-eight feeding devices) and the selected operation code specified by the left-most digit 42 of the thumbwheel 34 is zero (i.e., the code specifying that the timing point of a selected feed-line eye 88 is to be set), control passes to a block 138. If either one of these conditions is not satisfied, control passes to a block 134.

Figure 5C:
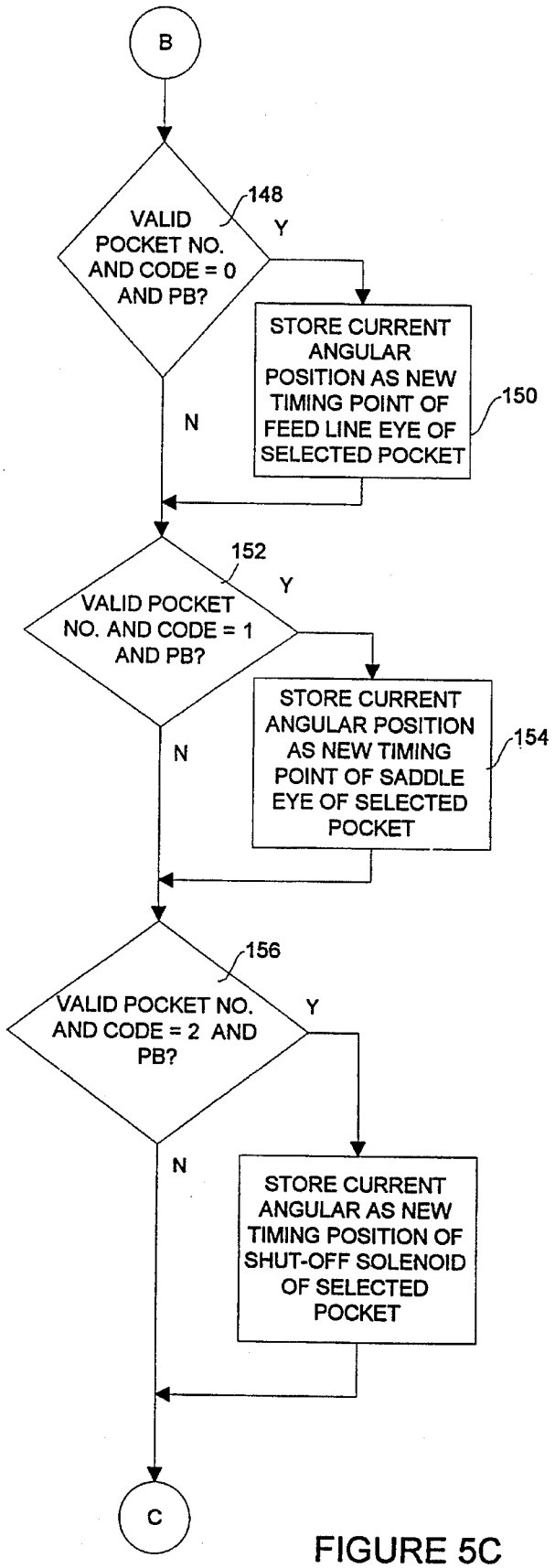

The block 138 tests the angular position AP of the binding line. If the angular position AP is within the twenty-degree segment of the machine cycle that the operator defined as the timing point of the feed-line eye 88 of the selected feeding device 22, then a block 146 activates the green timing-point-status light 46 on the control panel 32 during the twenty-degree segment, and control thereafter passes to a block 148 (FIG. 5C). If the angular position AP has not reached the timing point of the selected feed-line eye 88, then the timing-point-status light 46 remains off and control passes to the block 134.

The block 134 also tests the contents of the registers TW3 and TW2. If the "selected device" number is valid, as described above, and the selected operation code is 1 (i.e., the code specifying that a selected saddle eye 90 is to be set), control passes to a block 140. If either one of these conditions is not satisfied, control passes to a block 136.

Like the block 138, the block 140 tests the angular position AP of the binding line. If the angular position AP is within the twenty-degree segment of the machine cycle that the operator defined as the timing point of the saddle eye 90 of the selected feeding device 22, then the block 146 activates the timing-point-status light 46 as described above, and control passes to the block 148 (FIG. 5C). If the angular position AP has not reached the timing point of the selected saddle eye 90, the timing-point-status light 46 remains off and control passes to the block 136.

The block 136 also tests the contents of the registers TW3 and TW2. If the device number is valid and the selected operation code is 2 (i.e., the code specifying that the timing point of a selected shut-off solenoid 92 is to be set), control passes to a block 144. If either one of these conditions is not satisfied, control passes to a block 148 (FIG. 5C).

The block 144 tests the angular position AP of the binding line. If the angular position AP is within the twenty-degree segment of the machine cycle that the operator defined as the timing point of the solenoid 92 of the selected feeding device 22, then the block 146 activates the timing-point-status light 46, and control thereafter passes to the block 148 (FIG. 5C). If the angular position AP has not reached the timing point of the selected solenoid 92, the timing-point-status light 46 remains off and control passes directly from the block 144 to the block 148.

As shown in FIG. 5C, the block 148 tests the contents of the registers TW3 and TW2 and the flag PB. If the "selected device" number is valid, and the selected operation code is 0 (i.e., the code specifying that the timing point of a selected feed-line eye is to be set), and the flag PB is set, then a block 150 stores the angular position AP of the binding line as the new timing point of the feed-line eye 88 of the selected feeding device 22 and passes control to a block 152. If any of the above-described conditions is not satisfied, the block 150 is bypassed, and control passes directly to the block 152.

The block 152 again tests the contents of the registers TW3 and TW2 and the flag PB. If the "selected device" number is valid, and the selected operation code is 1 (i.e., the code specifying that the timing point of a selected saddle eye 90 is to be set), and the flag PB is set, then a block 154 stores the angular position AP of the binding line as the new timing point of the saddle eye 90 of the selected feeding device 22 and passes control to a block 156. If any of the above-described conditions is not satisfied, the block 154 is bypassed, and control passes directly to the block 156.

Figure 5D:
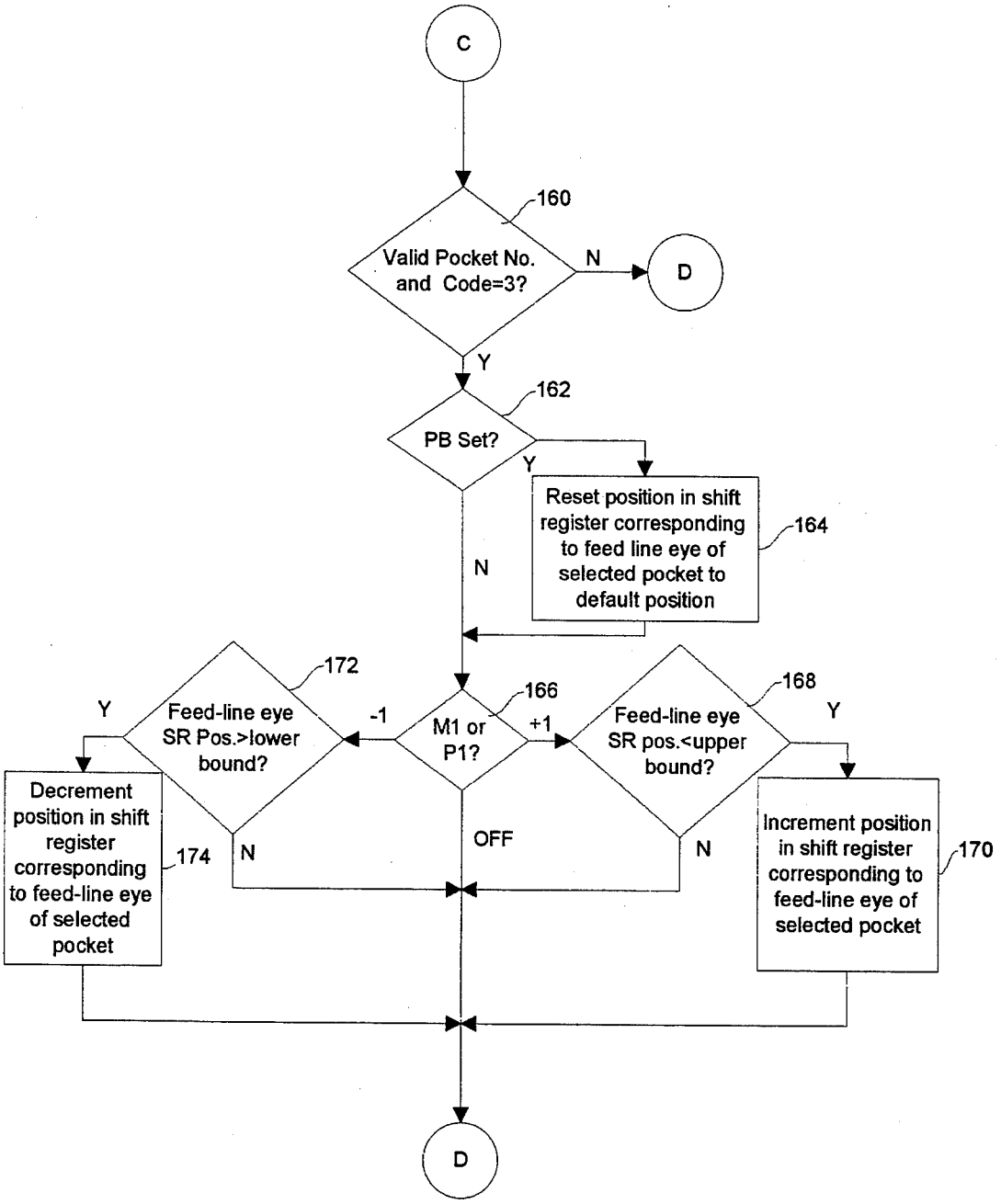

The block 156 once again tests the contents of the registers TW3 and TW2 and the flag PB. If the "selected device" number is valid, and the selected operation code is 2 (i.e., the code specifying that the timing point of a selected solenoid is to be set), and the flag PB is set, then a block 158, stores the angular position AP of the binding line as the new timing point of the solenoid 92 of the selected feeding device 22 and passes control to a block 160 (FIG. 5D). If any of the above-described conditions is not satisfied, the block 158 is bypassed, and control passes directly to the block 160 (FIG. 5D).

Figure 5E:
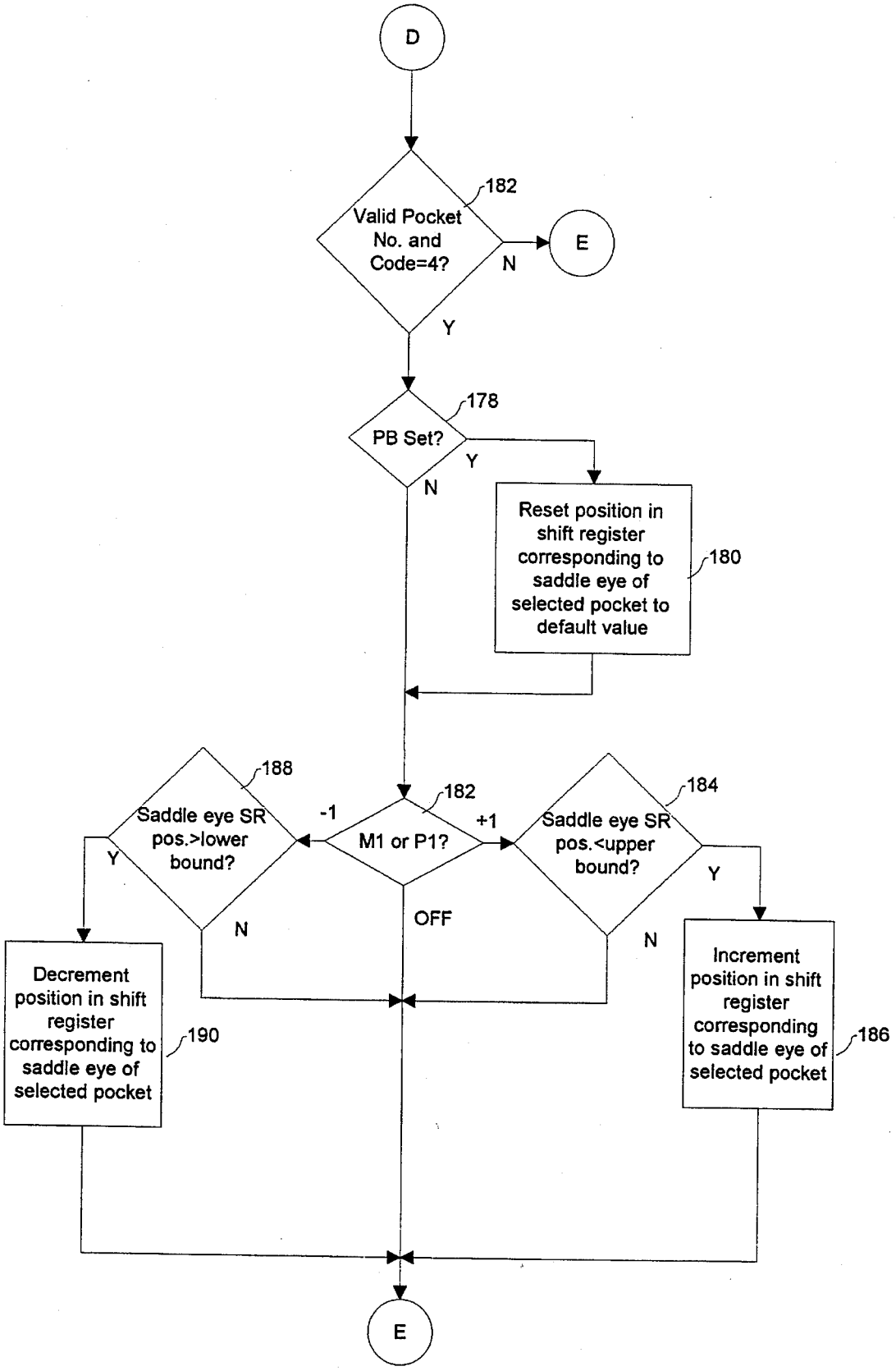

As shown in FIG. 5D, the block 160 tests the contents of the registers TW3 and TW2. If the "selected device" number is valid and the selected operation code is 3 (i.e. the code specifying that the shift-register position corresponding to a selected feed-line eye 88 is to be modified), control passes to a block 162. Otherwise, control passes to a block 176 (FIG. 5E). The operator makes this selection whenever there is a need to change the shift-register position associated with a particular feed-line eye 88 of a particular feeding device 22.

The block 162 tests the flag PB to ascertain whether the pushbutton 50 is depressed. If the flag PB is set, a block 164 resets the shift-register position number corresponding to the feed-line eye 88 of the selected feeding device 22 to a default position number thereof, and control then passes to a block 166. If the flag PB is not set, the block 164 is bypassed, and control passes directly to the block 166.

The block 166 tests the flags M1 and P1 to determine whether the knob 52 has been moved during the current program cycle. As described above in connection with FIG. 5A, the flag P1 is set if the knob 52 was moved to the +1 position, and the flag M1 is set if the knob 52 was moved to the −1 position. Neither the flag P1 nor the flag M1 is set if the knob 52 remained in the "OFF" position during the current program cycle.

If the flag Pl is set, a block 168 compares the shift-register position number corresponding to the feed-line eye 88 of the selected feeding device 22 to a predefined upper bound stored in a data file in the memory 47 of the controller 26. If the shift-register position number is below the upper bound, a block 170 increments by one the shift-register position number corresponding to the feed-line eye 88 of the selected feeding device 22, and control thereafter passes to the block 176 (FIG. 5E). If the shift-register position number has already reached the predefined upper bound, the block 170 is bypassed, and control passes directly from the block 168 to the block 176 (FIG. 5E).

If the flag M1 is set, a block 172 compares the shift-register position number corresponding to the feed-line eye 88 of the selected feeding device 22 to a predefined lower bound stored in a data file in the memory 47 of the controller 26. If the shift-register position number is above the lower bound, a block 174 decrements by one the shift-register position number corresponding to the feed-line eye 88 of the selected feeding device 22, and control thereafter passes to the block 176 (FIG. 5E). If the shift-register position number has already reached the predefined lower bound, the block 174 is bypassed, and control passes directly from the block 172 to the block 176 (FIG. 5E).

If neither the flag P1 nor the flag M1 is set, the blocks 168, 170, 172, and 174 are bypassed, and control passes directly from the block 166 to the block 176 (FIG. 5E).

Figure 5F:
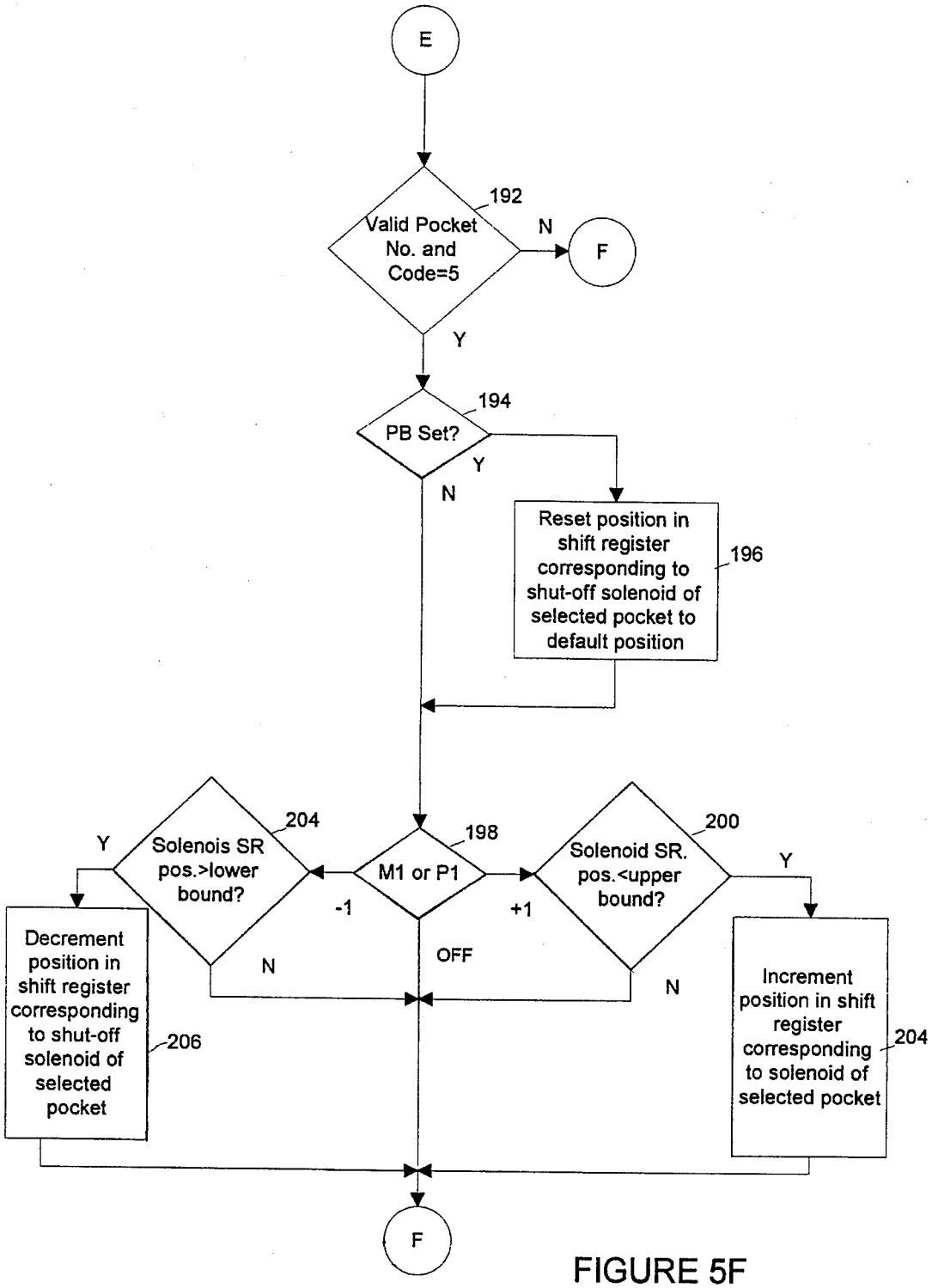

As shown in FIG. 5E, a group of blocks 176–190 are connected and operate in a manner similar to the blocks 160–174 of FIG. 5D. The block 176 tests the contents of the registers TW3 and TW2. If the "selected device" number is valid and the selected operation code is 4 (i.e., the code specifying that the shift-register position corresponding to a selected saddle eye 90 is to be modified), control passes to the block 178. Otherwise, control passes to the block 192 (FIG. 5F). The operator makes this selection whenever there is a need to change the shift-register position associated with a particular saddle eye 90 of a particular feeding device 22.

The block 178 tests the flag PB to ascertain whether the pushbutton 50 is depressed. If the flag PB is set, the block 180 resets the shift-register position number corresponding to the saddle eye 90 of the selected feeding device 22 to the default position number thereof, and control passes to the block 182. If the flag PB is not set, the block 180 is bypassed, and control passes directly to the block 182.

The block 182 tests the flags M1 and P1 to determine whether the knob 52 has been moved during the current program cycle. If the flag P1 is set, the block 184 compares the shift-register position number corresponding to the saddle eye 90 of the selected feeding device 22 to a predefined upper bound stored in a data file in the memory 47 of the controller 26. If the shift-register position number is below the upper bound, a block 186 increments by one the shift-register position number corresponding to the saddle eye 90 of the selected feeding device 22, and control passes to the block 192 (FIG. 5F). If the shift-register position number has already reached the predefined upper bound, the block 186 is bypassed, and control passes directly from the block 184 to the block 192 (FIG. 5F).

If the flag M1 is set, the block 188 compares the shift-register position number corresponding to the saddle eye 90 of the selected feeding device 22 to a predefined lower bound stored in a data file in the controller 26. If the shift-register position number is above the lower bound, the block 190 decrements by one the shift-register position number corresponding to the saddle eye 90 of the selected feeding device 22, and control passes to the block 192 (FIG. 5F). If the shift-register position number has already reached the predefined lower bound, the block 190 is bypassed, and control passes directly from the block 188 to the block 192 (FIG. 5F).

If neither the flag P1 nor the flag M1 is set, the blocks 184, 186, 188, and 190 are bypassed, and control passes directly from the block 182 to the block 192 (FIG. 5F).

Figure 5G:
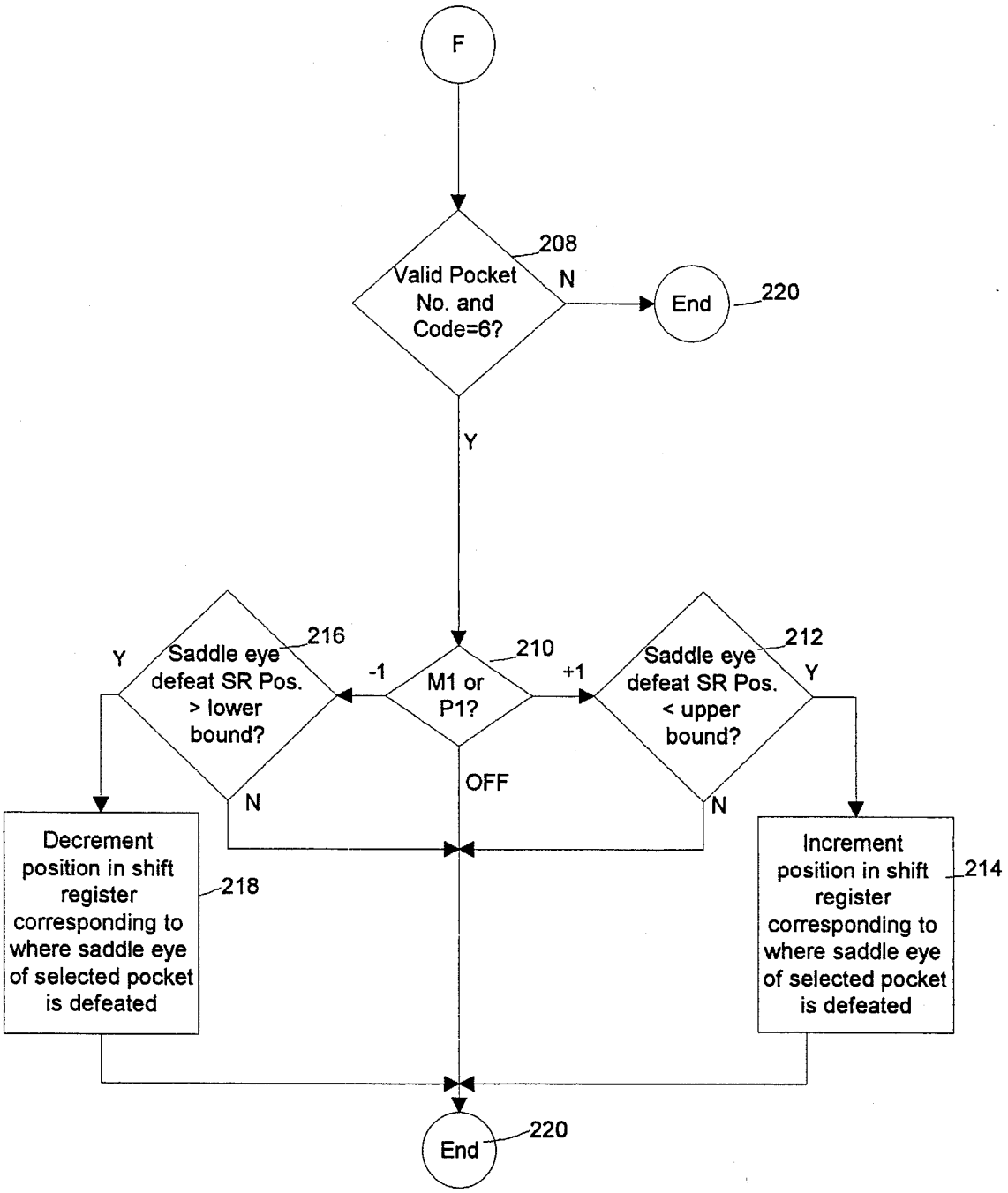

Another group of blocks 192–206 similar to the blocks 160–174 of FIG. 5D is now described with reference to FIG. 5F. The block 192 tests the contents of the registers TW3 and TW2. If the "selected device" number is valid and the selected operation code is 5 (i.e., the code specifying that the shift-register position number corresponding to a selected shut-off solenoid 92 is to be modified), control passes to the block 194. Otherwise, control passes to the block 208 (FIG. 5G). The operator makes this selection whenever there is a need to change the shift-register position in which the presence of a bit set to one will cause the selected feeding device 22 to be turned off by the shut-off solenoid 92 associated therewith.

The block 194 tests the flag PB to ascertain whether the pushbutton 50 is depressed. If the flag PB is set, the block 194 resets the shift-register position number corresponding to the shut-off solenoid 92 of the selected feeding device 22 to the default position thereof, and control passes to the block 198. If the flag PB is not set, the block 194 is bypassed, and control passes directly to the block 198.

The block 198 tests the flags M1 and P1 to determine whether the knob 52 has been moved during the current program cycle. If the flag P1 is set, the block 200 compares the shift-register position number corresponding to the shut-off solenoid 92 of the selected feeding device 22 to a predefined upper bound stored in a data file in the memory 47 of the controller 26. If the shift-register position number is below the upper bound, the block 202 increments by one the shift-register position number corresponding to the shut-off solenoid 92 of the selected feeding device 22, and control passes to the block 208 (FIG. 5G). If the shift-register position number has already reached the predefined upper bound, the block 202 is bypassed, and control passes directly from the block 200 to the block 208 (FIG. 5G).

If the flag M1 is set, the block 204 compares the shift-register position number corresponding to the shut-off solenoid 92 of the selected feeding device 22 to a predefined lower bound stored in a data file in the controller 26. If the shift-register position number is above the lower bound, the block 206 decrements by one the shift-register position number corresponding to the shut-off solenoid 92 of the selected feeding device 22, and control passes to the block 208 (FIG. 5G). If the shift-register position number has already reached the predefined lower bound, the block 206 is bypassed, and control passes directly from the block 204 to the block 208 (FIG. 5G).

If neither the flag P1 nor the flag M1 is set, the blocks 200, 202, 204, and 206 are bypassed, and control passes directly from the block 198 to the block 208 (FIG. 5G) .

Still another group of blocks 208–218 similar to the blocks 160–174 is now described with reference to FIG. 5G. The gathering section 20 may be operated in a "selective mode" whereby customized books are produced by causing selected feeding device 22 to deposit signatures in some books but not others.

For example, a feeding device 22 deposits a specialized advertising insert in books for interested recipients and omits the insert from books for disinterested recipients. Ordinarily, if a feeding device 22 is turned off to omit a signature 64 from a book, the saddle eye 90 of that feeding device 22 detects that the signature 64 is missing and sets the corresponding bit in the shift register 45 to one indicating that the book is defective.

When the gathering section 20 is operated in the "selective mode," however, the absence of signatures 64 which are deliberately omitted from a book does not render the book defective. Accordingly, although the saddle eye 90 of a feeding device 22 may detect a missing signature 64, if the signature was deliberately omitted, it is necessary to prevent the bit in the shift-register position associated with that saddle eye 90 from being set to one. In other words, the saddle eye 90 of a feeding device 22 that is selectively turned off should be defeated.

If the synchronous relationship between the gathering chain 24 and the feeding device 22 is lost, adjustment of the shift-register position number where a particular saddle eye 90 is defeated may be required. The blocks 208–218 enable the operator of the binding line to make this adjustment.

The block 208 tests the contents of the registers TW3 and TW2. If the "selected device" number is valid and the selected operation code is 6 (i.e., the code specifying that the saddle-eye defeat bit position in a defeat shift register DSR (described below) associated with a selected saddle eye 90 is to be modified), control passes to the block 210. Otherwise, the program cycle ends and a new program cycle begins during the next machine cycle as described above in connection with FIG. 4.

The block 210 tests the flags M1 and P1 to determine whether the knob 52 has been moved during the current program cycle. If the flag P1 is set, the block 212 compares the shift-register position number corresponding to the saddle-eye defeat position of the selected feeding device 22 to a predefined upper bound stored in a data file in the memory 47 of the controller 26. If the shift-register position number is below the upper bound, the block 214 increments by one the shift-register position number corresponding to the saddle-eye defeat position of the selected feeding device 22, and control thereafter passes to a block 220 which ends the program cycle. If the shift-register position number has already reached the predefined upper bound, the block 214 is bypassed, and control passes to the block 220.

If the flag M1 is set, the block 172 compares the shift-register position number corresponding to the saddle-eye defeat position of the selected feeding device 22 to a predefined lower bound stored in a data file in the controller 26. If the shift-register position number is above the lower bound, the block 218 decrements by one the shift-register position number corresponding to the saddle-eye defeat position of the selected feeding device 22, and control passes to the block 220. If the shift-register position number has already reached the predefined lower bound, the block 218 is bypassed, and control passes directly to the block 220.

If neither the flag P1 nor the flag M1 is set, the blocks 212, 214, 216, and 218 are bypassed, and control passes directly to the block 220 where the program cycle ends.

When the program cycle ends, the block 104 will be re-executed, as seen in FIG. 4, if the keyswitch 44 is on (i.e., if the control panel 32 is enabled). At the beginning of each pass through the program, a flag PB1 (used for the automatic embodiment described below) is cleared (i.e., set to zero) so that no adjustment operations will be executed during a given program cycle until the pushbutton 50 is depressed during that program cycle. The flag PB is set continuously from the time the pushbutton 50 is depressed until the pushbutton 50 is released. In contrast, the flag PB1 is set at the time the pushbutton 50 is depressed and is cleared at the end of the program cycle, irrespective of whether the pushbutton 50 has been released. If the keyswitch 44 is off, the controller 26 will continue to operate without performing the timing/shift adjustment sequence of block 104 (i.e., the sequence of FIGS. 5A–5G), and input by the operator to the controls of the control panel 32 will have no effect on the binding line until the keyswitch 44 is turned on again.

The three digits 42, 38, 40 of the thumbwheel 34 provide a maximum of 1,000 possible device address codes. Of these address codes, the coding scheme 36 described above requires only 196 address codes for a gathering section 20 having twenty-eight feeding devices 22. Address codes which are not used by the coding scheme 36 for selecting a specific sensor or solenoid of a specific feeding device can be assigned to perform trouble-shooting steps in further programming not shown in the flowchart of FIGS. 5A–5G. Because these trouble-shooting steps form no part of the present invention, their operation is not described here.

An automatic embodiment of the timing/shift adjustment sequence of block 104 (shown in FIG. 4) will now be described in detail with reference to FIG. 6 and FIGS. 7A–7C.

The automatic timing/shift adjustment sequence can be integrated with the manual timing/shift adjustment sequence described above in connection with FIGS. 5A–5G so that automatic as well as manual adjustment is available. To do so, rather than ending at the block 220 of FIG. 5G, the program cycle would continue, with control passing from the block 220 to a block 300 (shown in FIG. 7A). Alternatively, a manual/automatic select switch could be provided on the controller 32 to select execution of the automatic timing-adjustment programming of FIGS. 7A–13 rather than execution of the manual timing-adjustment programming of FIGS. 5A–5G. In either case, the programming of FIGS. 7A–7C will be repeatedly executed by the block 104 (FIG. 4) as long as the keyswitch 44 is in the "ON" position. As shown in FIG. 4, this programming will not be executed if the keyswitch 44 is in the "OFF" position; instead, the programming of FIGS. 7A–7C will be bypassed, and the controller 26 will continue to operate the binding line without making any automatic timing/shift adjustments.

Figure 7A:
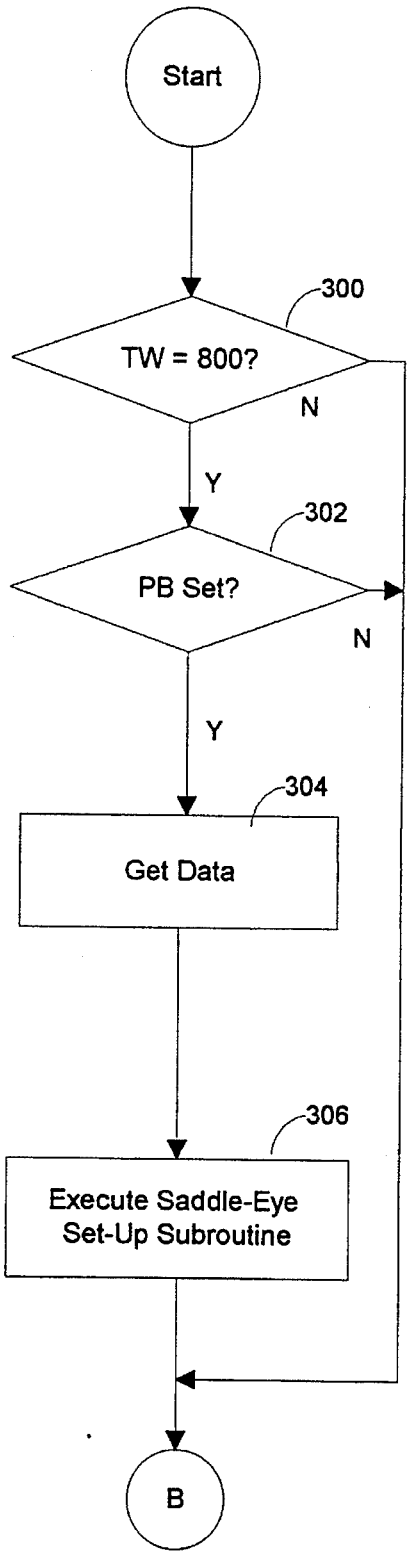
FIGS. 7A–7C, when joined along the similarly lettered lines, together comprise a flowchart illustrating the general operation of an automatic timing-adjustment apparatus according to the present invention.
Figure 7B:
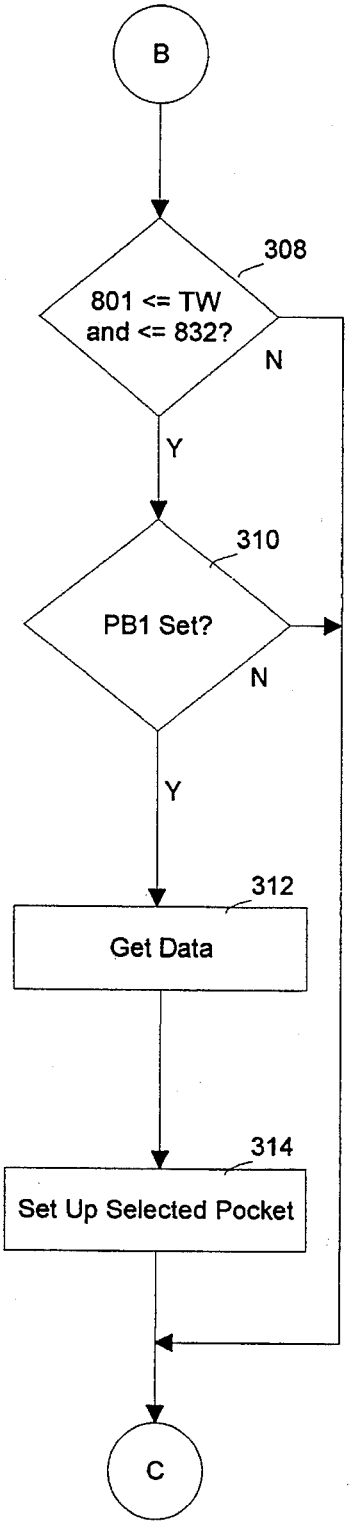
Figure 7C:
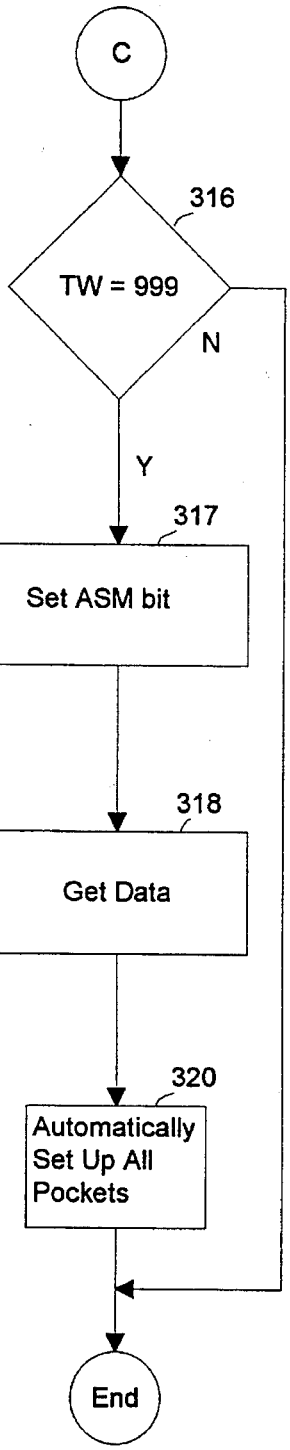

FIGS. 7A, 7B, and 7C illustrate the routing of program control to three different subroutines (shown in FIGS. 9A–9B, 12A–12F, and 13) of the automatic timing/shift adjustment sequence of the present invention. A table is provided in FIG. 6 to illustrate how these main subroutines, and other auxiliary subroutines called by the main subroutines, interrelate to make up the automatic timing-adjustment apparatus of the present invention. As shown in FIG. 6, the main subroutines are (1) a subroutine called from a block 306 of FIG. 7A to set up all saddle eyes 90 (i.e., calculate saddle-eye time and bit references, saddle-eye timing points, and saddle-eye shift-register positions); (2) a subroutine called from a block 314 of FIG. 7B to set up timing points and shift-register positions for an operator-selected feeding device 22; and (3) a subroutine called from a block 320 of FIG. 7C to automatically set up timing points and shift-register positions for all pockets (but not other types of feeding devices 22).

In practice, the operator calls the first of these subroutines only when the gathering section 20 is initially set up or when a major change is made to the line (e.g., a change in the size of the chain space 30 or a change in the relationship between the position of a chain space 30 and the angular position AP of the gathering section 20). To do so, the operator need only set the thumbwheel 34 to 800 and press the pushbutton 50.

The operator calls the second subroutine to set up or make adjustments to the timing points or shift-register positions of a selected feeding device 22, such as when the size of the signatures to be deposited by the selected feeding device 22 changes or a new feeding device 22 is installed in the gathering section 20. To do so, the operator must set the thumbwheel 34 to "8nn" (where "nn" is the number of the selected feeding device 22), set the auto set-up mode select switch 54 (FIG. 2B) to the mode corresponding to the type of the selected feeding device 22 (i.e., pocket, SMUF or Dragon PTF device, or cardfeeder), advance the binding line slowly until the grippers 72 of the selected feeding device 22 close, and press the pushbutton 50.

The operator calls the third subroutine to automatically set up the timing points and shift-register positions of all of the pockets (but not other types of feeding devices 22) in the gathering section 20, such as to produce books of a new size (i.e., when the size of signatures to be deposited by all pockets changes). To do so, the operator need only set the thumbwheel 34 to 999; the timing points and shift-register positions of all pockets 22 will then be set up automatically during operation of the gathering section 20 as discussed below in detail in connection with FIG. 13. As also explained below in detail, after the thumbwheel 34 is set to 999, the thumbwheel 34 must remain set to 999 until a signature 64 has been deposited on the gathering chain 24 (or at least fed) by each pocket 22 for which timing points and shift-register positions must be reset. Once that occurs, however, the operator can end the automatic pocket set-up operation by setting the thumbwheel 34 to a number other than 999, or by turning the keyswitch 44 to the off position, so that the subroutine of FIG. 13 will not be re-executed on the next pass through the program (FIG. 4). It should be noted that this automatic pocket set-up operation will automatically occur while the gathering chain 24 is being inched by the operator as well as while it is operating continuously, provided that the keyswitch 44 is on and the thumbwheel 34 is set to 999.

Prior to any of these three subroutines being called, another subroutine (illustrated in FIGS. 8A–8B) is called by one of the blocks 304, 312, or 318 shown in FIGS. 7A–7C, respectively, to initialize program constants with pre-stored or operator-entered data.

As shown in FIG. 7A, the block 300 tests the contents of the thumbwheel 34. If the thumbwheel 34 is set to 800, then a block 302 tests the flag PB which is set while the pushbutton 50 is depressed and which is not set when the pushbutton 50 is not depressed. If the flag PB is set, a block 304 executes a constant-initialization subroutine (described below in connection with FIGS. 8A–8B) to initialize program constants with pre-stored or operator-entered values required for operation of subsequent programming. After the constant-initialization subroutine has been executed, control returns to a block 306 which executes a saddle-eye set-up subroutine (described below in connection with FIGS. 9A–9B) to calculate saddle-eye reference points, saddle-eye timing points, and shift-register positions for all saddle eyes 90 in the gathering section 20 of the binding line. Thereafter, control returns to a block 308 (shown in FIG. 7B) where the contents of the thumbwheel 34 are examined once again.

In the event the block 300 determines that the thumbwheel 34 is not set to 800, the block 302 determines that the flag PB is not set, indicating that the pushbutton 50 is not depressed, control passes directly to the block 308 (FIG. 7B).

As shown in FIG. 7B, the block 308 determines whether the thumbwheel 34 has been set to a number between 801 and 832, inclusive. If so, a block 310 tests a flag PB1, which is set if the pushbutton 50 has been depressed during the current program cycle and which is not set if the pushbutton 50 has not been depressed during the current program cycle. If the block 310 determines that the flag PB1 is set, a block 312 executes the constant-initialization subroutine (described below in connection with FIGS. 8A–8B). After execution of the constant-initialization subroutine at block 312, a block 314 executes the timing/shift-register set-up subroutine (described below in connection with FIGS. 11A–11F), and control passes to a block 316 (shown in FIG. 7C). If the block 308 determines that the thumbwheel 34 is not set to a number between 801 and 832, inclusive, or if the block 310 determines that the pushbutton 50 has not been depressed during the current program cycle (i.e., that the flag PB1 is not set), then the blocks 312 and 314 are bypassed, and control passes directly to the block 316 (FIG. 7C).

Next, as shown in FIG. 7C, the block 316 tests the thumbwheel 34. If the thumbwheel 34 is set to 999, a block 317 sets an auto set-up mode bit ASM, which remains set for one program cycle, a block 318 executes the constant-initialization subroutine (FIGS. 8A–8B), and a block 320 executes an automatic pocket set-up subroutine (described below in connection with FIG. 13), and execution of the automatic timing-adjustment sequence thereafter ends. If the block 316 determines that the thumbwheel 34 is not set to 999, the blocks 317–320 are bypassed, and execution of the program cycle ends directly. However, the automatic timing-adjustment sequence will be repeatedly executed as long as the thumbwheel 34 remains set to 999 so that all pockets 22 can be set up.

As shown in FIG. 2B, the three additional adjustment functions provided in the automatic adjustment embodiment may be listed on the coding scheme 36 on the control panel 32 for the convenience of the binding line operator.

As shown in FIG. 4, when the foregoing automatic adjustment program cycle ends, the program cycle of the block 104 will be re-executed if the keyswitch 44 is on (i.e., if the control panel 32 is enabled), so that the binding line operator can perform further timing-adjustment operations as necessary. If the keyswitch 44 is not on, the controller 26 will continue to operate without making automatic timing/shift adjustments, and input by the operator to the controls of the control panel 32 will have no effect on the binding line until the keyswitch 44 is turned on again.

As was true of the manual adjustment program, address codes which are not used by the automatic adjustment coding scheme 36 can be assigned to perform trouble-shooting steps in further programming not shown in the flowchart of FIGS. 7A–7C or in the subroutine flowcharts of FIGS. 8A–13. Because these trouble-shooting steps form no part of the present invention, their operation is not described here.

The various programming sequences referred to above in connection with the blocks 304, 306, 312, 314, 318, and 320, are described in detail with reference to FIGS. 8A–13. The constant-initialization subroutine (illustrated in FIGS. 8A–8B), which is executed once by each of the blocks 304 (FIG. 7A), 312 (FIG. 7B), and 318 (FIG. 7C), is now described in detail.

The constant-initialization subroutine, comprising blocks 322–348 (FIGS. 8A–8B), enables an operator of the binding line to assign values to program constants which are specific to any particular configuration of the binding line gathering section 20. This initialization sequence initializes the program constants with values that are determined by the binding line operator, as described below, and incorporated directly into machine programming associated with the blocks 322–348. Of course, other means for initializing the program constants may be used. For example, a computer terminal could be provided and suitably programmed to prompt the binding line operator to enter each of the values during the initialization sequence so that the operator would not be required to program those values into the program itself.

Figure 8A:
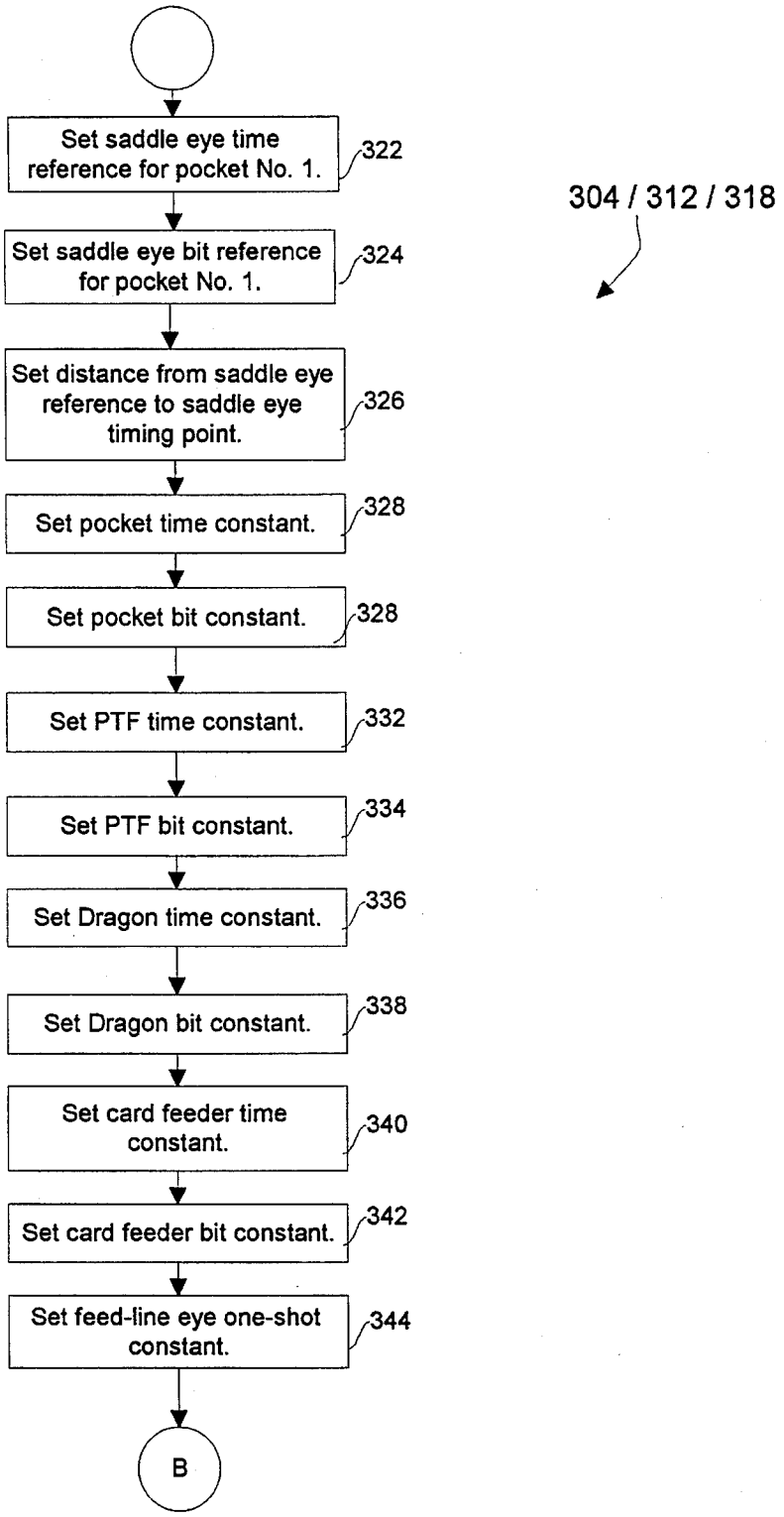
FIGS. 8A–8B, when joined along the similarly lettered lines, together comprise a detailed flowchart illustrating the operation of one portion of the automatic timing-adjustment apparatus shown in FIGS. 7A–7C.
Figure 8B:
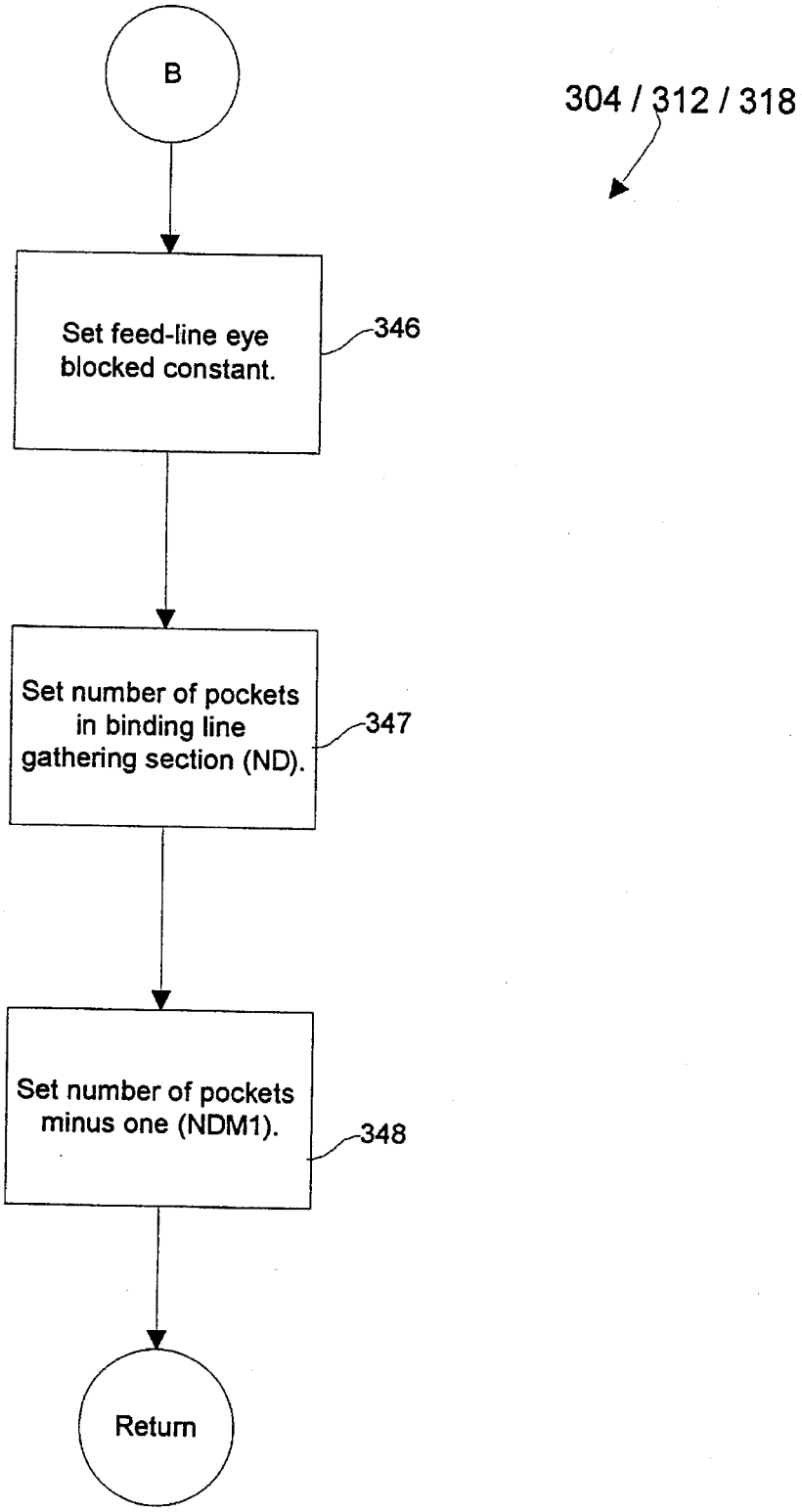

For purposes of reference, the following table summarizes the program constants that are initialized by the blocks 322–348 of FIGS. 8A–8B.

| Constant | Definition of Constant | Block Where Constant Initialized |
|---|---|---|
| SETR1 | Saddle-Eye Time Reference for First Pocket | 322 |
| SEBR1 | Saddle-Eye Bit Reference for First Pocket | 324 |
| SEO | Saddle-Eye Offset | 326 |
| PTC | Pocket Time Constant | 328 |
| PBC | Pocket Bit Constant | 330 |
| PTFTC | Parallel-To-Foot Time Constant | 332 |
| PTFBC | Parallel-To-Foot Bit Constant | 334 |
| DTC | Dragon Time Constant | 336 |
| DBC | Dragon Bit Constant | 338 |
| CFTC | Card-Feeder Time Constant | 340 |
| CFBC | Card-Feeder Bit Constant | 342 |
| FEOSC | Feed-line Eye One-Shot Constant | 344 |
| FEBC | Feed-line Eye Blocked Constant | 346 |
| ND | Number of Devices in Binding Line | 347 |
| NDM1 | Number of Devices Minus 1 (ND − 1) | 348 |

Initially, the block 322 sets a constant SETR1, representing the saddle-eye time reference for the saddle eye 90 of the first feeding device 22 in the gathering section 20, equal to an operator-specified (preprogrammed) value. In particular, the value assigned to the constant SETR1 is the angular position AP in the machine cycle at which one of the gathering pins 28 (hereinafter called a "reference gathering pin") is disposed approximately one inch downstream of the saddle eye 90 of the first feeding device 22. It should be noted that the first feeding device 22 is the one located nearest the downstream end of the gathering section 20 as shown in FIG. 1. The feeding devices 22 are numbered sequentially from number one at the downstream end to number ND at the upstream end of the gathering section 20.

The block 324 sets a constant SEBR1, representing the saddle-eye bit reference for the saddle eye 90 of the first feeding device 22, equal to the shift-register bit position number corresponding to the chain space 30 on the gathering chain 24 immediately upstream of the reference gathering pin 28 based upon which the first-saddle-eye time reference SETR1 is determined as described above. This number is equal to one more than the number of chain spaces 30 between the reference gathering pin 28 and the reject gate of the binding line 20.

Next, the block 326 sets a constant SEO equal to a predetermined saddle-eye offset, which corresponds to the angular distance between the saddle-eye time reference SETR[] of any particular feeding device 22 and the saddle-eye timing point SETP[] of that feeding device 22. In other words, the saddle-eye offset constant SEO is set equal to the predetermined angular portion of the machine cycle that elapses between the saddle-eye time reference and the saddle-eye timing point (the time when the output of the saddle eye 90 is sampled to determine whether it detects a missing signature 64). The value of the saddle-eye offset constant SEO is dependent upon the length of a signature 64 and the length of a chain space 30. The examination of the output of any particular saddle eye 90 takes place when the gathering section 20 reaches the saddle-eye timing point SETP[] of the particular saddle eye 90 (described below). In order to ensure that this examination takes place at a time when, in the absence of a purposely omitted signature 64, or a misfed signature 64, or an already defective book, the particular saddle eye 90 can be expected to be blocked by a signature 64, the saddle-eye offset constant SEO is typically set equal to about 270°. This value causes the output of the particular saddle-eye 90 to be examined after about three quarters (i.e., 270°/360°) of the signature 64, if present, and the chain space 30 in which it is deposited, has physically passed the particular saddle eye 90. The saddle-eye timing point obtained with this value, as described below, will cause the saddle-eye output to be examined approximately three-quarters of the way between the leading (downstream) gathering pin 28 of a particular chain space 30 and the trailing (upstream) gathering pin 28 of that chain space 30).

Next, the blocks 328 and 330 set the pocket time and bit constants, PTC and PBC, respectively. The pocket time constant PTC and the pocket bit constant PBC are based on the time (i.e., the angular portion of the machine cycle) that elapses between (1) the time a signature 64 of the largest possible size is gripped by one of the grippers 72 in a pocket 22 (as illustrated in FIG. 3) and (2) the first saddle-eye time reference of the saddle eye 90 of the pocket 22 that is reached after that signature 64 is pulled around the drum 74 and dropped on a chain space 30. Once this time (the "feed time" for a pocket 22) is known, seventy degrees is added to it, and the resulting sum is divided by 360°. That is, PBC and PTC together represent the whole and fractional number of chain spaces 30 between the point at which a largest signature 64 is gripped and the point at which the output of the saddle eye 90 of the pocket 22 is examined to determine whether the signature 64 was deposited on the gathering chain 24. The pocket bit constant PBC is set equal to the whole-number portion of the quotient resulting from that division, and the pocket time constant PTC is set equal to the remainder resulting from that division.

As described below, these values of the pocket time constant PTC and pocket bit constant PBC are used by blocks 414–426 and 430 of FIGS. 11A–11B to derive solenoid shift-register positions SSRP's for pockets 22 that will ensure that the solenoid 92 of a given pocket 22 will disable the given pocket 22 at the time when it would otherwise feed a signature 64 to a book from which the signature should be omitted. Seventy degrees is added to the "feed time" for a pocket 22 in order to allow for operator error in determining the pocket "feed time." The division by 360° accounts for the fact that the "feed time" of a pocket 22 is generally longer than one machine cycle and that a number of chain spaces 30 may pass a pocket 22 while a particular signature 64 is being fed through the pocket 22. The integer portion of this quotient (the pocket bit constant PBC) represents the whole number of chain spaces 30 that pass a pocket 22 during the "feed time" thereof. The remainder portion resulting from the division (the pocket time constant PTC) represents the additional fractional number of chain spaces 30 that pass the pocket 22 during the feed time thereof.

The blocks 332 and 334 set the parallel-to-foot (PTF) time and bit constants PTFTC and PTFBC, respectively. Like the pocket time and bit constants PTC and PBC, these constants are derived by adding seventy degrees to the longest "feed time" of a parallel-to-foot (PTF) device in the gathering section 20 of the binding line. The sum is divided by 360°. The integer part of the quotient is the PTF bit constant PTFBC, and the PTF time constant PTFTC is set equal to the remainder of the division.

As described below, these values of the PTF time constant PTFTC and PTF bit constant PTFBC are used by blocks 434–446 and 450 of FIGS. 11B–11C to derive solenoid shift-register positions SSRP's for SMUF PTF devices 22 that will ensure that the solenoid 92 of a given SMUF PTF device 22 will disable the given SMUF PTF device 22 at the time when it would otherwise feed a signature 64 to a book from which the signature 64 should be omitted. Seventy degrees is added to the "feed time" for a SMUF PTF device 22 in order to allow for operator error in determining the SMUF PTF "feed time." The division by 360° accounts for the fact that the "feed time" for a SMUF PTF device 22 is generally longer than one machine cycle and that a number of chain spaces 30 may pass a PTF device 22 while a particular signature 64 is being fed through the PTF device 22. The integer portion of this quotient (the PTF bit constant PTFBC) represents the number of chain spaces 30 that pass a SMUF PTF device 22 during the "feed time" thereof. The remainder portion resulting from the division (the PTF time constant PTFTC) represents the additional fractional number of chain spaces 30 that pass the PTF device 22 during the feed time thereof.

Thereafter, the blocks 336 and 338 set Dragon time and bit constants, DTC and DBC respectively, and the blocks 340 and 342 set card-feeder time and bit constants CFTC and CFBC, respectively. These constants are derived in the same manner as the foregoing pocket and PTF time and bit constants, but in relation to Dragon and card-feeding devices 22.

Next, the block 344 sets a feed-line eye one-shot constant FEOSC equal to the angular distance between the solenoid timing point STP of a feeding device 22 (i.e., the angular time during a machine cycle when the solenoid 92 of the feeding device 22 will energize to prevent the feeding device 22 from feeding a signature 64) and the feed-line eye timing point FETP of the feeding device 22 (i.e., the angular time during a machine cycle when output of the feed-line eye 88 of the feeding device 22 will be examined to determine if a signature is missing). It should be noted that the feed-line eye one-shot constant FEOSC is the same for all types of feeding devices 22 in the gathering section 20 only because the location of the feed-line eye 88 of a particular feeding device 22 relative to the solenoid 92 of the particular feeding device 22 is the same for all types of feeding devices 22. Of course, if the relationship between the feed-line eye 88 and the solenoid 92 were different for different types of feeding devices 22, different feed-line eye one-shot constants FEOSC would be required for each type of feeding device 22 and could be stored in an array FEOSC[] or in any other suitable manner. In a typical binding line gathering section 20, the constant FEOSC is set equal to approximately 150° to ensure that, in the absence of a purposely omitted signature 64, or a misfed signature 64, or an already defective book, a given feed-line eye 88 can be expected to be blocked by a signature 64 at the time when the output of the feed-line eye 88 is examined.

As shown in FIG. 8B, the block 346 sets another constant FEBC, called the "feed-line-eye-blocked" constant, equal to the time (i.e., the angular portion of the machine cycle) that elapses between the time when a signature 64 is gripped by the grippers 72 of a given pocket 22 and the time when the feed-line eye 88 of the given pocket 22 is blocked by the signature 64. Typically, this constant is set equal to approximately fifty degrees.

Next, the block 347 sets a constant ND equal to the number of feeding devices 22 in the binding line gathering section 20, and the block 348 sets a constant NDM1 equal to one less than the number of feeding devices 22 (i.e., ND-1).

Figure 9A:
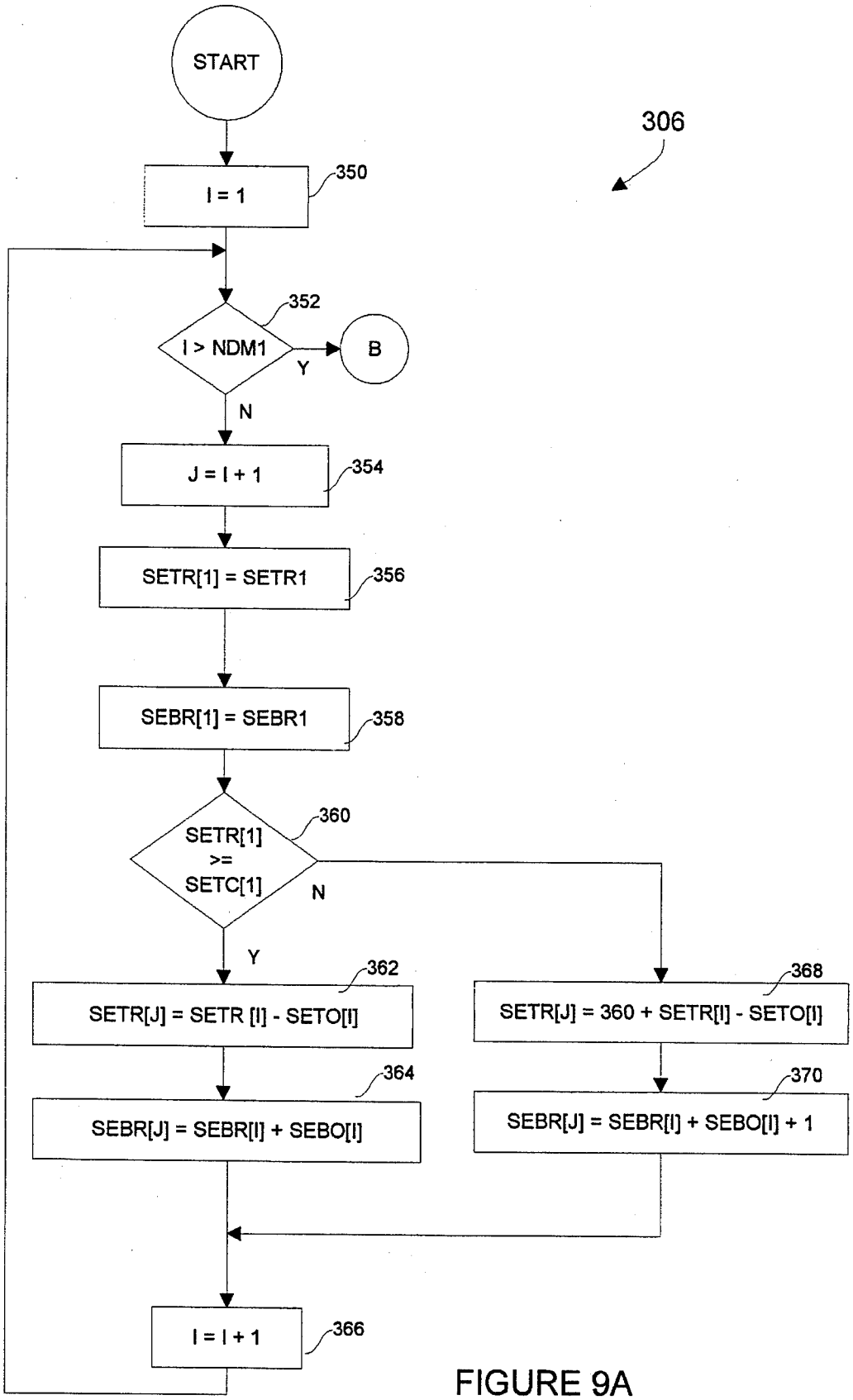
FIGS. 9A–9B, when joined along the similarly lettered lines, together comprise a detailed flowchart illustrating the operation of one portion of the automatic timing-adjustment apparatus shown in FIGS. 7A–7C.
Figure 9B:
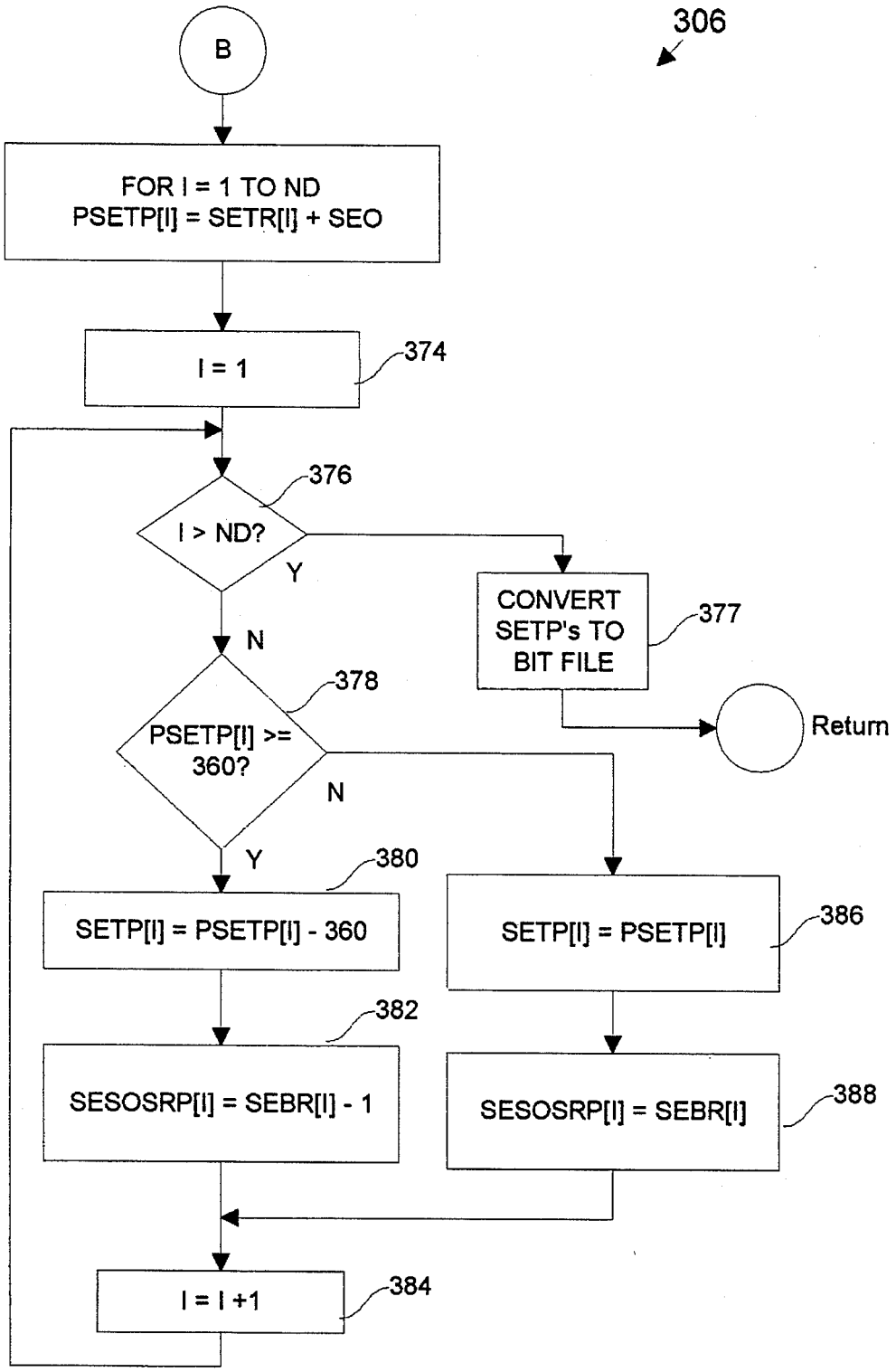

FIGS. 9A–9B illustrate a subroutine executed by the block 306 (FIG. 7A) for calculating saddle-eye time references, saddle-eye timing points, and saddle-eye shift-register positions for all saddle-eyes 90 in the gathering section 20. It should be noted that this subroutine does not set up timing points and shift register positions for feed-line eyes 88 as well as for saddle-eyes 90 because, unlike saddle-eyes 90 which are stationary with respect to the gathering section 20, feed-line eyes 88 are moveable along with the feeding devices 22 in which they are installed.

This automatic saddle-eye set-up subroutine, comprising blocks 350–388, is now described in detail. As a preliminary matter, however, the numerous variable arrays used by the subroutines of FIGS. 9A–13 are summarized in the following table:

| Arrayy Variable | Definition of Variable | Block(s) Assigning Value to Variable: |
|---|---|---|
| BP[i] | Bit Pattern Representing ith Segment of Machine Cycle | Pre-stored |
| CFBR[i] | Card-Feeder Bit Reference of ith (Card Feeder) Device | 474, 478 |
| CFTR[i] | Card-Feeder Time Reference of ith (Card Feeder) Device | 472, 476 |
| DBR[i] | Dragon Bit Reference of ith (Dragon) Device | 456, 460 |
| DFEDSRP[i] | Default value for Feed-Line Eye Defeat Shift-Register Position of ith Device | Pre-stored |
| DTR[i] | Dragon Time Reference of ith (Dragon) Device | 454, 458 |
| FEDSRP[i] | Feed-Line Eye Defeat Shift-Register Position of ith Device | 492, 498 |
| FESOSRP[i] | Feed-Line Shut-Off Shift-Register Position of ith Device | 494, 500 |
| FETPBP[i] | Feed-Line Eye Timing Point Bit Pattern of ith Device | 518 |
| FETP[i] | Feed-Line Eye Timing Point of ith Device | 490, 496 |
| HIGH[i] | Upper Angular Degree Limit of ith Segment of Machine Cycle | Pre-stored |
| LOW[i] | Lower Angular Degree Limit of ith Segment of Machine Cycle | Pre-stored |
| PBR[i] | Pocket Bit Reference of ith Pocket | 418, 422 |
| PFETP[i] | Provisional Feed-Line Eye Timing | 484 |
| PSETP[i] | Provisional Saddle-Eye Timing Point of ith Device | 372 |
| PTFBR[i] | PTF Bit Reference of ith (PTF) Device | 438, 442 |
| PTFTR[i] | PTF Time Reference of ith (PTF) Device | 436, 440 |
| PTR[i] | Pocket Time Reference of ith Pocket | 416, 420 |
| SEBO[i] | Saddle-Eye Bit Offset of ith Device | Pre-stored |
| SEBR[i] | Saddle-Eye Bit Reference of ith Device | 358, 364, 370 |
| SEDSRP[i] | Saddle-Eye Defeat Shift-Register Position of ith Device | 504 |
| SESOSRP[i] | Saddle-Eye Shut-Off Shift-Register Position of ith Device | 382, 388 |
| SETO[i] | Saddle-Eye Time Offset of ith Device | Pre-stored |
| SETPBP[i] | Saddle-Eye Timing Point Bit Pattern of ith Device | 402 |
| SETP[i] | Saddle-Eye Timing Point of ith Device | 380, 386 |
| SETR[i] | Saddle-Eye Time Reference of ith Device | 356, 362, 368 |
| SSRP[i] | Solenoid Shift-Register Position of ith Device | 426, 430, 446, 450, 464, 466, 482, 486 |
| STP[i] | Solenoid Timing Point of ith Device | 408 |
| STPBP[i] | Solenoid Timing Point Bit Pattern of ith Device | 514 |

As noted above, the variables identified in the foregoing table are array variables. In other words, each such variable is an array of storage locations in the memory of the controller 26 (shown in FIG. 1). Each array includes one element or storage location for each feeding device 22. Arrays are referred to generally herein by the name of the array followed by an empty pair of brackets (e.g., "SETR []"). The contents of particular array locations are referred to herein by the name of the array followed by either an integer or an integer variable enclosed in brackets (e.g,, "SETR[I]"). The integer or integer variable represents the ordinal number of the particular element in the array. For example, SETR[I] is the saddle-eye time reference of the Ith feeding device 22 of the gathering section 20, and SETR[1] is the saddle-eye time reference of the 1st feeding device 22.

As noted in the foregoing variable table, some of the array variables are not assigned values during operation of the subroutines described herein. Instead, these array variables have pre-stored values which are assigned by start-up programming used to set up the binding line prior to operation of the present invention. Alternatively, values for these variables could be entered by the operator of the binding line if a computer terminal were provided as described above. In any case, a description of each of these pre-stored values is provided below as the corresponding array variable is described.

In addition to the array variables, several other status-indicating variables are used in the programming of FIGS. 7A–7C and FIGS. 9A–13. These include bit variables such as ASM, CFASM, DASM, PASM, and SPASM; a bit array variable FEBB[]; and integer variables such as AP, TW2, and TW3. ASM is set when the thumbwheel 34 is set to 999. CFASM, DASM, PASM, and SPASM are set when the set-up mode selector switch 54 is set to the card-feeder, Dragon, pocket, or SMUF PTF auto set-up mode, respectively. AP indicates the current angular position in degrees of the binding line within its machine cycle. TW2 is set to the two-digit number selected by the right-most two digits 38, 40 of the thumbwheel 34, but the value of TW2 may also be modified by the programming described herein (see block 412, FIG. 11A). TW3 indicates the three-digit number selected by the thumbwheel 34. The bit array variable FEBB[] contains a "feed-line eye blocked" bit for each feeding device 22 in the gathering section 20. During any given program cycle, when the feed-line eye 88 of the Ith feeding device 22 is blocked by a signature 64, the feed-line eye blocked bit FEBB[I] of the Ith feeding device 22 is set or assigned a value of one for the duration of that program cycle. Otherwise, FEBB[I] has a value of zero.

All variables in the subroutines of the present invention, including any counter variables (e.g., I or J), are global variables. In other words, when any particular variable is assigned a value in one subroutine, that particular variable will have the assigned value when referenced in other subroutines until the variable is assigned a new value.

As shown in FIG. 9A, the block 350 initializes a counter I to one. The block 352 then tests whether the value of the counter I exceeds the value of the constant NDM1 (i.e., whether I>ND-1). If so, control passes to the block 372 (FIG. 9B). If I is less than or equal to NDM1, then the block 354 sets an array index variable J equal to I+1, the block 356 sets a variable SETR[1], representing the calculated saddle-eye time reference for the saddle eye 90 of the first feeding device 22, equal to the constant SETR1, and the block 358 sets a variable SEBR[1], representing the calculated saddle-eye bit reference for the saddle eye 90 of the first feeding device 22, equal to the constant SEBR1.

As shown in the array variable table above, a predetermined saddle-eye time offset SETO[] and a predetermined saddle-eye bit offset SEBO[] are pre-stored in the memory 47 of the controller 26 for each feeding device 22. Like previously described pre-stored array variables, the values stored in SETO[] and SEBO[] may be set by the machine programming or may be entered by the binding line operator via a computer terminal if one is provided.

The pre-stored values of the saddle-eye time offset SETO [I] and saddle-eye bit offset SEBO[I] of the Ith feeding device 22 are based on the angular distance between the saddle eye 90 of the Ith feeding device 22 and the saddle eye 90 of the next feeding device 22 (feeding device I+1) upstream in the gathering section 20. In particular, the pre-stored value of the saddle-eye bit offset SEBO[I] of Ith feeding device 22 is equal to the distance, expressed as an integer number of chain-space lengths, between the saddle eye 90 of the Ith feeding device 22 and the saddle eye 90 of the next feeding device 22 (feeding device I+1) upstream in the gathering section 20. The saddle-eye time offset SETO[I] of the Ith feeding device 22 is equal to the remainder resulting from dividing the total time between the Ith saddle eye and the (I+1)th saddle eye by 360°.

Next, the block 360 determines whether the saddle-eye time reference SETR[I] of the Ith feeding device 22 is greater than or equal to the saddle-eye time offset SETO[I] of the Ith feeding device 22. If so, the block 362 sets the Jth saddle-eye time reference SETR[J] equal to the Ith saddle-eye time reference SETR[I] minus the Ith saddle-eye time offset SETO[I], and the block 364 sets the Jth saddle-eye bit reference SEBR[J] equal to the Ith saddle-eye bit reference SEBR[I] plus the Ith saddle-eye bit offset SEBO[I]. Otherwise, the block 368 sets SETR[J] equal to 360° plus SETR[I] minus SETO[I], and the block 370 sets SEBR[J] equal to SEBR[I] plus SEBO[I] plus one. The blocks 362 and 368 place the saddle-eye time reference SETR[] for each feeding device 22 about one inch from the downstream gathering pin 28 closest to the saddle-eye of that feeding device 22 when another gathering pin 28 is one inch downstream of the saddle eye 90 of the first feeding device 22. The blocks 364 and 370 determine the saddle-eye bit reference SEBR[] for each feeding device 22 dependent upon the number of chain spaces 30 between adjacent feeding devices 22.

Thereafter, in either case, the block 366 increments the counter I by one so that the saddle-eye time reference SETR[] of the remaining feeding devices 22 may be calculated, and control returns to the block 352 which once again tests the value of the counter I as described above.

As shown in FIG. 9B, when the block 352 determines that the counter I exceeds NDM1, control passes to the block 372, which calculates a provisional saddle-eye timing point PSETP[] for each saddle eye 90. More particularly, a counter I is incremented sequentially from one to ND. For each value of I (i.e., for each saddle eye 90), the Ith provisional saddle-eye timing point PSETP[I] is calculated as the sum of the Ith saddle-eye time reference SETR[I] and the saddle-eye offset constant SEO. As stated above, the saddle-eye offset constant SEO is typically between approximately 270° and approximately 300°. This value of SEO ensures that the saddle-eye timing point SETP[I] of the Ith feeding device 22 will be set to a time such that, in the absence of a purposely omitted signature 64, or a misfed signature 64, or an already defective book, the Ith saddle eye 90 can be expected to be blocked by a signature 64 at the time when the output of the Ith saddle eye 90 is examined.

Next, the block 374 sets a counter I equal to one. The block 376 then determines whether I exceeds the number ND of feeding devices 22 in the gathering section 20. If so, a block 377 executes a subroutine (described below in connection with FIG. 10) that converts the saddle-eye timing points of each of the saddle eyes 90 (i.e., SETP[1], SETP[2], . . . , and SETP[ND]), which are expressed in angular degrees, into a bit file. Thereafter, execution of the saddle-eye set-up routine of FIGS. 9A–9B ends, and control returns to the point at which this routine was called (see the block 306 in FIG. 7A). If I is less than or equal to ND, the block 378 determines whether the provisional saddle-eye timing point PSETP[I] of the Ith saddle eye 90 is greater than or equal to 360°. If so, the block 380 computes the Ith saddle-eye timing point SETP[I], which must be between 0° and 359°, inclusive, by subtracting 360° from the Ith provisional saddle-eye timing point PSETP[I], and the block 382 sets the Ith saddle-eye shut-off shift-register position SESOSRP[I] equal to the Ith saddle-eye bit reference SEBR[I] minus one. If the block 378 determines that the provisional saddle-eye timing point PSETP[I] of the Ith saddle eye 90 is less than 360°, then the block 386 simply sets the Ith saddle-eye timing point SETP[I] equal to the Ith provisional saddle-eye timing point PSETP[I], and the block 388 sets the Ith saddle-eye shut-off shift-register position SESOSRP[I] equal to the Ith saddle-eye bit reference SEBR[I] of the Ith saddle eye 90. In either case, the block 384 thereafter increments the counter I by one and returns control to the block 376 which, once again, tests whether the counter I exceeds ND as described above.

Figure 10:
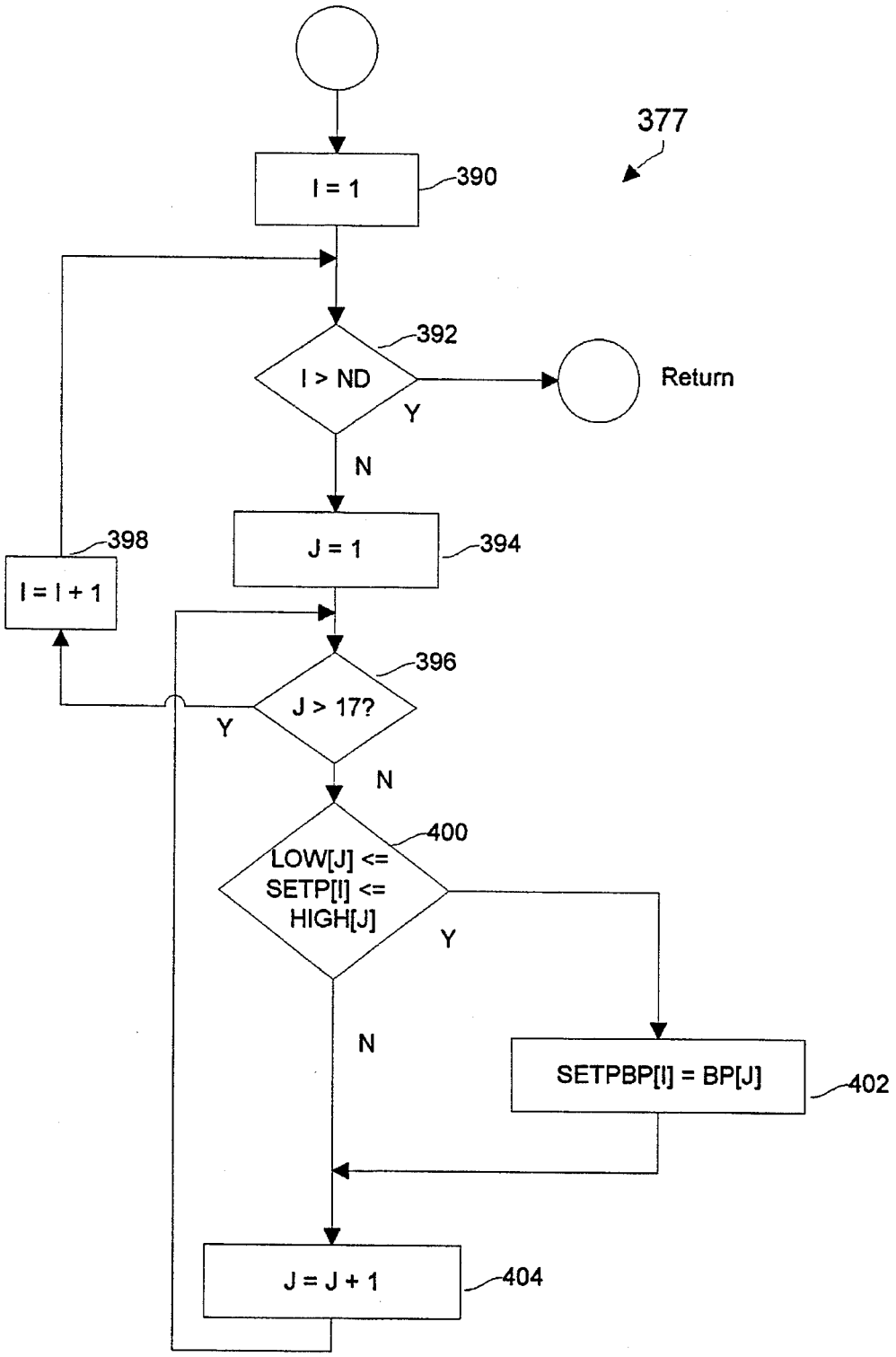
FIG. 10 comprises a detailed flowchart illustrating the operation of another portion of the automatic timing-adjustment apparatus shown in FIGS. 7A–7C.

FIG. 10 illustrates the saddle-eye timing-point conversion subroutine or programming sequence called by the block 377 (FIG. 9B) for converting the saddle-eye timing points SETP[] (which are expressed in degrees) of each of the saddle eyes 90 into a bit file or bit array SETPBP[] stored in the memory 47. This subroutine is now described in detail. In general terms, this subroutine encodes each saddle-eye timing point SETP[] as one of seventeen prestored bit patterns BP[] that are stored in the memory 47 of the controller 46.

More particularly, the machine cycle is divided into seventeen angular segments or timing points, each of which has a lower angular degree limit LOW[i] and an upper angular degree limit HIGH[i], where i is an integer between one and seventeen, inclusive. Of course, the machine cycle can be divided into any desired number of timing points of any desired size. Seventeen segments are chosen to allow the timing points or angular segments within which the sensors 88 and 90 must detect missing signatures 64 to be set with an acceptable degree of precision.

The arrays of angular degree limits LOW[] and HIGH[] are stored in the memory 47 of the controller 26. For each saddle-eye timing point SETP[I], expressed in degrees, the timing-point-conversion subroutine selects a saddle-eye timing-point bit pattern SETPBP[I]. Specifically, SETPBP[I] is set equal to the pre-stored bit pattern BP [J] for which the corresponding lower and upper angular degree limits LOW [J] and HIGH[J] define the angular segment of the machine cycle that includes the saddle-eye timing point SETP[I]. This conversion is necessary because the saddle-eye timing-point bit patterns SETPBP[] can be rapidly interpreted and used by the controller 26, whereas the degree values of the saddle-eye timing points SETP[] cannot. Of course, in programming environments where decimal values can be interpreted sufficiently quickly, the conversion to bit patterns is unnecessary.

First, as shown in FIG. 10, a block 390 initializes a counter I to one. A block 392 then tests whether the counter I exceeds the number ND of devices in the binding line gathering section 20. If so, execution of the timing-point-conversion subroutine ends and control returns to the point in the programming sequence where this subroutine was called (block 377, FIG. 9B); thereafter, control returns to the block 308 (FIG. 7B). If the counter I is less than or equal to ND, a block 394 initializes a counter J to one, and a block 396 tests whether J is greater than seventeen. If so, a block 398 increments the counter I by one and returns control to the block 392 which, once again, tests whether I exceeds ND. If the block 396 determines that J is less than or equal to seventeen, then a block 400 tests whether the Ith saddle-eye timing point SETP[I] is within the Jth angular segment of the machine cycle (i.e., whether LOW[J]≦SETP[I]≦HIGH[J]). If so, a block 402 sets the Ith saddle-eye timing-point bit pattern SETPBP[I] equal to the Jth pre-stored bit pattern BP[J]. Thereafter, a block 404 increments the counter J by one and returns control to the block 396 which tests whether J exceeds 16 as described above. If the block 400 determines that the Ith saddle-eye timing point SETP[I] is not within the Jth angular time segment, then the block 402 is bypassed, and the block 404 increments the counter J by one and returns control to the block 396.

FIGS. 11A–11F illustrate a programming sequence or subroutine executed by the block 314 (FIG. 7B) and by a block 534 (shown in FIG. 13 and described in detail below) for setting up the timing points and shift-register positions associated with a selected feeding device 22. This subroutine is now described in detail.

When executed by the block 314, this subroutine operates to set up all timing points and shift-register positions for a selected feeding device 22. In such a case, the number of the feeding device 22 is simply TW2, the device number selected by the thumbwheel 34. Also, four flags or bits, corresponding to the four positions of the set-up mode selector switch 54 (FIG. 2B), are provided. One of these flags is automatically set as a result of the setup mode selector switch 54 being set to the corresponding position. These flags (and the corresponding set-up mode selector switch positions) are: PASM (pocket auto set-up mode), SPASM (SMUF PTF auto set-up mode), DASM (Dragon PTF auto set-up mode), and CFASM (card-feeder auto set-up mode).

Alternatively, this subroutine may be repeatedly executed by the block 534 to set up all timing points and shift-register positions for each of the feeding devices 22 in sequence. In this case, the thumbwheel 34 has been set to 999 and the auto set-up mode bit ASM has been set (see FIG. 7C). Each time the subroutine is executed by the block 534, TW2 is changed to a new device number, as described below. Notably, the position of the set-up mode selector switch 54 is irrelevant when this subroutine is executed by the block 534 (FIG. 13) as the subroutine of FIG. 13 only sets up timing points and shift-register positions of pockets 22.

In order to prevent the timing points and shift-register positions of the sensors 88, 90 and the solenoid 92 of feeding devices 22 other than pockets 22 from being automatically reset by the operation of this subroutine, non-pocket feeding devices 22 must be turned off or emptied of signatures so that the feed-line eyes 88 of those devices will not trigger the recalculation of their associated timing points and shift-register positions. Alternatively, means could be provided for identifying all feeding devices 22 of any particular type (e.g., pockets 22) so that only the timing points and shift-register positions of feeding devices of the particular type would be automatically set up by this subroutine.

As one example, each type of feeding device 22 could provide an identifying signal or set of signals to the controller 26 so that the controller 26 could effect the set-up of only devices of an operator-selected type (e.g., pockets 22 or any other type). More particularly, an electrical connector or plug (not shown) is used to connect each feeding device 22 of the gathering section 20 to the controller 26 so that various electrical input and output signals can be transmitted therebetween. Two pins of the electrical connector of each particular feeding device 22 could be dedicated to identifying the type of the particular feeding device 22 via a pre-determined assignment of logic values or signals coupled to the two dedicated identification pins. Specifically, each different type of feeding device 22 could supply a unique two-bit identifying code at the two dedicated pins (e.g., pocket=00, SMUF PTF=01, Dragon PTF=10, and cardfeeder=11, where "0" denotes a first particular voltage level and "1" denotes a second particular voltage level). Of course, any other suitable means for identifying the type of a feeding device 22 could be used instead, if desired.

Figure 11A:
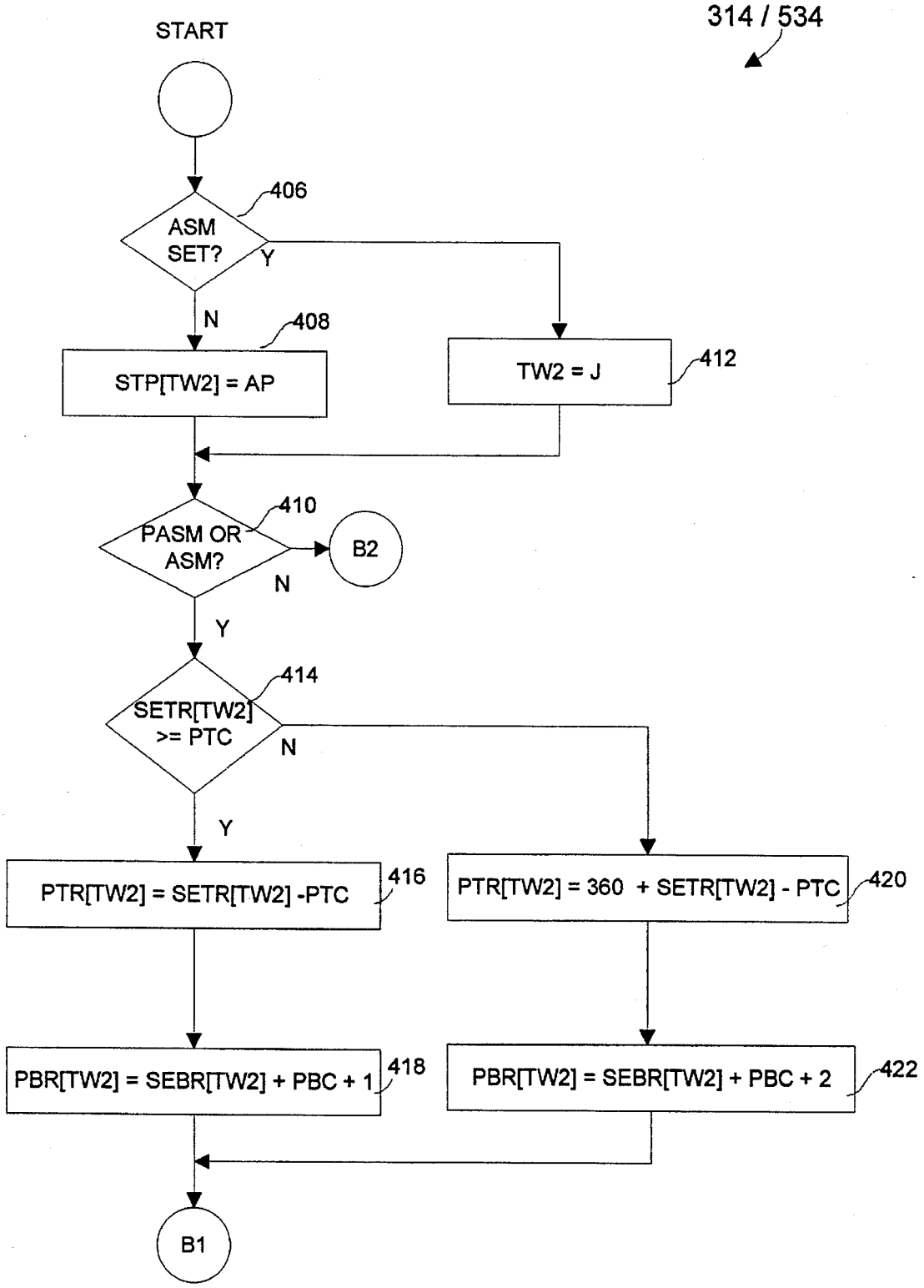
FIGS. 11A–11F, when joined along the similarly lettered lines, together comprise a detailed flowchart illustrating the operation of yet another portion of the automatic timing-adjustment apparatus shown in FIGS. 7A–7C.

As shown in FIG. 11A, a block 406 tests whether the auto set-up mode bit ASM is set (i.e. whether the thumbwheel 34 is set to 999). It should be noted that the auto set-up mode bit ASM is cleared at the beginning of each program cycle and is set to one again only when the thumbwheel 34 is set to 999.

If the auto set-up mode bit ASM is not set, the subroutine has been called by the block 314 to set up the timing points and shift-register positions of a feeding device 22 selected by the thumbwheel 34 which is set to a number between 801 and 832, inclusive (so that TW2 is between 1 and 32, inclusive). In this case, a block 408 sets the solenoid timing point STP[TW2] of the selected feeding device 22 equal to the angular position AP of the gathering section 20 within its machine cycle as detected by a decoder or resolver (not shown). To set the solenoid timing point STP[TW2] properly, however, the operator of the binding line must first have slowly advanced the gathering chain 24 (FIG. 1) until he has observed that the gripper 72 (FIG. 3) of the selected feeding device 22 has gripped a signature 64 (FIG. 3). Control then passes to the block 410.

Figure 13:
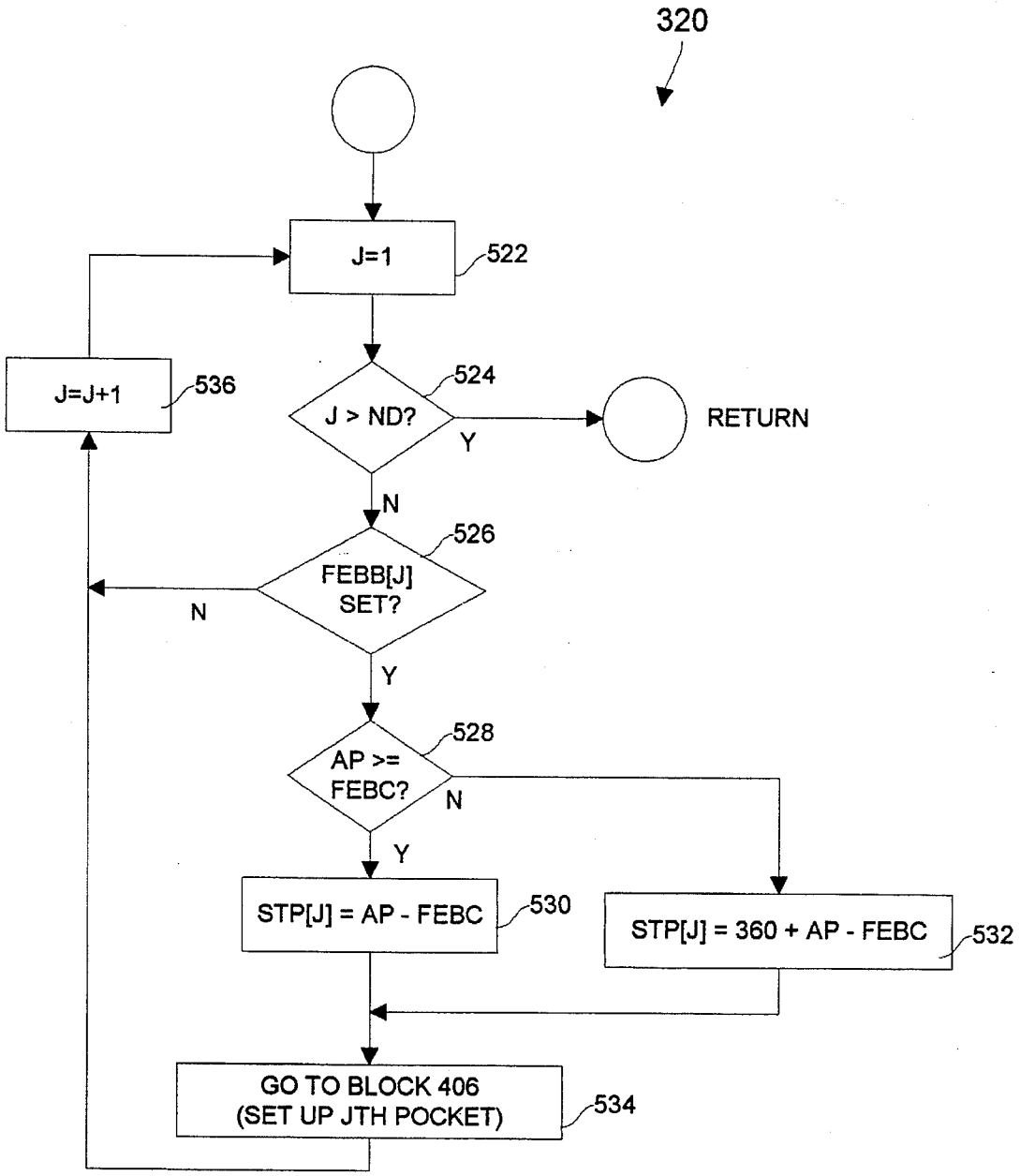
FIG. 13 comprises a detailed flowchart illustrating the operation of another portion of the automatic timing-adjustment apparatus shown in FIGS. 7A–7C.

On the other hand, if the auto set-up mode bit ASM is set, the subroutine has been executed by the block 534 of FIG. 13 to set up the timing points and shift-register positions of a pocket 22 selected by the pocket auto set-up sequence (described below in connection with FIG. 13), and the thumbwheel 34 has been set to 999. It should be noted that, if the auto set-up mode bit ASM is set, the selected feeding device 22 is necessarily a pocket 22, because the subroutine of FIG. 13 calls the subroutine of FIG. 11 only to set-up timing points and shift register positions of pockets 22 and not of other types of feeding devices 22. To that end, a block 412 sets TW2 equal to the value of J, which will have been set previously by one of the blocks 522 or 536 of FIG. 13 in order to specify the selected pocket 22. In this case, the solenoid timing point STP[TW2] of the specified pocket 22 will also have been set by the pocket auto set-up subroutine of FIG. 13 as described below. In this case, too, control thereafter passes to the block 410.

The block 410 tests whether either the pocket auto set-up mode bit PASM is set (i.e., whether the set-up selector switch 54 (FIG. 2B) is set to the pocket auto setup position), or the auto set-up mode bit ASM is set (i.e, whether the thumbwheel 34 has been set to 999). If both conditions are false, indicating that this subroutine was executed by the block 314 to set up the timing points and shift-register positions of a feeding device 22 other than a pocket (e.g., a SMUF PTF, a Dragon PTF, or a card feeder), control passes to a block 428 (FIG. 11B). If either condition is true, indicating that the routine has been executed by one of the blocks 314 or 534 to set up the timing points and shift-register positions of a pocket 22, control passes to a block 414 which tests whether the saddle-eye time reference SETR[TW2] for the selected feeding device 22 (necessarily a pocket) is greater than or equal to the pocket time constant PTC (described above in connection with the block 328 (FIG. 8A)). If so, a block 416 sets the pocket time reference PTR[TW2] of the selected pocket 22 equal to the difference between the saddle-eye time reference SETR[TW2] of the selected pocket 22 and the pocket time constant PTC, and a block 418 sets the pocket bit reference PBR[TW2] of the selected pocket 22 equal to the saddle-eye bit reference SEBR[TW2] of the selected pocket 22 plus the pocket bit constant PBC (described above in connection with the block 330 (FIG. 8A)) plus one. Thereafter, control passes to a block 424 (FIG. 11B). If not, a block 420 sets the pocket time reference PTR[TW2] of the selected pocket 22 equal to 360° plus the saddle-eye time reference SETR[TW2] of the selected pocket 22 minus the pocket time constant PTC, and a block 422 sets the pocket bit reference PBR[TW2] of the selected pocket 22 equal to the saddle-eye bit reference SEBR[TW2] of the selected pocket 22 plus the pocket bit constant PBC plus two, and control passes to the block 424 (FIG. 11B).

Figure 11B:
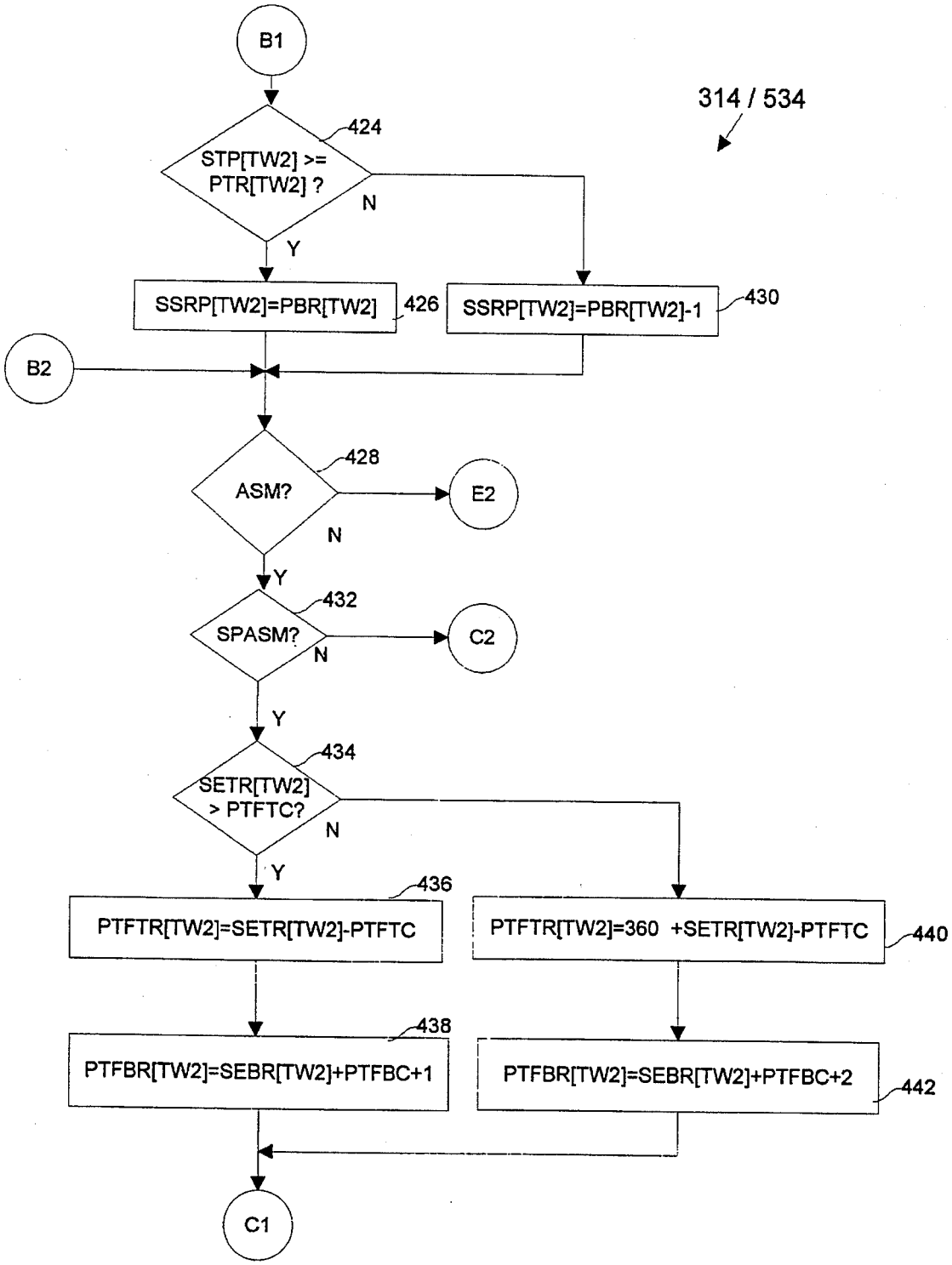

As shown in FIG. 11B, the block 424 tests whether the solenoid timing point STP[TW2] of the selected pocket 22 is greater than or equal to the pocket time reference PTR [TW2] of the selected pocket 22. If so, a block 426 sets the solenoid shift-register position SSRP[TW2] of the selected pocket 22 equal to the pocket bit reference PBR[TW2] of the selected pocket 22, and control passes to a block 428. It should be noted that the solenoid shift-register position SSRP[I] of the Ith feeding device 22 (of any type) refers to a particular position in the shift-register 45 (shown in FIG. 1) in which a bit is set to one if the Ith feeding device 22 should not feed a signature 64 and is set to zero otherwise. Accordingly, the solenoid shift-register position SSRP [TW2] of the selected feeding device 22 is set based upon the number (plus one or two) of chain spaces 30 that pass through the selected feeding device 22 (selected by TW2) between the time when a signature 64 is gripped by the grippers 72 and the time when the output of the saddle eye 90 of that feeding device 22 is examined to determine whether that signature 64 has correctly dropped onto the gathering chain 24. The one or two is added so that the feeding device 22 will be turned off before it feeds a signature 64 that will be deposited on a chain space 30 containing a book that was determined to be defective upstream of the feeding device 22 (i.e., a book for which the corresponding bit in the shift register 45 is set to one).

If the solenoid timing point STP[TW2] of the selected pocket 22 is less than the pocket time reference PTR[TW2] of the selected pocket 22, then a block 430 sets the solenoid shift-register position SSRP[TW2] of the selected pocket 22 equal to the pocket bit reference PBR[TW2] of the selected pocket 22 minus one, and control passes to the block 428.

The block 428 tests whether the auto set-up mode bit ASM is set (i.e., whether the thumbwheel 34 is set to 999). If so, control passes to a block 484 (FIG. 11E); otherwise, control passes to a block 432.

The block 432 tests whether the SMUF PTF auto setup mode bit SPASM is set (i.e., the set-up mode selector switch 54 (FIG. 2B) is set to the SMUF PTF auto set-up position). If not, control passes to a block 448 (FIG. 11C); if so, control passes to a block 434 to set up the selected feeding device 22 (which, in this case, is a SMUF PTF device).

The block 434 tests whether the saddle-eye time reference SETR[TW2] for the selected SMUF PTF device 22 is greater than or equal to the PTF time constant PTFTC (described above in connection with block 332 (FIG. 8A)). If so, a block 436 sets the PTF time reference PTFTR[TW2] of the selected SMUF PTF device 22 equal to the saddle-eye time reference SETR[TW2] of the selected SMUF PTF device 22 minus the PTF time constant PTFTC, and a block 438 sets the PTF bit reference PTFBR[TW2] of the selected SMUF PTF device 22 equal to the saddle-eye bit reference SEBR[TW2] of the selected SMUF PTF device 22 plus the PTF bit constant PTFBC plus one. Thereafter, control passes to a block 444 (FIG. 11C). If the saddle-eye time reference SETR[TW2] of the selected SMUF PTF device 22 is less than the PTF time constant PTFTC, as determined by the block 434, then a block 440 sets the PTF time reference PTFTR[TW2] of the selected SMUF PTF device 22 equal to 360° plus the saddle-eye time reference SETR[TW2] of the selected SMUF PTF device 22 minus the PTF time constant PTFTC, and a block 442 sets the PTF bit reference PTFBR [TW2] of the selected SMUF PTF device 22 equal to the saddle-eye bit reference SEBR[TW2] of the selected SMUF PTF device 22 plus the PTF bit constant PTFBC plus two, and control passes to the block 444 (FIG. 11C).

Figure 11C:
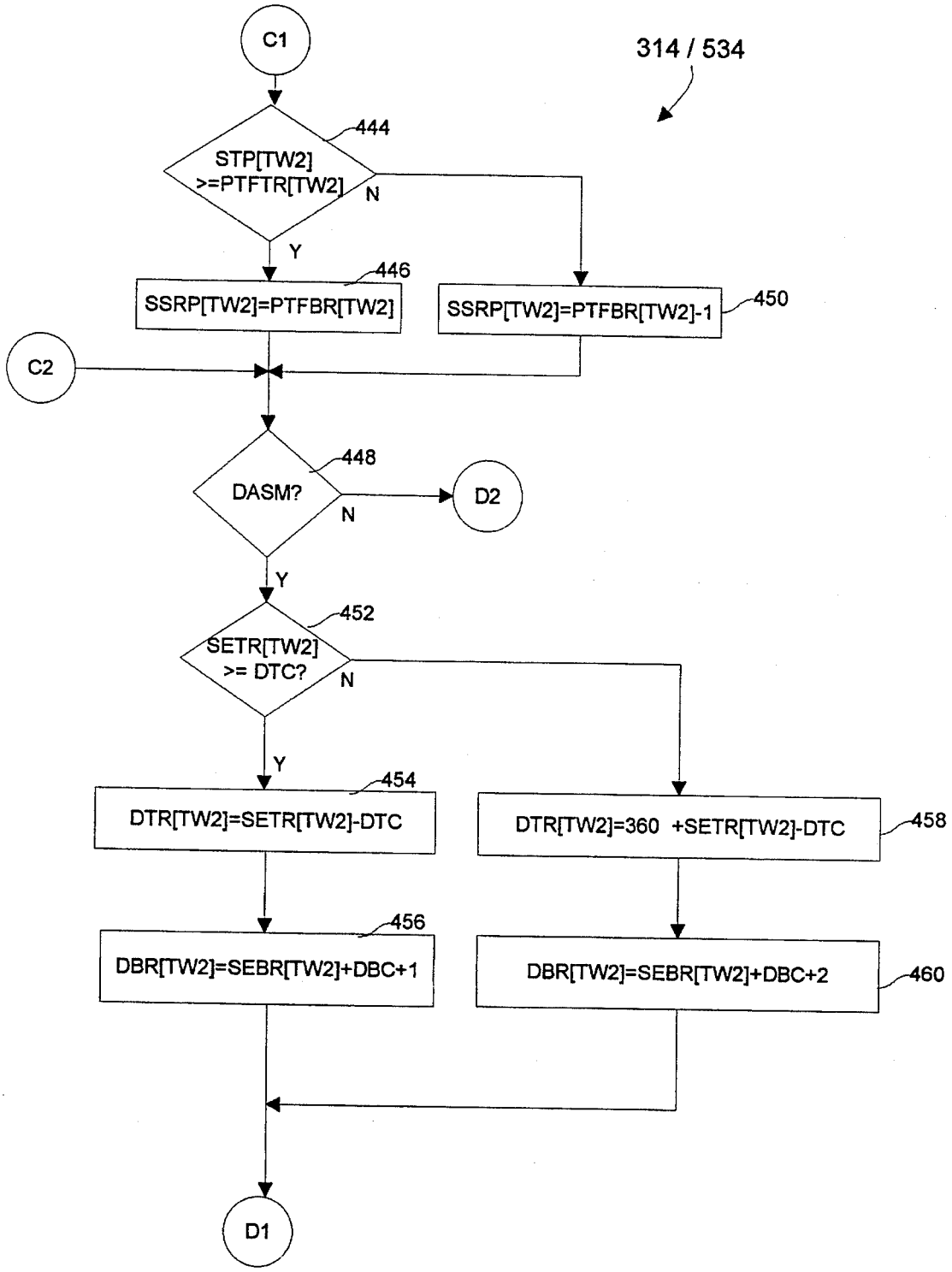

As shown in FIG. 11C, the block 444 tests whether the solenoid timing point STP[TW2] of the selected SMUF PTF device 22 is greater than or equal to the PTF time reference PTFTR[TW2] of the selected SMUF PTF device 22. If so, a block 446 sets the solenoid shift-register position SSRP [TW2] of the selected SMUF PTF device 22 equal to the PTF bit reference PTFBR[TW2] of the selected SMUF PTF device 22, and control passes to a block 448. If not, a block 450 sets the solenoid shift-register position SSRP[TW2] of the selected SMUF PTF device 22 equal to the PTF bit reference PTFBR[TW2] minus one, and control passes to the block 448.

The block 448 tests whether the Dragon auto set-up mode bit DASM is set (i.e., whether the set-up mode selector switch 54 is set to the Dragon PTF auto set-up position (FIG. 2B)). If not, control passes to a block 468 (FIG. 11D); if so, control passes to a block 452 to set up the selected feeding device 22 (which, in this case, is a Dragon PTF device).

The block 452 determines whether the saddle-eye time reference SETR[TW2] of the selected Dragon PTF device 22 is greater than or equal to the Dragon time constant DTC (described above in connection with block 336 (FIG. 8A)). If so, a block 454 sets the Dragon time reference DTR[TW2] of the selected Dragon PTF device 22 equal to the saddle-eye time reference SETR[TW2] of the selected Dragon PTF device 22 minus the Dragon time constant DTC, and a block 456 sets the Dragon bit reference DBR[TW2] of the selected Dragon PTF device 22 equal to the saddle-eye bit reference SEBR[TW2] of the selected Dragon PTF device 22 plus the Dragon bit constant DBC plus one. If not, a block 458 sets the Dragon time reference DTR[TW2] of the selected Dragon PTF device 22 equal to 360° plus the saddle-eye time reference SETR[TW2] of the selected Dragon PTF device 22 minus the Dragon time constant DTC, and a block 460 sets the Dragon bit reference DBR[TW2] of the selected Dragon PTF device 22 equal to the saddle-eye bit reference SEBR[TW2] of the selected Dragon PTF device plus the Dragon bit constant DBC plus two. In either case, control then passes to a block 462 (FIG. 11D).

Figure 11D:
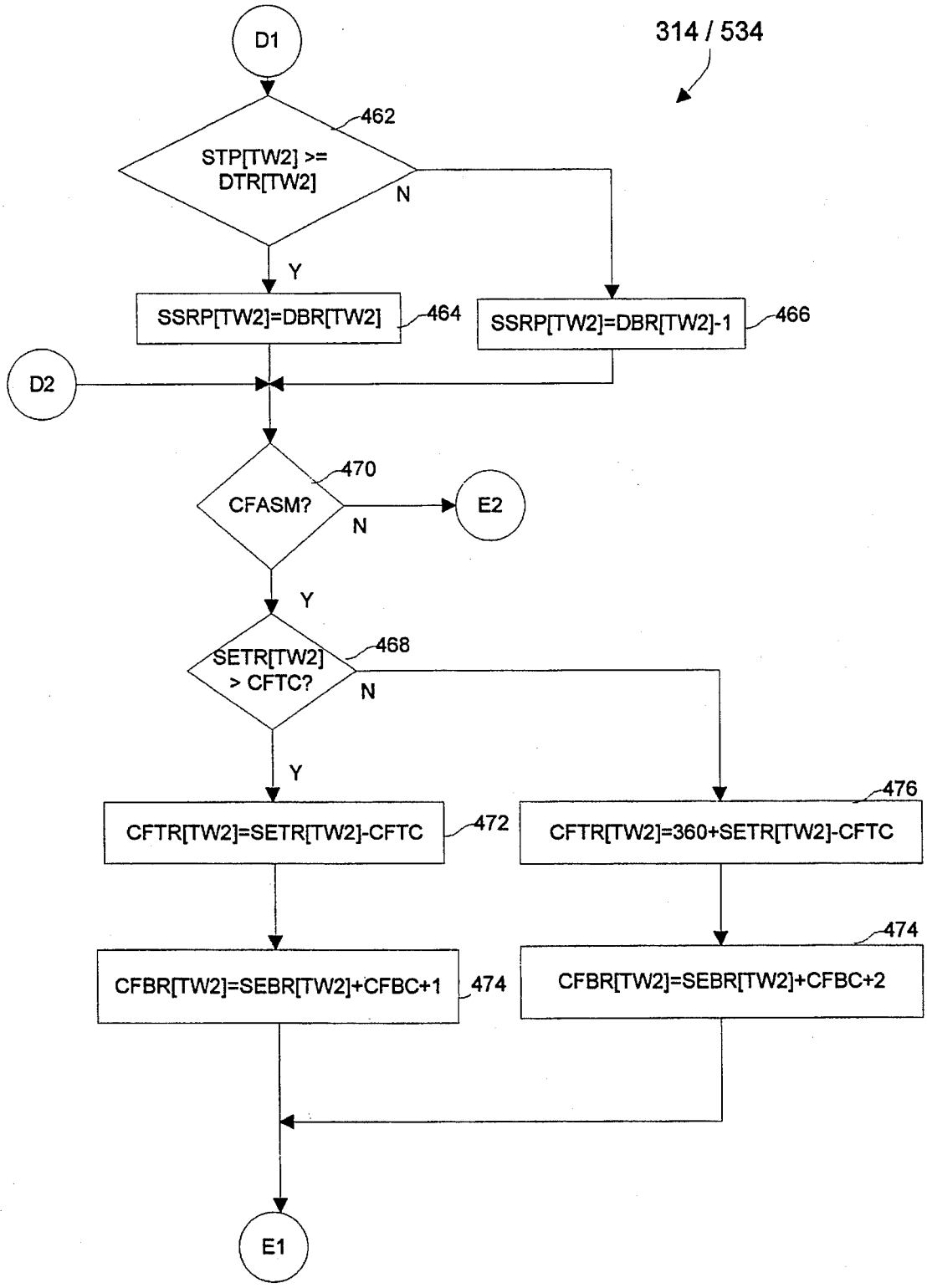

As shown in FIG. 11D, the block 462 tests whether the solenoid timing point STP[TW2] of the selected Dragon PTF device 22 is greater than or equal to the Dragon time reference DTR. If so, a block 464 sets the solenoid shift-register position SSRP[TW2] of the selected Dragon PTF device 22 equal to the Dragon bit reference DBR[TW2] of the selected Dragon PTF device 22; otherwise, a block 466 sets the solenoid shift-register position SSRP[TW2] of the selected Dragon PTF device 22 equal to the Dragon bit reference DBR[TW2] of the selected Dragon PTF device 22 minus one.

Figure 11E:
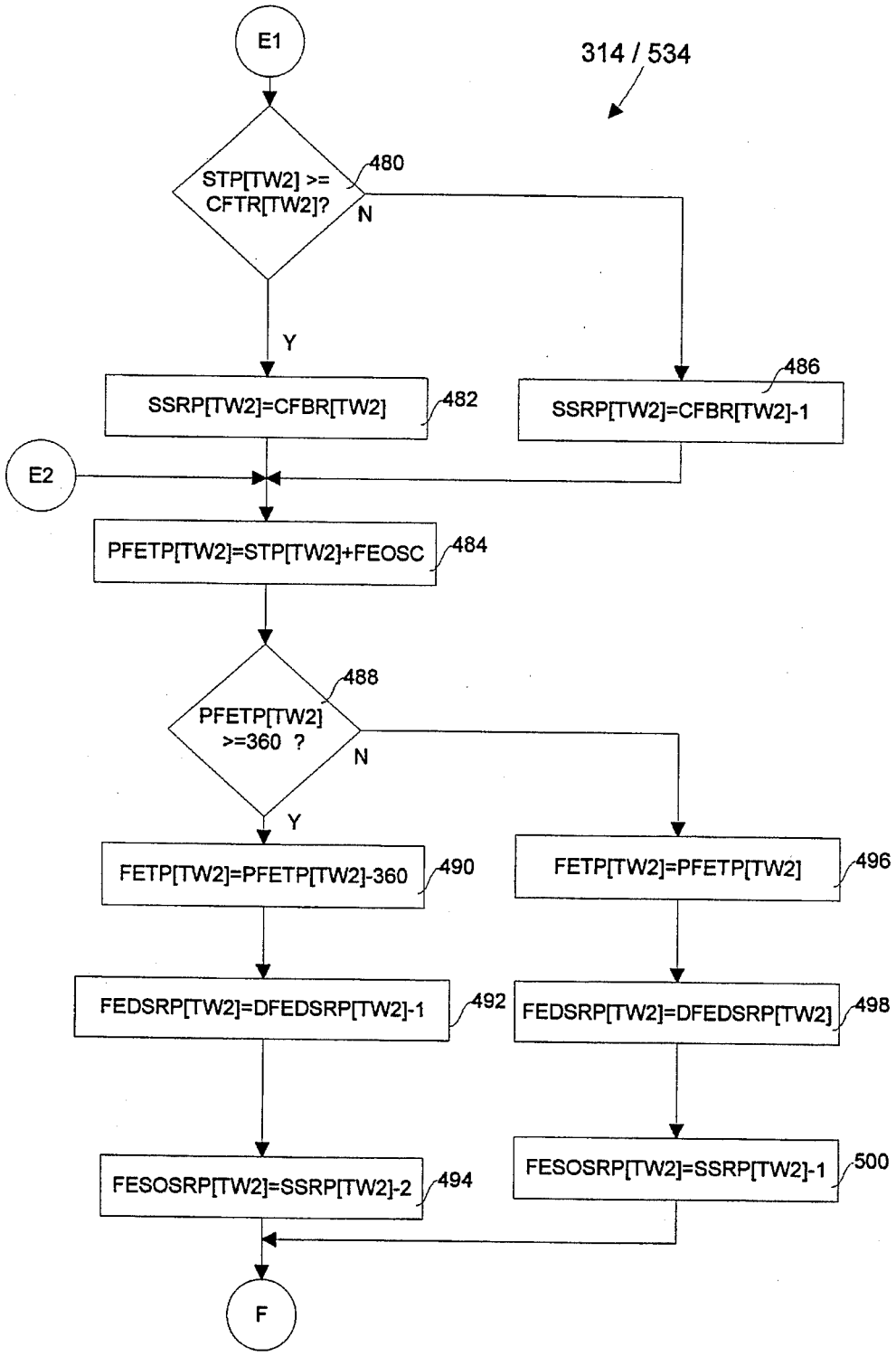

In either case, control then passes to the block 468, which tests whether the card-feeder auto set-up mode bit CFASM is set (i.e. whether the set-up mode selector switch 54 (FIG. 2B) is set to the card-feeder auto set-up position). If not, control passes to a block 484 (FIG. 11E). If so, a block 470 tests whether the saddle-eye time reference SETR[TW2] of the selected feeding device 22 (which, in this case, is necessarily a card feeder) is greater than or equal to the card-feeder time constant CFTC. If so, a block 472 sets the card-feeder time reference CFTR[TW2] of the selected card feeder 22 equal to the saddle-eye time reference SETR [TW2] of the selected card feeder 22 minus the card-feeder time constant CFTC, and a block 474 sets the card-feeder bit reference CFBR[TW2] of the selected card feeder 22 equal to the saddle-eye bit reference SEBR[TW2] of the selected card feeder 22 plus the card-feeder bit constant CFBC plus one. If not, a block 476 sets the card-feeder time reference CFTR[TW2] of the selected card feeder 22 equal to 360° plus the saddle-eye time reference SETR[TW2] of the selected card feeder 22 minus the card-feeder time constant CFTC, and a block 478 sets the card-feeder bit reference CFBR[TW2] of the selected card feeder 22 equal to the saddle-eye bit reference SEBR[TW2] of the selected card feeder 22 plus the cardfeeder bit constant CFBC plus two. In either case, control thereafter passes to a block 480 (FIG. 11E).

As shown in FIG. 11E, the block 480 tests whether the solenoid timing point STP[TW2] of the selected card feeder 22 is greater than or equal to the card-feeder time reference CFTR[TW2] of the selected card feeder 22. If so, a block 482 sets the solenoid shift-register position SSRP[TW2] of the selected card feeder 22 to the card-feeder bit reference CFBR[TW2] of the selected card feeder 22, and if not, a block 486 sets the solenoid shift-register position SSRP [TW2] of the selected card feeder 22 equal to the card-feeder bit reference CFBR[TW2] of the selected card feeder 22 minus one. In either case, control then passes to the block 484.

The block 484 sets the provisional feed-line eye timing point PFETP[TW2] of the selected feeding device 22 (which, at this point in the program, may be any type of feeding device) equal to the sum of the solenoid timing point STP[TW2] of the selected feeding device 22 and the feed-line eye one-shot constant FEOSC (described above in connection with the block 344 (FIG. 8A)).

Next, a block 488 tests whether the provisional feed-line eye timing point PFETP[TW2] of the selected feeding device 22 is greater than or equal to 360°. If so, a block 490 sets the feed-line eye timing point FETP[TW2] of the selected feeding device 22 equal to the provisional feed-line eye timing point PFETP[TW2] of the selected feeding device 22 minus 360°; a block 492 sets the feed-line eye defeat shift-register position FEDSRP[TW2] of the selected feeding device 22 equal to a default value for the feed-line eye defeat shift-register position DFEDSRP[TW2] of the selected feeding device 22 (retrieved from an array DFED-SRP[] of pre-stored default values for the feed-line eye defeat shift-register positions of each of the feeding devices 22, which array is stored in the memory 47 of the controller 26 (FIG. 1)), minus one; and a block 494 sets the feed-line eye shutoff shift-register position FESOSRP[TW2] of the selected feeding device 22 equal to the solenoid shift-register position SSRP[TW2] of the selected feeding device 22 minus two.

It should be noted that the feed-line eye defeat shift-register positions FEDSRP[] (and the saddle-eye defeat shift-register positions SEDSRP[] described below) of the feeding devices 22 do not refer to positions in the shift register 45. They refer instead to ordinal position numbers in a defeat shift register DSR (shown in FIG. 1), which is also stored in the memory 47 of the controller 26, but which is distinct from the shift register 45. A bit in the defeat shift register DSR is set when a signature 64 is purposely omitted from a book (e.g., when customized books are being gathered). For example, under ordinary circumstances, when a feed-line eye 88 (or a saddle eye 90) of a particular feeding device 22 detects a missing signature 64, the bit in the corresponding feed-line eye shut-off shift-register position FESOSRP[] (or the corresponding saddle-eye shut-off shift-register position SESOSRP[] in the shift register 45) is set to one to indicate that the book is defective. However, when the bit in the feed-line eye defeat shift-register position FED-SRP[] (or the bit in the saddle-eye defeat shift-register position SEDSRP[]) is set, indicating that the signature 64 was purposely omitted, the failure of the feed-line eye 88 (or of the saddle eye 90) to detect a signature 64 does not cause the bit in the corresponding feed-line eye shut-off shift-register position FESOSRP[] (or the bit in the corresponding saddle-eye shut-off shift-register position SESOSRP[]) in the shift register 45 to be set, because the book is not defective.

The defeat shift register DSR may include a number of sub-registers corresponding to the number ND of feeding devices 22 in the gathering section 20. In this type of defeat shift register DSR, each sub-register is associated with a particular feeding device 22. When a particular feeding device 22 is purposely caused to not feed a signature, a bit in the sub-register associated with the particular feeding device 22 is set to one. Bits are shifted synchronously through all of the sub-registers as the gathering section 20 advances, and when the feed-line eye 88 of the particular feeding device 22 fails to detect the purposely omitted signature 64, the bit in the feed-line eye shut-off shift-register position FESOSRP[] of the particular feeding device 22 in the shift register 45 will not be set to one if the bit in the feed-line eye defeat shift-register position FEDSRP[] of the particular feeding device 22 in the defeat shift register DSR is set to one. Similarly, the bit in the saddle-eye shut-off shift-register position SESOSRP[] of the particular feeding device 22 will not be set to one if the bit corresponding to the book in which the signature 64 is to be omitted (which bit will have been shifted within the sub-register associated with the particular feeding device 22 from the feed-line eye defeat shift-register position FEDSRP[] of the particular feeding device 22 to the saddle-eye defeat shift-register position SEDSRP[] thereof) is set to one.

Rather than including a collection of sub-registers as described above, the defeat shift register DSR could be a single, long, continuous shift register having a particular segment thereof associated with each feeding device 22. In this variant, a bit is set to one in the segment associated with a feeding device 22 that is caused to purposely omit a signature 64, but that bit is not actually shifted through the entire segmented shift register. Instead, when the bit is shifted to the last bit position in the segmented shift register, the bit is set to zero before being shifted into the next segment. In effect, then, the long, segmented shift register DSR is thereby used to emulate a set of separate shift registers as in the above-described embodiment.

If, the block 488 determines that the provisional feed-line eye timing point PFETP[TW2] of the selected feeding device 22 is less than 360°, a block 496 sets the feed-line eye timing point FETP[TW2] of the selected feeding device 22 equal to the provisional feed-line eye timing point PFETP [TW2] of the selected feeding device 22; a block 98 sets the feed-line eye defeat shift-register position FEDSRP[TW2] of the selected feeding device 22 equal to a default value for the feed-line eye defeat shift-register position DFEDSRP [TW2] of the selected feeding device 22 (retrieved from an array DFEDSRP[] of pre-stored default values for the feed-line eye defeat shift-register positions of each of the feeding devices 22); and a block 500 sets the feed-line eye shutoff shift-register position FESOSRP[TW2] of the selected feeding device 22 equal to the solenoid shift-register position SSRP[TW2] of the selected feeding device 22 minus one. In either case, control then passes to a block 502 (FIG. 11F).

Figure 11F:
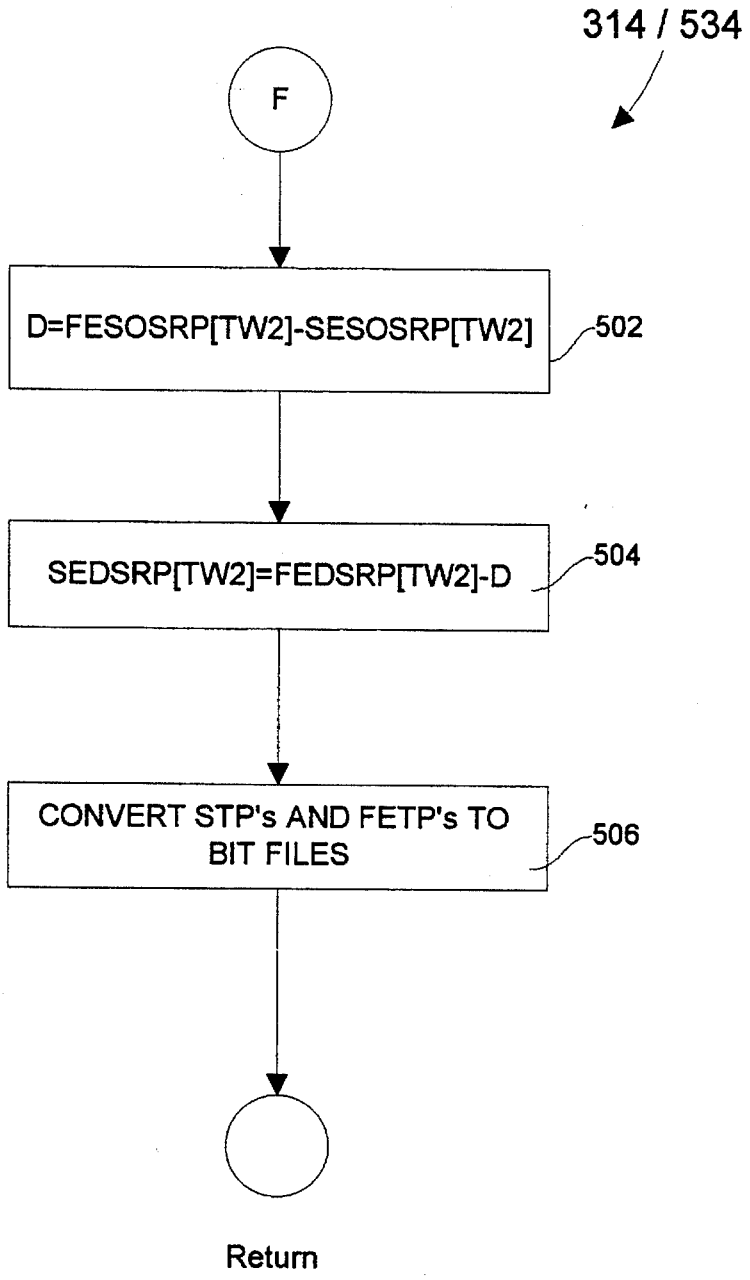

As shown in FIG. 11F, the block 502 computes a difference D between the feed-line eye shutoff shift-register position FESOSRP[TW2] of the selected feeding device 22 and the saddle-eye shutoff shift-register position SESOSRP [TW2] of the selected feeding device 22. The saddle-eye shut-off shift-register position SESOSRP[I] of the Ith feeding device 22 is the position in the shift register 45 where a bit will be set when a missing signature is detected by the Ith saddle eye 90 (unless the bit stored in the Ith saddle-eye defeat shift-register position SEDSRP[I] in the defeat shift register DSR is set as described above.

Thereafter, a block 504 sets the saddle-eye defeat shift-register position SEDSRP[TW2] of the selected feeding device 22 equal to the feed-line eye defeat shift-register position FEDSRP[TW2] of the selected feeding device 22 minus the difference D, and a block 506 executes a subroutine described below in connection with blocks 508–520 (FIG. 12) for converting the decimal degree values of the solenoid timing point STP[TW2] and the feed-line eye timing point FETP[TW2] of the selected feeding device 22 into a bit file. Thereafter, the timing/shift-register set-up subroutine of FIGS. 11A–11F terminates, and control returns to the point where the subroutine was called (i.e., either the block 314 of FIG. 7B (selected feeding device set-up) or the block 534 of FIG. 13 (auto pocket set-up)).

Figure 12:
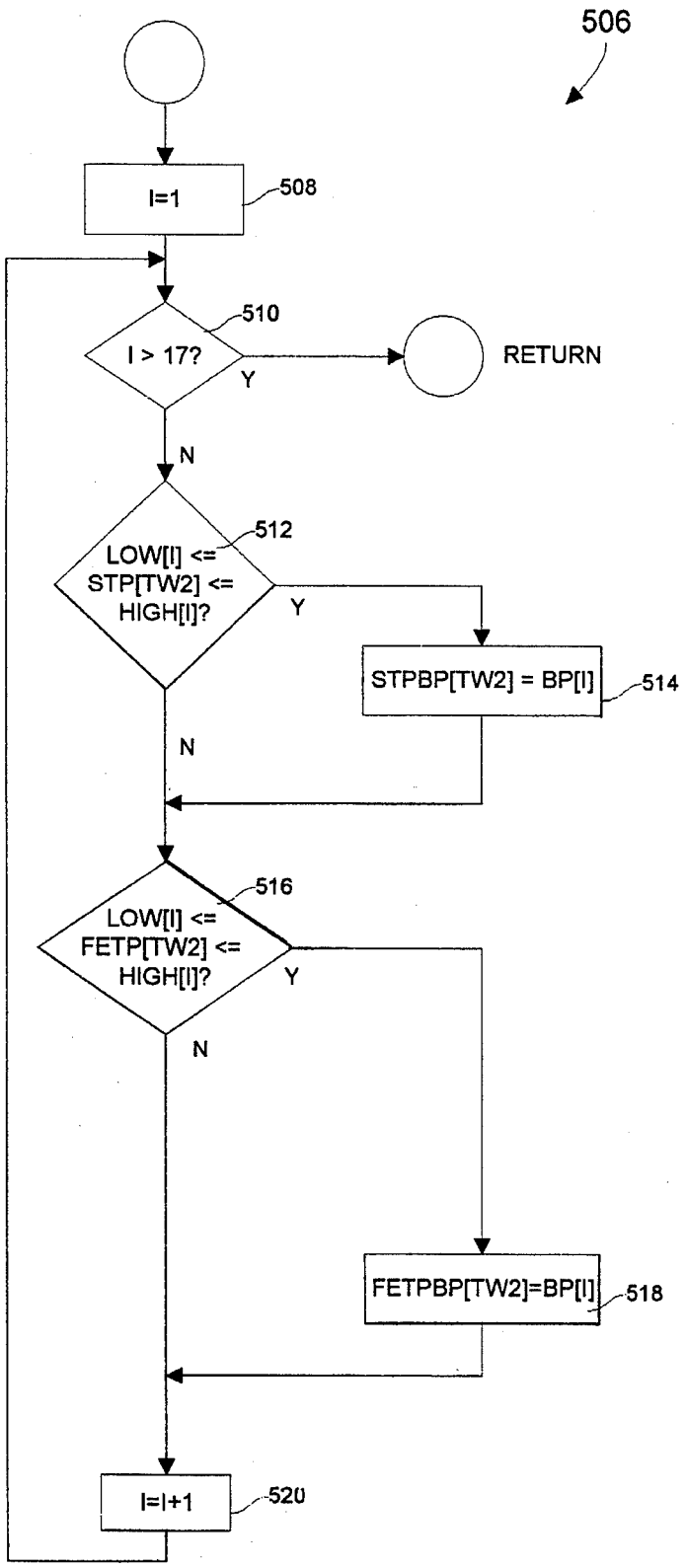
FIG. 12 comprises a detailed flowchart illustrating the operation of still another portion of the automatic timing-adjustment apparatus shown in FIGS. 7A–7C.

The subroutine called by the block 506 (FIG. 11F) for converting the solenoid timing point STP[TW2] and the feed-line eye timing point FETP[TW2] from decimal degree values into bit patterns representing those values is shown in FIG. 12 and is now described in detail.

Initially, the block 508 sets a counter I equal to one. Thereafter, the block 510 determines whether the counter I is greater than seventeen. If so, execution of the programming sequence shown in FIG. 12 ends, and control returns to the point where this programming sequence was called (i.e. to the block 506 (FIG. 11F)), and thereafter to the point where the programming sequence shown in FIGS. 11A–11F was called.

If the block 510 determines that the counter I is less than or equal to seventeen, a block 512 determines whether the solenoid timing point STP[TW2] of the selected feeding device 22 is between the Ith lower angular degree limit LOW[I] and the Ith upper angular degree limit HIGH[I] (i.e., whether LOW[TW2]≦STP[TW2]≦HIGH[TW2]). If so, the block 514 sets the solenoid timing point bit pattern STPBP [TW2] for the selected feeding device 22 equal to the Ith pre-stored bit pattern BP[I], and control passes to a block 516. If not, the block 514 is bypassed and control passes directly to the block 516.

The block 516 determines whether the feed-line eye timing-point FETP[TW2] of the selected feeding device 22 is between the Ith lower angular degree limit LOW[I] and the Ith upper angular degree limit HIGH[I]. If so, the block 518 sets the feed-line eye timing-point bit pattern FETPBP [TW2] for the selected feeding device 22 equal to the Ith pre-stored bit pattern BP[I], and control passes to a block 520 which increments the counter I by one and returns control to the block 510 to test the value of the counter I once again. If the block 516 determines that the feed-line eye timing point FETP[TW2] of the selected feeding device 22 is not between LOW[I] and HIGH[I], inclusive, then the block 518 is bypassed and control passes directly to the block 520, which increments the counter I by one and returns control to the block 510.

The automatic pocket set-up programming sequence or subroutine that implements the automatic set-up of all pockets (but not of other types of feeding devices 22) in the gathering section 20 of the binding line is shown in FIG. 13 and is now described in detail. This subroutine is executed by the block 320 of FIG. 7C when the thumbwheel 34 (FIG. 2B) is set to 999. Moreover, as explained in detail below (and as shown in FIG. 4), this subroutine is repeatedly executed while the keyswitch 44 (FIG. 2B) is on and the thumbwheel 34 (FIG. 2B) is set to 999.

First, a block 522 initializes a counter J to one. Thereafter, a block 524 tests whether J exceeds the number ND of devices in the binding line gathering section 20. If so, execution of this subroutine ends, and control returns to the point where this subroutine was called (i.e., the block 320 (FIG. 7C)). Otherwise, a block 526 tests whether the feed-line eye blocked bit FEBB[J] for the feed-line eye 88 of the Jth feeding device 22 is set. As explained above, the Jth feed-line eye blocked bit FEBB[J] is automatically set as soon as the Jth feed-line eye 88 becomes blocked by a signature 62 and remains set until the end of the program cycle. As also described above, unless means are provided for enabling the controller 26 to determine which feeding devices 22 are pockets 22, all non-pocket feeding devices 22 must be emptied of signatures 64 or turned off during this operation to prevent the timing points and shift-register positions of the non-pocket feeding devices 22 from being incorrectly set during this operation.

Accordingly, if FEBB[J] is set, the Jth feeding device 22 is necessarily a pocket 22, so control passes to a block 528 which tests whether the angular position AP of the binding line gathering section 20 in its machine cycle is greater than or equal to the feed-line eye blocked constant FEBC. If so, a block 530 sets the solenoid timing point STP[J] of the Jth feeding device 22 (a pocket) equal to the angular position AP minus the feed-line eye blocked constant FEBC. It should be noted that this calculation is made when the angular position AP is equal to the angular position of the gathering section 20 in its machine cycle at which the feed-line eye 88 is just blocked by a signature 64. The solenoid timing point STP[J] of the Jth pocket 22 is calculated based on this value so that the solenoid 92 of the Jth pocket 22 can be energized in time to prevent the pocket 22 from feeding a signature 64 for an already defective book (or for a book from which the signature 64 should be purposely omitted).

If the angular position AP is less than the feed-line eye blocked constant FEBC, a block 532 sets the solenoid timing point STP[J] of the Jth feeding device 22 equal to 360° plus AP minus FEBC. Thereafter, in either case, a block 534 executes the programming sequence or subroutine described above in connection with FIGS. 11A–11F for setting up the timing points and shift-register positions associated with the Jth feeding device 22 (a pocket). When control is returned from that subroutine, or if the feed-line eye blocked bit FEBB[J] of the Jth feeding device 22 is not set, indicating that the Jth feeding device 22 is not a pocket 22, a block 536 increments the counter J by one, and control is returned to the block 524 which again tests whether the value of the counter J exceeds the number ND of feeding devices 22 in the binding line gathering section 20.

Significantly, the automatic set-up operation is not complete until a signature 64 has been deposited on the gathering chain 24 (or at least fed) by each pocket 22 for which timing points and shift-register positions must be reset. The reason for this is that, even though the automatic pocket set-up subroutine of FIG. 13 tests all ND feeding devices 22, one at a time, to determine whether the feed-line eye blocked bit FEBB[] of each feeding device 22 is set (i.e., to determine whether the feeding device 22 is a pocket 22), the feeding-device set-up subroutine of FIG. 11 is executed by the block 534 (FIG. 13) for only those feeding devices 22 (necessarily pockets 22) whose feed-line eyes 88 have become blocked during the current program cycle (as indicated by the respective feed-line eye blocked bits FEBB[] being set). Consequently, because the pockets 22 do not necessarily feed signatures 64 and thus block their respective feed-line eyes 88 in sequence, the pockets 22 are not necessarily set up sequentially by the subroutine of FIG. 13 in ascending order of device number.

Instead, during any particular program cycle, multiple pockets 22 will be set-up if multiple feed-line eye blocked bits FEBB[] corresponding to those multiple pockets 22 have been set during that particular program cycle as determined by the subroutine of FIG. 13. Accordingly, the subroutine of FIG. 13 may be required to be re-executed a number of times less than the number of pockets 22 in order for all pockets 22 to be set up. As long as the keyswitch 44 is on and the thumbwheel 34 is set to 999, the programming of FIGS. 7A–7C will be repeatedly executed as shown in FIG. 4, and the subroutine of FIG. 13 will be repeatedly executed until all pockets 22 have been set up.

The above-described embodiment of the present invention associates the book in each chain space 30 of the gathering section 20 with only one bit in the shift-register. However, it will be readily apparent to those skilled in the art how to apply the principle of the present invention to a system wherein several bits may be used to indicated several conditions of each book, rather than one bit being used to indicate one condition (i.e., defective v. non-defective).

The foregoing description is for the purpose of teaching those skilled in the art the best mode of carrying out the invention and is to be construed as illustrative only. Numerous modifications and alternative embodiments of the invention will be apparent to those skilled in the art in view of this description. The details of the disclosed structure may be varied substantially without departing from the spirit of the invention, and the exclusive use of all modifications within the scope of the appended claims is reserved.

What is claimed is:

1. A timing-adjustment apparatus for a binding line including a feeding device having a sensor that develops an output during each of a plurality of operational sequences indicating that a condition has arisen and controlling means responsive to the sensor output for controlling the binding line, comprising:

storing means operable during an initial operational sequence for storing an operator-defined time period during which the condition is expected to arise in each subsequent operational sequence;

developing means responsive to the storing means and operable during an operational sequence subsequent to the initial operational sequence for developing an indication for an operator of the binding line that the operator-defined time period has been reached; and changing means coupled to the storing means for changing the operator-defined time period in an operational sequence subsequent to the initial operational sequence based on the indication.

2. The timing-adjustment apparatus of claim 1, wherein the feeding device includes at least two sensors each of which develops an output detected by the controlling means during each of the operational sequences indicating that a corresponding one of a plurality of conditions has arisen, and wherein the timing-adjustment apparatus includes at least two storing means operable during the initial operational sequence for storing operator-defined time periods during each of which a respective condition is expected to arise and wherein the developing means develops an indication that the condition corresponding to an operator-selected one of the sensors has arisen.

3. The timing-adjustment apparatus of claim 1, wherein the binding line comprises a plurality of feeding devices, each including at least two sensors each of which develops an output detected by the controlling means during each of the operational sequences indicating that a corresponding one of a plurality of conditions has arisen, wherein the timing-adjustment apparatus includes at least two storing means operable during the initial operational sequence for storing operator-defined time periods during each of which a respective condition is expected to arise with respect to each of the sensors, and wherein the developing means develops an indication that the condition corresponding to an operator-selected one of the sensors has arisen.

4. The timing-adjustment apparatus of claim 3, wherein each feeding device includes a feed-line at which a plurality of signatures is drawn into the feeding device and detecting means for detecting the absence of a signature at the feed-line.

5. The timing-adjustment apparatus of claim 4, wherein the detecting means comprises a feed-line sensor.

6. The timing-adjustment apparatus of claim 3, wherein the binding line includes conveying means for conveying a plurality of signatures.

7. The timing-adjustment apparatus of claim 6, wherein the conveying means comprises a plurality of conveying spaces, and the controlling means includes a plurality of storage locations for storing a plurality of bits, each representing a condition of a book on the binding line at a particular conveying space, and wherein the bits are successively shifted through the storage locations as the conveying means is conveying signatures, and further comprising setting means responsive to the sensor output of one of the sensors of one of the feeding devices for setting one of the bits in a first storage location associated with the sensor, and associating means coupled to the setting means for associating a second storage location different from the first storage location with the sensor.

8. The timing-adjustment apparatus of claim 7, wherein the bit in the first storage location is set in response to the sensor output of a particular sensor of a particular feeding device if the particular sensor detects that a signature will be missing from a particular conveying space associated with the sensor.

9. The timing-adjustment apparatus of claim 6, wherein each feeding device includes positioning means for positioning a signature on the conveying means and detecting means for detecting the absence of a signature at the positioning means.

10. The timing-adjustment apparatus of claim 9, wherein the positioning means comprises a saddle.

11. The timing-adjustment apparatus of claim 10, wherein the detecting means comprises a saddle sensor.

12. The timing-adjustment apparatus of claim 3, wherein each feeding device includes engaging means moveable between first and second positions for engaging a signature, and retaining means coupled to the engaging means and the controlling means for retaining the engaging means in the second position.

13. The timing-adjustment apparatus of claim 12, wherein the engaging means comprises a sucker bar having a plurality of suckers.

14. The timing-adjustment apparatus of claim 12, wherein the retaining means comprises a solenoid.

15. The timing-adjustment apparatus of claim 12, wherein the engaging means comprises a sucker bar having a plurality of suckers and the retaining means comprises a solenoid operable to turn off the suckers.

16. The timing-adjustment apparatus of claim 3, wherein the binding line includes gathering means for gathering and conveying a plurality of signatures along the binding line and a plurality of gathering pins secured at equally-spaced locations along the gathering means, and wherein each feeding device includes a saddle adjacent the gathering means, holding means for holding the plurality of signatures, a sucker bar moveable between first and second positions and operable in each operational sequence for moving a signature from the holding means to a feed-line, a feed-line sensor operable during a time period associated with the feed-line sensor in each operational sequence for detecting the absence of a signature at the feed-line, a saddle sensor operable during a time period associated with the saddle sensor in each operational sequence for detecting the absence of a signature on the saddle of the feeding device, and a solenoid coupled to the sucker bar for locking the sucker bar in the first position.

17. The timing-adjustment apparatus of claim 1, wherein each operational sequence consists of at least a first time period and a second time period, the apparatus further comprising signalling means operable in each operational sequence during a particular one of the first and second time periods for signalling that the particular one of the first and second time periods has been reached in each operational sequence.

18. The timing-adjustment apparatus of claim 17, wherein the signalling means includes a light.

19. The timing-adjustment apparatus of claim 18, wherein, during an operational sequence, the light is on during the one of the first and second time periods and off during the other of the first and second time periods.

20. The timing-adjustment apparatus of claim 17, wherein the particular one of the first and second time periods is the operator-defined time period.

21. The timing-adjustment apparatus of claim 1, further comprising first signalling means operable in each operational sequence for signalling either that the operator-defined time period has been reached or that the operator-defined time period has not been reached.

22. The timing-adjustment apparatus of claim 21, further comprising second signalling means operable in each operational sequence for signalling either that the operator-defined time period can be changed or that the operator-defined time period should not be changed.

23. The timing-adjustment apparatus of claim 22, wherein the first and second signalling means include respective first and second lights.

24. The timing-adjustment apparatus of claim 23, wherein the first and second lights are different colors.

25. The timing-adjustment apparatus of claim 1, further comprising signalling means operable in each operational sequence for signalling either that the operator-defined time period can be changed or that the operator-defined time period should not be changed.

26. A timing-adjustment apparatus for a binding line including a plurality of feeding devices, each including a plurality of sensors each of which develops an output during each of a plurality of operational sequences indicating that a corresponding one of a plurality of conditions has arisen, and a conveyor having a plurality of conveyor spaces for conveying a plurality of signatures, and controlling means responsive to the sensor outputs for controlling the binding line, comprising:

a plurality of storage locations for storing a plurality of bits, each representing a condition of a book on the binding line at a particular conveyor space, wherein the bits are successively shifted through the storage locations as the conveyor is conveying signatures;

setting means responsive to the sensor output of a particular sensor of one of the feeding devices for setting one of the bits in a first storage location associated with the sensor; and associating means responsive to a detected loss of synchronism between the feeding devices and the conveyor spaces and coupled to the setting means for associating a second storage location different from the first storage location with the particular sensor.

27. A timing-adjustment method for adjusting timing of a binding line including a feeding device having a sensor that develops an output during each of a plurality of operational sequences indicating that a condition has arisen and controlling means responsive to the sensor output for controlling the binding line, comprising the steps of:

(a) storing, during an initial operational sequence, an operator-defined time period during which the condition is expected to arise in each subsequent operational sequence;

(b) providing, during an operational sequence subsequent to the initial operational sequence and in response to the operator-defined time period, an indication for an operator of the binding line that the operator-defined time period has been reached; and (c) changing, during an operational sequence subsequent to the initial operational sequence, the operator-defined time period in response to the indication.

28. The timing-adjustment method of claim 27, wherein each operational sequence consists of at least a first time period and a second time period, the method further comprising the step of signalling, during a particular one of the first and second time periods of each operational sequence, that the particular one of the first and second time periods has been reached in each operational sequence, and wherein the operator-defined time period should not be changed during the particular one of the first and second time periods.

29. The timing-adjustment method of claim 27, wherein each operational sequence consists of at least a first time period and a second time period, the method further comprising the step of signalling, during a particular one of the first and second time periods of each operational sequence, that the particular one of the first and second time periods has been reached in each operational sequence, and wherein the operator-defined time period can be changed during the particular one of the first and second time periods.

30. The timing-adjustment method of claim 27, wherein the binding line includes a plurality of feeding devices, each having a sensor that develops an output during each of a plurality of operational sequences indicating that a corresponding condition has arisen, the method further comprising the step of selecting a particular feeding device for which the step (c) is to change an operator-defined time period.

31. The timing-adjustment method of claim 27, wherein the feeding device, has a plurality of sensors, each of which develops an output during each of a plurality of operational sequences indicating that a corresponding condition has arisen, the method further comprising the step of selecting a particular sensor, the corresponding operator-defined time period of which is to be changed by the step (c).

32. The timing-adjustment method of claim 27, further comprising the step of advancing the binding line to a desired position prior to the step (c).

33. The timing-adjustment method of claim 32, wherein the step (c) is performed only if the indication is not provided when the binding line is in the desired position.

34. An automatic timing-adjustment apparatus for a synchronous gathering section of a binding line including a feeding device having a sensor that develops an output during each of a plurality of operational sequences indicating that a condition has arisen and controlling means responsive to the sensor output for controlling the binding line, the apparatus comprising:

storing means operable during an initial operational sequence for storing a defined time period during which the condition is expected to arise in each subsequent operational sequence; and updating means responsive to the storing means and operable during an operational sequence subsequent to the initial operational sequence for automatically updating the defined time period during the subsequent operational sequence.

35. The automatic timing-adjustment apparatus of claim 34, wherein the binding line includes a plurality of feeding devices, each having a sensor that develops an output during each of a plurality of operational sequences indicating that a condition has arisen, the apparatus further comprising first means for storing a defined time period for each feeding device, second means for storing a defined time period of an operator-selected feeding device, third means for storing a defined time period for all feeding devices of a particular type, and fourth means for activating the first, second, and third means.

36. The automatic timing-adjustment apparatus of claim 34, wherein the binding line includes a plurality of feeding devices, each having a sensor that develops an output during each of a plurality of operational sequences indicating that a condition has arisen, the apparatus further comprising first means for storing a defined time period for each feeding device, second means for storing a defined time period of an operator-selected feeding device, third means for storing a defined time period for all feeding devices of a particular type, and fourth means for activating an operator-selected one of the first, second, and third means.

37. The automatic timing-adjustment apparatus of claim 34, wherein the feeding device includes at least two sensors each of which develops an output detected by the controlling means during each of the operational sequences indicating that a corresponding condition has arisen, wherein the storing means is operable during the initial operational sequence for storing defined time periods during each of which a respective condition is expected to arise, and wherein the updating means automatically updates at least one of the defined time periods during the subsequent operational sequence.

38. The automatic timing-adjustment apparatus of claim 37, wherein the storing means stores an operator-defined reference point and wherein the updating means automatically updates at least one of the defined time periods based upon the reference point.

39. The automatic timing-adjustment apparatus of claim 38, wherein the storing means stores an offset for each sensor and wherein a defined time period is automatically calculated for each particular sensor based at least in part on the offset for the particular sensor.

40. The automatic timing-adjustment apparatus of claim 38, wherein at least one of the defined time periods is one of a saddle-eye timing point, a feed-line eye timing point, and a solenoid timing point.

41. The automatic timing-adjustment apparatus of claim 34, wherein the binding line comprises a plurality of feeding devices, each including at least two sensors each of which develops a sensor output detected by the controlling means during each of the operational sequences indicating that a corresponding condition has arisen, wherein the storing means is operable during the initial operational sequence for storing a plurality of defined time periods during each of which a respective condition is expected to be sensed by a corresponding sensor, and wherein the updating means is responsive to the storing means for automatically updating a predetermined one of the plurality of defined time periods.

42. The automatic timing-adjustment apparatus of claim 41, wherein the updating means comprises means responsive to the storing means for automatically updating all of the defined time periods of an operator-specified one of the feeding devices.

43. The automatic timing-adjustment apparatus of claim 41, wherein each of the feeding devices is one of a plurality of types of feeding devices and at least one of the feeding devices is of a particular type of feeding device, and wherein the updating means comprises means responsive to the storing means for automatically updating each of the defined time periods of the feeding devices of the particular type.

44. The automatic timing-adjustment apparatus of claim 43, further comprising selecting means for selecting the particular type of feeding device.

45. The automatic timing-adjustment apparatus of claim 43, wherein the plurality of types of feeding devices includes pockets, cardfeeders, SMUF PTF devices, and Dragon PTF devices.

46. The automatic timing-adjustment apparatus of claim 41, wherein each feeding device includes a feed-line at which a plurality of signatures is drawn into the feeding device and detecting means for detecting the absence of a signature at the feed-line.

47. The automatic timing-adjustment apparatus of claim 46, wherein the detecting means comprises a feed-line sensor.

48. The automatic timing-adjustment apparatus of claim 41, wherein the binding line includes conveying means for conveying a plurality of signatures.

49. The automatic timing-adjustment apparatus of claim 48, wherein the conveying means comprises a gathering chain.

50. The automatic timing-adjustment apparatus of claim 48, wherein the conveying means comprises a plurality of conveying spaces, and the controlling means includes a plurality of storage locations for storing a plurality of bits, each representing a condition of a book on the binding line at a particular conveying space, and wherein the bits are successively shifted through the storage locations as the conveying means is conveying signatures, and setting means responsive to the sensor output of one of the sensors of one of the feeding devices for setting one of the bits in a first storage location associated with the sensor and associating means coupled to the setting means for associating a second storage location different from the first storage location with the sensor.

51. The automatic timing-adjustment apparatus of claim 50, further comprising associating means coupled to the setting means for associating respective second storage locations different from the respective first storage locations with all of the sensors of an operator-specified one of the feeding devices.

52. The automatic timing-adjustment apparatus of claim 50, wherein each of the feeding devices is one of a plurality of types of feeding devices and at least one of the feeding devices is of a particular type of feeding device, the apparatus further comprising associating means coupled to the setting means for automatically associating respective second storage locations different from the respective first storage locations with all of the sensors of all of feeding devices of the particular type.

53. The automatic timing-adjustment apparatus of claim 52, further comprising selecting means for selecting the particular type of feeding device.

54. The automatic timing-adjustment apparatus of claim 52, wherein the plurality of types of feeding devices includes pockets, cardfeeders, SMUF PTF devices, and Dragon PTF devices.

55. The automatic timing-adjustment apparatus of claim 48, wherein each feeding device includes positioning means for positioning a signature on the conveying means and means for detecting the absence of a signature at the positioning means.

56. The automatic timing-adjustment apparatus of claim 55, wherein the positioning means of at least one of the feeding devices comprises a saddle.

57. The automatic timing-adjustment apparatus of claim 56, wherein the detecting means of at least one of the feeding devices comprises a saddle sensor.

58. The automatic timing-adjustment apparatus of claim 57, wherein a defined time period is associated with each saddle sensor, further including updating means responsive to the storing means for automatically updating the defined time period associated with the saddle sensor of each of the feeding devices.

59. The automatic timing-adjustment apparatus of claim 41, wherein each feeding device includes engaging means moveable between first and second positions for engaging a signature and retaining means coupled to the engaging means and the controlling means for retaining the engaging means in the second position.

60. The automatic timing-adjustment apparatus of claim 59, wherein the engaging means comprises a sucker bar having a plurality of suckers.

61. The automatic timing-adjustment apparatus of claim 59, wherein the retaining means comprises a solenoid.

62. The automatic timing-adjustment apparatus of claim 59, wherein the engaging means comprises a sucker bar having a plurality of suckers and the retaining means comprises a solenoid operable to turn off the suckers.

63. The automatic timing-adjustment apparatus of claim 41, wherein the binding line includes a gathering chain for conveying a plurality of signatures along the binding line and a plurality of gathering pins secured at equally-spaced locations along the gathering chain, and wherein each feeding device includes a saddle adjacent the gathering chain, a feed chain for holding the plurality of signatures, a sucker bar moveable between first and second positions and operable in each operational sequence for moving a signature from the feed chain to a feed-line, a feed-line sensor operable during a time period associated with the feed-line sensor in each operational sequence for detecting the absence of a signature at the feed-line, a saddle sensor operable during a time period associated with the saddle sensor in each operational sequence for detecting the absence of a signature at the saddle of the feeding device, and a solenoid coupled to the sucker bar for locking the sucker bar in the first position.

64. The automatic timing-adjustment apparatus of claim 34, wherein the storing means stores an operator-defined reference point and wherein the updating means automatically updates the defined time period based upon the reference point.

65. The automatic timing-adjustment apparatus of claim 64, wherein the operator-defined reference point is based upon the relative positions of the sensor and the binding line.

66. The automatic timing-adjustment apparatus of claim 64, wherein the binding line includes at least two feeding devices, each having at least one sensor that develops an output during each of a plurality of operational sequences indicating that a condition has arisen, and wherein the operator-defined reference point is associated with a particular sensor in a particular one of the feeding devices.

67. The automatic timing-adjustment apparatus of claim 66, wherein the particular sensor is one of a feed-line eye and a saddle eye.

68. The automatic timing-adjustment apparatus of claim 64, wherein the operator-defined reference point includes a time reference and a bit reference for a particular sensor and wherein the updating means automatically updates the defined time period based upon the time reference and the bit reference.

69. An automatic timing-adjustment apparatus for a binding line including a plurality of feeding devices each including a plurality of sensors each of which develops an output during each of a plurality of operational sequences indicating that a corresponding one of a plurality of conditions has arisen and a conveyor having a plurality of conveyor spaces for conveying a plurality of signatures, and controlling means responsive to the sensor outputs for controlling the binding line, comprising:

a plurality of storage locations for storing a plurality of bits, each representing a condition of a book on the binding line at a particular conveyor space, wherein the bits are successively shifted through the storage locations as the conveyor is conveying signatures;

setting means responsive to the sensor output of a particular sensor of one of the feeding devices for setting one of the bits in a first storage location associated with the particular sensor; and associating means responsive to a detected loss of synchronism between the feeding devices and the conveyor spaces and coupled to the setting means for automatically associating a second storage location different from the first storage location with the particular sensor.

70. The automatic timing-adjustment apparatus of claim 69, wherein the storage location associated with the particular sensor is a saddle-eye shift-register position if the particular sensor is a saddle eye and a feed-line eye shift-register position if the particular sensor is a feed-line eye.

71. The automatic timing-adjustment apparatus of claim 69, further comprising:

a plurality of defeat storage locations for storing a further plurality of bits, each representing a condition of a book on the binding line at a particular conveyor space, wherein the bits are successively shifted through at least some of the storage locations as the conveyor is conveying signatures;

preventing means responsive to the value of the bit stored in a first defeat storage location associated with a particular sensor of one of the feeding devices for preventing the setting means from setting the bit in the first storage location associated with the particular sensor; and second associating means responsive to a detected loss of synchronism between the feeding devices and the conveyor spaces and coupled to the preventing means for automatically associating a second defeat storage location different from the first defeat storage location with the particular sensor.

72. The automatic timing-adjustment apparatus of claim 71, wherein the defeat storage location associated with the particular sensor is a saddle-eye defeat shift-register position if the particular sensor is a saddle-eye and a feed-line eye defeat shift-register position if the particular sensor is a feed-line eye.

* * * * *